US011549507B2

(12) United States Patent
Klassen et al.

(10) Patent No.: US 11,549,507 B2
(45) Date of Patent: Jan. 10, 2023

(54) HYPOTROCHOID POSITIVE-DISPLACEMENT MACHINE

(71) Applicant: Genesis Advanced Technology Inc., Surrey (CA)

(72) Inventors: James Brent Klassen, Osoyoos (CA); Alexander Sean Li, Surrey (CA); Arthi Muniyappan, North Vancouver (CA); Benjamin McGhie, Surrey (CA); Justin Michael Hebert, Airdrie (CA); Javier Peter Fernandez-Han, Burnaby (CA); Timothy Davis Burson, New Westminster (CA)

(73) Assignee: Genesis Advanced Technology Inc., Surrey (CA)

( * ) Notice: Subject to any disclaimer, the term of this patent is extended or adjusted under 35 U.S.C. 154(b) by 0 days.

(21) Appl. No.: 17/508,885

(22) Filed: Oct. 22, 2021

(65) Prior Publication Data

US 2022/0397113 A1 Dec. 15, 2022

Related U.S. Application Data

(60) Provisional application No. 63/240,362, filed on Sep. 2, 2021, provisional application No. 63/209,948, filed on Jun. 11, 2021.

(51) Int. Cl.
*F04C 2/10* (2006.01)
*F04C 15/00* (2006.01)

(52) U.S. Cl.
CPC ..... *F04C 2/10* (2013.01); *F04C 15/0019* (2013.01); *F04C 2210/1094* (2013.01);
(Continued)

(58) Field of Classification Search
CPC ..... F04C 2/10; F04C 15/0019; F04C 2210/1094; F04C 2210/20;
(Continued)

(56) References Cited

U.S. PATENT DOCUMENTS 2,389,728 A * 11/1945 Hill ..... F01C 1/084 74/462
3,117,561 A 1/1964 Bonavera
(Continued)

FOREIGN PATENT DOCUMENTS

DE 4104397 A1 9/1991
DE 102012214243 A1 2/2014
(Continued)

OTHER PUBLICATIONS

Gupta, A. et al., 'Wankel Rotary Engine's Apex Seal/Trochoid Wear Chatter the Devil's Nail Marks Persist', *International Journal of Scientific and Research Publications*, 9(4):2250-3153, Apr. 2019, 6 pages.
(Continued)

*Primary Examiner* — Dominick L Plakkoottam
*Assistant Examiner* — Paul W Thiede
(74) *Attorney, Agent, or Firm* — Seed Intellectual Property Law Group LLP

(57) ABSTRACT

A displacement device including an inner rotor and an outer rotor with meshing projections. Points on each rotor trace a hypotrochoidal path relative to the other. The tips of the outer rotor projections may contact the inner rotor at Top Dead Center (TDC) and Bottom Dead Center (BDC) to form higher and lower pressure regions. Various elements may shape other elements to form seals.

25 Claims, 58 Drawing Sheets

(52) U.S. Cl.
CPC .... *F04C 2210/20* (2013.01); *F04C 2210/206* (2013.01); *F04C 2210/224* (2013.01); *F04C 2240/20* (2013.01); *F04C 2250/20* (2013.01); *F05C 2225/04* (2013.01)

(58) Field of Classification Search
CPC ..... F04C 2210/206; F04C 2210/224; F04C 2240/20; F04C 2250/20; F05C 2225/04
See application file for complete search history.

(56) References Cited

U.S. PATENT DOCUMENTS 3,758,243 A 9/1973 Fox
3,887,311 A 6/1975 Louzecky
4,100,664 A 7/1978 Straesser
5,720,251 A 2/1998 Round et al.
5,820,504 A * 10/1998 Geralde ..... F16H 1/32 475/180
6,089,843 A * 7/2000 Kondoh ..... F16C 33/121 419/30
6,273,695 B1 8/2001 Arbogast et al.
6,893,239 B2 * 5/2005 Pippes ..... F04C 2/102 418/171
9,127,671 B2 9/2015 Ono et al.
9,670,924 B2 6/2017 Holtzapple et al.
2005/0063851 A1 3/2005 Phillips
2012/0248903 A1 * 10/2012 Cullen ..... H02K 3/51 310/53
2014/0299094 A1 * 10/2014 Li ..... F01C 11/004 123/205
2017/0370359 A1 12/2017 Kimura et al.
2018/0172000 A1 6/2018 Hattori et al.
2020/0300243 A1 * 9/2020 Rosenbarger ..... F04C 2/088

FOREIGN PATENT DOCUMENTS

EP 0661454 A1 11/1994
EP 1493926 A2 6/2004
JP 6481399 B2 3/2019

OTHER PUBLICATIONS

Warren, S., "New Rotary Engine Designs by Deviation Functions Method," UCLA Electronic Theses and Dissertations, University of California, Los Angeles, 2012, 138 pages.
Thomas A Xometry Company, 'All About Internal Gear Pump—What They Are and How They Work,' Article downloaded from Insights. URL=https://www.thomasnet.com/articles/pumps-valves-accessories/internal-gear-pumps. pp. 1-4; Jul. 8, 2021.

* cited by examiner

HYPOTROCHOID POSITIVE-DISPLACEMENT MACHINE

TECHNICAL FIELD

Internal gear fluid transfer devices.

SUMMARY

A displacement device may have a housing, an inner rotor and an outer rotor. The inner rotor may be fixed for rotation relative to the housing about a first axis, and the outer rotor fixed for rotation relative to the housing about a second axis parallel to and offset from the first axis. The inner rotor has radially outward-facing projections, and the outer rotor radially inward-facing projections configured to mesh with the radially outward facing projections of the inner rotor. The inner rotor, outer rotor and housing may collectively form a set of components arranged for relative motion in planes perpendicular to the first axis, the set of components defining axially facing surfaces including at least one surface pairing arranged to form an interface between a first axially facing surface and a second axially facing surface of the at least one surface pairing, the first axially facing surface and the second axially facing surface being defined by different components of the set, the first axially facing surface of the at least one surface pairing being configured to shape or be shaped by, or both, the second axially facing surface of the at least one surface pairing.

In various embodiments, there may be included any one or more of the following features: the radially inward-facing projections of the outer rotor may seal against the radially outward-facing projections of the inner rotor at a Bottom Dead Center zone including Bottom Dead Center (BDC) of the displacement device, and seal against troughs between the radially outward-facing projections of the inner rotor at a Top Dead Center zone including Top Dead Center (TDC) of the displacement device, the BDC and TDC sealing zones separating the displacement device into higher and lower pressure regions. The radially inward-facing projections of the outer rotor, in combination with the sealing of the radially inward-facing projections of the outer rotor against the inner rotor, may be configured to produce substantially equal and opposite torques on the outer rotor as a result of their similar surface areas exposed to the higher pressure fluid at TDC and BDC. Two consecutive radially inward-facing projections of the radially inward-facing projections of the outer rotor and two consecutive zones between the radially outward-facing projections of the inner rotor may be respectively shaped such that a seal is maintained between the inner and outer rotor in a chamber past TDC to provide an internal expansion of compressed fluid that passes through TDC. Two consecutive radially outward-facing projections of the radially outward-facing projections of the inner rotor may be respectively shaped such that a seal is maintained between the inner and outer rotors in a chamber past BDC to provide an internal compression of fluid that passes through BDC. The at least one surface pairing may include a first housing surface pairing comprising a first surface of the housing and an outer surface of one of the inner rotor and the outer rotor arranged to form a first housing interface, the first surface of the housing being configured to shape or be shaped by, or both, the outer surface of the one of the inner rotor and the outer rotor. The housing may include a port plate, and the at least one surface pairing may include a port plate surface pairing comprising a surface of the port plate and an outer surface of one of the inner rotor and the outer rotor being arranged to form a port plate interface, the surface of the port plate being configured to shape or be shaped by, or both, the outer surface of the one of the inner rotor and the outer rotor. The outer surface of the one of the inner rotor and the outer rotor may be defined by an endplate of the one of the inner rotor and the outer rotor. The outer surface of the one of the inner rotor and the outer rotor may be an outer surface of the outer rotor. There may also be port plate interface fluid supply channels configured to supply fluid under pressure to the port plate interface for debris removal. There may also be proud port plate interface elements on the surface of the port plate or on the outer surface of the one of the inner rotor and the outer rotor, the proud port plate interface elements being arranged to shape the outer surface of the one of the inner rotor and the outer rotor in the case that the proud port plate interface elements are on the surface of the port plate, and the proud port plate interface elements being arranged to shape the surface of the port plate in the event that the proud port plate interface elements are on the outer surface of the one of the inner rotor and the outer rotor. The proud port plate interface elements may have spiral-shaped port plate interface shaping edges, the port plate interface shaping edges being oriented to push shaping debris from the port plate interface in a radially outward direction when the axially facing surfaces of the port plate surface pairing move in an expected direction of relative motion in use of the displacement device. The outer surface of the one of the inner rotor and the outer rotor may have the proud port plate interface elements. The surface of the port plate may comprise a plastic material over a metal backing plate. There may be an actuator for positioning the surface of the port plate in contact with or close to the surface of the one of the inner rotor and the outer rotor. The actuator may include a chamber in the housing configured to receive pressurized fluid, the port plate being in contact with the chamber to act as a piston. There may be a purge valve connecting the chamber to an inlet of the machine. There may be a biasing element biasing the port plate away from the outer surface of the one of the inner rotor and the outer rotor against a stop. The at least one surface pairing may include a first rotor surface pairing comprising a first surface of the inner rotor and a first surface of the outer rotor arranged to form a first rotor interface, the first surface of the outer rotor being configured to shape or be shaped by, or both, the first surface of the inner rotor. The first surface of the outer rotor may be defined by an endplate of the outer rotor. There may be first rotor interface fluid supply channels configured to supply fluid under pressure to the first rotor interface for debris removal. There may be proud first rotor interface elements on the first surface of the inner rotor or on the first surface of the outer rotor, the proud first rotor interface elements being arranged to shape the first surface of the inner rotor in the case that the proud first rotor interface elements are on the first surface of the outer rotor, and the proud first rotor interface elements being arranged to shape the first surface of the outer rotor in the event that the proud first rotor interface elements are on the first surface of the inner rotor. The proud first rotor interface elements may have spiral-shaped first rotor interface shaping edges, the first rotor interface shaping edges being oriented to push shaping debris from the first rotor interface in a radially outward direction when the surfaces of the first rotor surface pairing move in an expected direction of relative motion in use of the displacement device. The first surface of the outer rotor may have the proud first rotor interface elements. The at least one surface pairing may include a second rotor surface pairing comprising a second surface of the inner rotor and a second surface of the outer rotor arranged to form a second rotor interface, the second surface of the outer rotor being configured to shape or be shaped by, or both, the second surface of the inner rotor. The second surface of the outer rotor may be defined by a second endplate of the outer rotor. The second rotor interface fluid supply channels may be configured to supply fluid under pressure to the second rotor interface for debris removal. There may be proud second rotor interface elements on the second surface of the inner rotor or on the second surface of the outer rotor, the proud second rotor interface elements being arranged to shape the second surface of the inner rotor in the case that the proud second rotor interface elements are on the second surface of the outer rotor, and the proud second rotor interface elements being arranged to shape the second surface of the outer rotor in the event that the proud second rotor interface elements are on the second surface of the inner rotor. The proud second rotor interface elements may have spiral-shaped second rotor interface shaping edges, the second rotor interface shaping edges being oriented to push shaping debris from the second rotor interface in a radially outward direction when the surfaces of the second rotor surface pairing move in an expected direction of relative motion in use of the displacement device. The second surface of the outer rotor may have the proud second rotor interface elements. The at least one surface pairing may include a housing surface pairing comprising an axially-facing housing surface and a corresponding axially-facing surface of at least one of the inner rotor or the outer rotor arranged to form a housing interface, the axially-facing housing surface being configured to shape or be shaped by, or both, the corresponding axially facing surface. There may be interface fluid supply channels configured to supply fluid under pressure to the housing interface for debris removal. There may be proud housing interface elements on the axially-facing housing surface or on the corresponding axially-facing surface, the proud housing interface elements being arranged to shape the corresponding axially-facing surface in the case that the proud housing interface elements are on the axially-facing housing surface, and the proud housing interface elements being arranged to shape the axially-facing housing surface in the event that the proud second rotor interface elements are on the corresponding axially-facing surface. The proud housing interface elements may have spiral-shaped housing interface shaping edges, the second housing shaping edges being oriented to push shaping debris from the housing interface in a radially outward direction when the surfaces of the housing surface pairing move in an expected direction of relative motion in use of the displacement device. The axially-facing surface of the at least one of the inner rotor or the outer rotor may have the proud second rotor interface elements. There may be a fluid supply channel arrangement, which may include fluid supply channels supplying fluid to any one or more of the interfaces described above for debris removal. The fluid supply channel arrangement may include for example a flow passage through a shaft of the inner rotor. Fluid supply channels to different interfaces may be connected together or separate, and if separate may supply the same or a different fluid. The fluid may be the same as or different from a working fluid of the displacement device. The outer rotor may be configured to provide a clearance between roots of the inward-facing projections of the outer rotor and tips of the outward-facing projections of the inner rotor, the clearance selected to accommodate ice buildup between the projections of the outer rotor. There may be mounting features to mount the displacement device on an external surface or structure such that the first axis has a nonvertical, non-horizontal orientation in which a discharge port of the displacement device is located substantially at a lowest part of an active volume of the displacement device. The orientation of the first axis may be between 1 degree and 45 degrees from vertical. The inner rotor may comprise a shapable material, for example a machinable or abradable material. The inner rotor may comprise polytetrafluoroethylene (PTFE). There may be a screen arranged to contact a fluid flow into the displacement device, the screen arranged to have a screen temperature that cools more quickly than fluid-facing surfaces of the outer rotor when the displacement device is shut down after use. The screen may be thermally connected to a heat sink exposed to an ambient temperature. The radially inward-facing projections may have leading and trailing portions configured to contact the radially outward-facing projections of the inner rotor between the sealing zones. There may be flow channels arranged to prevent the formation of a sealed secondary chamber between the radially outward-facing projections of the inner rotor and the radially inward-facing projections of the outer rotor at or near Top Dead Center (TDC). The trailing portions of the radially inward-facing outer rotor projections may provide relative rotational positioning of the outer rotor and inner rotor and may provide a contact ratio between the rotors in a direction of rotation of 1 or greater. The leading portions of the radially inward-facing outer rotor projections may provide relative rotational positioning of the outer rotor and inner rotor and may provide a contact ratio between the rotors in a direction of rotation of 1 or greater. The radially outward-facing projections of the inner rotor may have shapable sealing zone surfaces comprising a shapable material, and portions of the inner rotor outward-facing projections providing rotational positioning relative to the outer rotor may also comprise the shapable material. Each of the axially facing surfaces of the at least one surface pairing may comprise an abradable material and may be configured to shape the other of the axially facing surfaces of the at least one surface pairing.

A displacement device may have a housing, an inner rotor and an outer rotor. The inner rotor may have a number of outward-facing projections, and the outer rotor may have a number of inward-facing projections. The inner rotor may be fixed for rotation relative to the housing about a first axis, and the outer rotor fixed for rotation relative to the housing about a second axis parallel to and offset from the first axis. The number of inward-facing projections of the outer rotor may be, for example, greater by one than the number of outward-facing projections of the inner rotor. The outward-facing projections of the inner rotor and the inward-facing projections of the outer rotor may intermesh, the outer rotor and the inner rotor being configured to rotate at a relative ratio of rotation speeds defined by a ratio of the number of inner rotor projections to the number of outer rotor projections. The inward-facing projections of the outer rotor may have inward-most tips defining hypotrochoid paths relative to the inner rotor, the inner rotor comprising tip sealing zones at tips of the outward-facing projections and trough sealing zones at troughs between the outward-facing projections, the tip sealing zones and the trough sealing zones being arranged to seal against the inward-most tips of the projections of the outer rotor as the inward-most tips trace the hypotrochoid paths.

In various embodiments, there may be included any one or more of the following features: the tip sealing zones may occur at a Bottom Dead Center zone including Bottom Dead Center (BDC) of the displacement device, and trough sealing zones may occur at a Top Dead Center zone including Top Dead Center (TDC) of the displacement device, the BDC and TDC sealing zones separating the displacement device into higher and lower pressure regions. The radially inward-facing projections of the outer rotor, in combination with the sealing of the radially inward-facing projections of the outer rotor against the inner rotor, may be configured to produce substantially equal and opposite torques on the outer rotor as a result of their similar surface areas exposed to higher pressure fluid at TDC and BDC. Two consecutive radially inward-facing projections of the radially inward-facing projections of the outer rotor and two consecutive zones between the radially outward-facing projections of the inner rotor may be respectively shaped such that a seal is maintained between the inner and outer rotor in a chamber past TDC to provide an internal expansion of compressed fluid that passes through TDC. Two consecutive radially outward-facing projections of the radially outward-facing projections of the inner rotor may be respectively shaped such that a seal is maintained between the inner and outer rotors in a chamber past BDC to provide an internal compression of fluid that passes through BDC. A screen may be arranged to contact a fluid flow into the displacement device, the screen arranged to have a screen temperature that cools more quickly than fluid-facing surfaces of the outer rotor when the displacement device is shut down after use. The screen may be thermally connected to a heat sink exposed to an ambient temperature. The sealing zones at the tips of the outward-facing projections or the sealing zones at the troughs between the outward-facing projections or both may be configured with the inward-most tips of the outer rotor to be shaped by the inward-most tips of the outer rotor. A first inward-facing projection of the outer rotor may have a first tip geometry different than a second tip geometry of a second inward-facing projection of the outer rotor, the first tip geometry having a sharper angle of incidence with the tips of the outward-facing projections of the inner rotor in a direction of relative motion at bottom Dead Center (BDC) and the second tip geometry having a sharper angle of incidence at the troughs between the outward-facing projections of the inner rotor in a direction of relative motion at Top Dead Center (TDC). The first tip and second tip may be arranged so that the first tip and the second tip trace a common hypotrochoid path relative to the inner rotor. The inward-facing projections of the outer rotor may include a plural number of sets of projections, the projections of each set having a respective common geometry, and the outer rotor projection number being a multiple of the plural number of the sets. The inward-most tips of the inward-facing projections of the outer rotor may be made of a harder material than the tip sealing zones and than the trough sealing zones and the inward-most tips of the inward-facing projections of the outer rotor may be configured to shape the tip sealing zones and the trough sealing zones in operation of the displacement device. The inward-facing projections of the outer rotor may be tapered to sharp edges at the inward-most tips. The inward-most tips of the outer rotor may be configured with rounded surfaces. Each point on the rounded surface may still define a hypotrochoid path and the sealing surfaces of the inner rotor may still be designed to seal against the rounded surfaces of the outer rotor tips, and the tips of the outer rotor fins, depending on the embodiment, may still shape, including e.g. wear-in, the inner rotor sealing surfaces. The tip sealing zones or the trough sealing zones or both may comprise radially movable seals. The radially movable seals may be radially movable at a first temperature and configured to become radially fixed or tighter fitting in their grooves at a second temperature. The inward-facing outer rotor projections may have leading and trailing portions configured to contact the outward-facing projections of the inner rotor between the tip sealing zones and the trough sealing zones. There may be flow channels arranged to prevent the formation of a sealed secondary chamber between the outward-facing projections of the inner rotor and the inward-facing projections of the outer rotor at or near Top Dead Center (TDC). For the purpose of this disclosure, a chamber is defined as a volume which is formed by contact or near contact interactions, for example a pair of such interactions, between two or more elements, for example between the inner rotor and the outer rotor. The trailing portions of the inward-facing outer rotor projections may provide relative rotational positioning of the outer rotor and inner rotor and provide a contact ratio between the rotors in a direction of rotation of one or greater. The leading portions of the inward-facing outer rotor projections may provide relative rotational positioning of the outer rotor and inner rotor and provide a contact ratio between the rotors in a direction of rotation of one or greater. A trough of the troughs between the outward-facing projections may have a shape such that a sealed chamber is maintained past Top Dead Center (TDC) to provide an internal expansion of fluid that passes through TDC. Other troughs, for example all of the troughs between the outward-facing projections, may be similarly shaped. An inner rotor projection of the outward-facing projections may have a shape such that a sealed chamber is maintained past Bottom Dead Center (BDC) to provide an internal compression of fluid that passes through BDC. Other projections, for example all of the outward-facing projections, may be similarly shaped. The tip sealing zones, the trough sealing zones, or both may comprise a shapable material, portions of the inner rotor outward-facing projections providing rotational positioning relative to the outer rotor also comprising the shapable material.

A method of running-in a displacement device may include providing a displacement device comprising an inner rotor and an outer rotor, the inner rotor having radially movable seals configured to seal against radially innermost tips of inward-facing projections of the outer rotor, the radially movable seals being radially movable or fixed depending on a temperature of the seals. The radially movable seals may be located at tips of outward-facing projections of the inner rotor or at troughs between the outward-facing projections of the inner rotor or both, The method may further include operating the displacement device at a first temperature, allowing the radially movable seals to radially advance, when the displacement device is operated at the first temperature, to respective top-out positions in which they contact the radially innermost tips of the inward-facing projections of the outer rotor, and, for example subsequently, operating the displacement device at a second temperature, the radially moveable seals being fixed in the respective top-out positions when the displacement device is operated at the second temperature.

In various embodiments, there may be included any one or more of the following features: the radial advancement of the radially moveable seals, when the displacement device is operated at the first temperature, may occur due to centrifugal force. The radially moveable seals may be biased radially inward. For example, the radially moveable seals may be biased radially inward by springs. The seals may alternatively be biased radially outward, e.g. by springs, for example such that radial advancement occurs under the biasing force. The seals may be disposed within grooves, the radially moveable seals being radially moveable at the first temperature and fixed or tighter in their grooves at the second temperature due to differential thermal expansion of the seals relative to a material defining the grooves. The seals being fixed may, for example, allow a position to be set that will establish a small gap. The seals being tighter may, for example, reduce leak paths around the seals within the grooves.

A further method of running-in a displacement device may include providing a displacement device, the displacement device comprising a housing and an inner rotor having radially outward-facing projections, the inner rotor being fixed for rotation relative to the housing about a first axis, and an outer rotor having radially inward-facing projections configured to mesh with the radially outward-facing projections of the inner rotor, the outer rotor being fixed for rotation relative to the housing about a second axis parallel to and offset from the first axis, and the inner rotor having a first axial facing surface and a second axial facing surface. The method may also include operating the displacement device under conditions such that the first axial facing surface interferes with a first corresponding axial facing surface of the outer rotor or the housing to cause the first corresponding axial facing surface to shape the first axial facing surface, or operating the displacement device under conditions such that the second axial facing surface interferes with a second corresponding axial facing surface of the outer rotor or the housing to cause the second corresponding axial facing surface to shape the second axial facing surface, or under conditions where both will occur. Subsequently, the displacement device may be operated under conditions where at least some of the above-mentioned interference does not occur.

In various embodiments, there may be included any one or more of the following features: the inner rotor may be constructed to cause the above-mentioned interference when the displacement device is operated as constructed, and the subsequent operation without interference may be due to the shaping of the inner rotor when the displacement device is operated as constructed. The conditions under which the interference occurs may be conditions in which the inner rotor has a first temperature, and the inner rotor may have a second temperature different from the first temperature during the subsequent operation without interference.

A still further method of running-in a displacement device may include providing a displacement device, the displacement device comprising a housing and an inner rotor having radially outward-facing projections, the inner rotor being fixed for rotation relative to the housing about a first axis, and an outer rotor having radially inward-facing projections configured to mesh with the radially outward-facing projections of the inner rotor, the outer rotor being fixed for rotation relative to the housing about a second axis parallel to and offset from the first axis, and the housing including a port plate having a port plate axially facing surface facing a corresponding axially facing surface of the inner rotor or the outer rotor. The method may also include operating the displacement device under conditions such that the port plate axial facing surface interferes with the corresponding axial facing surface of the inner rotor or the outer rotor to cause the corresponding axial facing surface to shape the port plate axial facing surface, and subsequently operating the displacement device without interference between the port plate axial facing surface and the corresponding axial facing surface.

In various embodiments, there may be included any one or more of the following features: the port plate may be constructed to cause interference when the displacement device is operated as constructed, and the subsequent operation without interference may be due to the shaping of the port plate when the displacement device is operated as constructed. The conditions such that the port plate axial facing surface interferes with the corresponding axial facing surface of the inner rotor or the outer rotor may be conditions in which the port plate has a first temperature, and the port plate may have a second temperature different from the first temperature during the subsequent operation without interference.

A method of clearing ice from a displacement device may be applied to displacement device having a housing, an inner rotor having radially outward-facing projections, the inner rotor being fixed for rotation relative to the housing about a first axis, an outer rotor having radially inward-facing projections configured to mesh with the radially outward-facing projections of the inner rotor, the outer rotor being fixed for rotation relative to the housing about a second axis parallel to and offset from the first axis, or to any displacement device as described above. The method includes the steps of operating the displacement device, an internal temperature of the displacement device during operation being greater than 0 degrees Celsius, ceasing to operate the displacement device, monitoring the internal temperature of the displacement device over a cool-down period after ceasing to operate the displacement device as the internal temperature of the displacement device cools towards an ambient temperature less than 0 degrees Celsius, on detecting that the internal temperature of the displacement device is approaching 0 degrees Celsius, rotating the displacement device to cause water in the displacement device to be displaced from the displacement device, for example by spinning the rotors of the displacement device to cause condensed water in the displacement device to be centrifuged away from the rotors of the displacement device. The detection that the internal temperature of the displacement device is approaching 0 degrees Celsius may be implemented by for example detecting that the internal temperature has reached a threshold temperature, or for example detecting that a temperature trend in the internal temperature will lead to 0 degrees Celsius or a different temperature threshold within a time threshold. The displacement device may include a screen arranged to filter fluid flow into the displacement device, the screen arranged to have a screen temperature lower than the device temperature of the displacement device during the cool-down period.

These and other aspects of the device and method are set out in the claims.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Disclosed in this document are geometries for, methods for the designing of, and variations of a pump or compressor or expander or related device which, in some embodiments, may offer low internal leakage, low internal friction, low manufacturing tolerance requirements, low wear during operation, and high efficiency.

Figure 1:
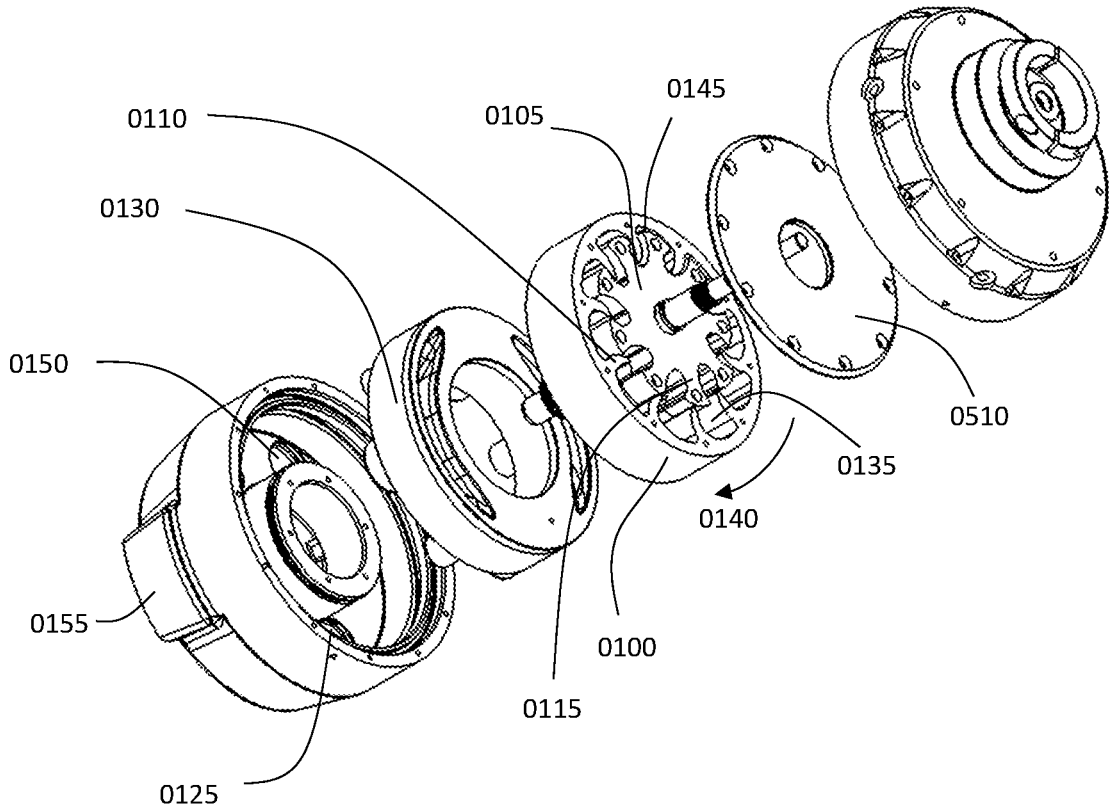
FIG. 1 is an exploded isometric view of an exemplary fluid transfer device showing a housing, port plate, outer rotor and inner rotor.

A non-limiting, exemplary embodiment of the device is shown in FIG. 1 in a simplified exploded view. Such a device may have, among other components, an outer rotor 0100, whose axis is parallel to, but not colinear with the axis of an inner rotor 0105. An outer rotor may have, among other features, radially inward-facing projections 0110, shaped referred to here as fins. Points on these fins 0110 of the outer rotor 0100 trace a hypotrochoidal path relative to an inner rotor 0105 when the device is in operation. This hypotrochoidal motion, in conjunction with outer rotor fin geometry and other features disclosed herein, may be used to derive the required device geometries to achieve advantages during operation which are discussed throughout this document.

An inner rotor 0105 may have, among other features, radially outward-facing projections 0115 (hereafter "lobes"), part of whose form is derived from that of the fins 0110 as the fins 0110 trace hypotrochoidal paths relative to the inner rotor 0105. It is also possible to begin with an inner rotor 0105 and derive the form of the fins 0110 on an outer rotor 0100. Further, it is possible to derive the forms of the fins and lobes in tandem. The derivation of the inner rotor lobe shape may be done precisely in the design phase and manufactured with no further shaping of the inner rotor lobes in operation. The derivation of these surfaces may also be done approximately and with some intended interference at operating condition during the design phase, such that the shaping of the surfaces may be done roughly during manufacturing and then more precisely during operation by means of a self-shaping effect as described below.

The device may be operated as a pump or compressor, or as a hydraulic motor or expander. The operation of the device as a pump or compressor described as follows:

Fluid entering the device from an intake port 0125 is drawn through a port plate 0130 into one or a plurality of chambers (such as that labeled) 0135, which are formed by a contact or near contact interaction between the inner rotor 0105 and the outer rotor 0100. Fluid is drawn into the device via the expansion of the one or plurality of the chambers 0135 when the rotors are rotated relative to a housing 0155 in a direction shown by arrow 0140.

The term "seal" as used in this document indicates components have a sufficiently small gap between them as to greatly increase the flow resistance through this gap from an area of high pressure to an area of lower pressure, such that rotation of the device at an operating speed and pressure provides positive displacement. A seal need not have zero leakage.

Fluid fills the one or plurality of chambers as the rotors 0100 and 0105 are rotated and the volume of the chambers increases, until such a time as the volume of the one or plurality of the chambers has reached an ideal value. In many cases it will be preferential to draw fluid into a chamber until its volume reaches a maximum value. The point in the rotation at which a chamber reaches a maximum value is referred to, in this disclosure, as Bottom Dead Center (BDC). For example, chamber 0135 is near or at BDC as shown in FIG. 1. When the working fluid (the fluid whose flow is controlled by the device) is a non-compressible fluid such as water or oil, it is desirable for the timing of the opening and closing of the ports to be arranged such that a point at which the chamber rotates to the BDC position and becomes sealed from the intake port is at or near the point where the same chamber opens to the discharge port. Similarly, when the working fluid is a compressible fluid or where it is desirable to increase the pressure of the compressible fluid before the chamber opens to the discharge port, it is desirable for the timing of the opening and closing of the ports to be arranged such that a point at which the chamber rotates to the BDC position and becomes sealed from the intake port is at the largest volume position of that chamber, and that the same chamber decreases in volume to achieve internal compression before that chamber opens to the discharge port. In other words, for a non-compressible fluid, it is important to ensure that chambers are always or almost always in communication with either the inlet or discharge port when they are changing volume to ensure that no or very little compression or expansion of the fluid is implied by a change in volume of the chambers at BDC, in practice reducing losses to friction that would otherwise occur as the incompressible fluid is forced through small gaps into or out of the chambers as they change in volume. Alternatively, for a compressible working fluid in an application where it is desirable to increase the pressure of the working fluid, it may be preferential to maintain the seal in each chamber from BDC until the chamber volume has reduced such that the pressure of the fluid is elevated to a desirable level, such as the pressure of the discharge port of the compressor.

Figure 3:
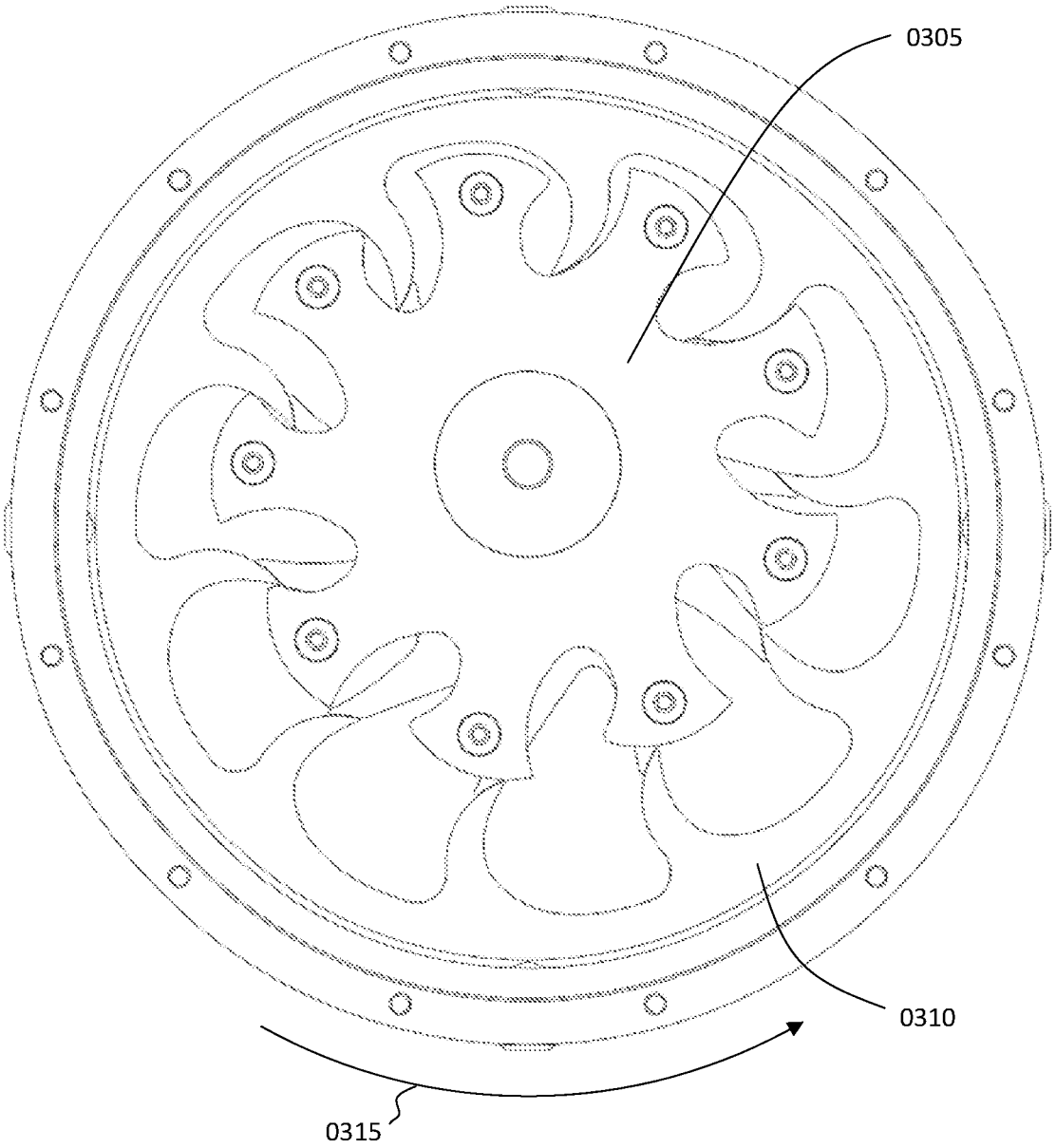
FIG. 3 is a top view of the exemplary fluid transfer device of FIG. 1 showing the inner and outer rotor as well as the housing.

The position at which the chambers have their smallest volume is referred to, in this disclosure, as Top Dead Center (TDC). For example, chamber 0145 is at or near TDC as shown in FIG. 1. After the fluid in the chambers is expelled out the discharge port and at or near the smallest volume position (TDC) the chambers may become sealed from the discharge port. For a non-compressible fluid, the chambers may also be opened to the intake port at or near this point. For a compressible fluid, it may be desirable to keep the chambers sealed for a rotation angle that allows expansion of the compressed fluid to a pressure near or equal to the pressure of the intake port. Fluid is expelled from the compression side of the device through a stationary port plate 0130, and from the device via an exhaust port 0150 in the housing 0155. Additional sealing beyond Top Dead Center or Bottom Dead Center may be provided by inner rotor projections that have shapes with sealing zones extending for a length such that two seals surrounding a chamber between the inner rotor and outer rotor are maintained while the chamber changes volume. As can be seen in for example FIG. 3, the inner rotor troughs in this embodiment allow a seal to be maintained past Top Dead Center (TDC) to provide an internal expansion of compressed fluid that passes through TDC. As also shown in FIG. 3, an inner rotor lobe projection in this embodiment has a shape that allows a seal to be maintained past Bottom Dead Center (BDC) to provide an internal compression of fluid that passes through BDC. To enable this internal compression and expansion, it is preferable that the chamber rotating chamber ports (not shown in this figure, illustrated in FIG. 5 as 0515), which allow a chamber to communicate with the inlet and discharge ports, close at or near BDC and TDC and remain closed long enough to allow the desired pressure to be reached inside the sealed chambers.

The disclosed invention may also be fitted with additional features or components which are not shown in FIG. 1 for clarity.

Figure 2:
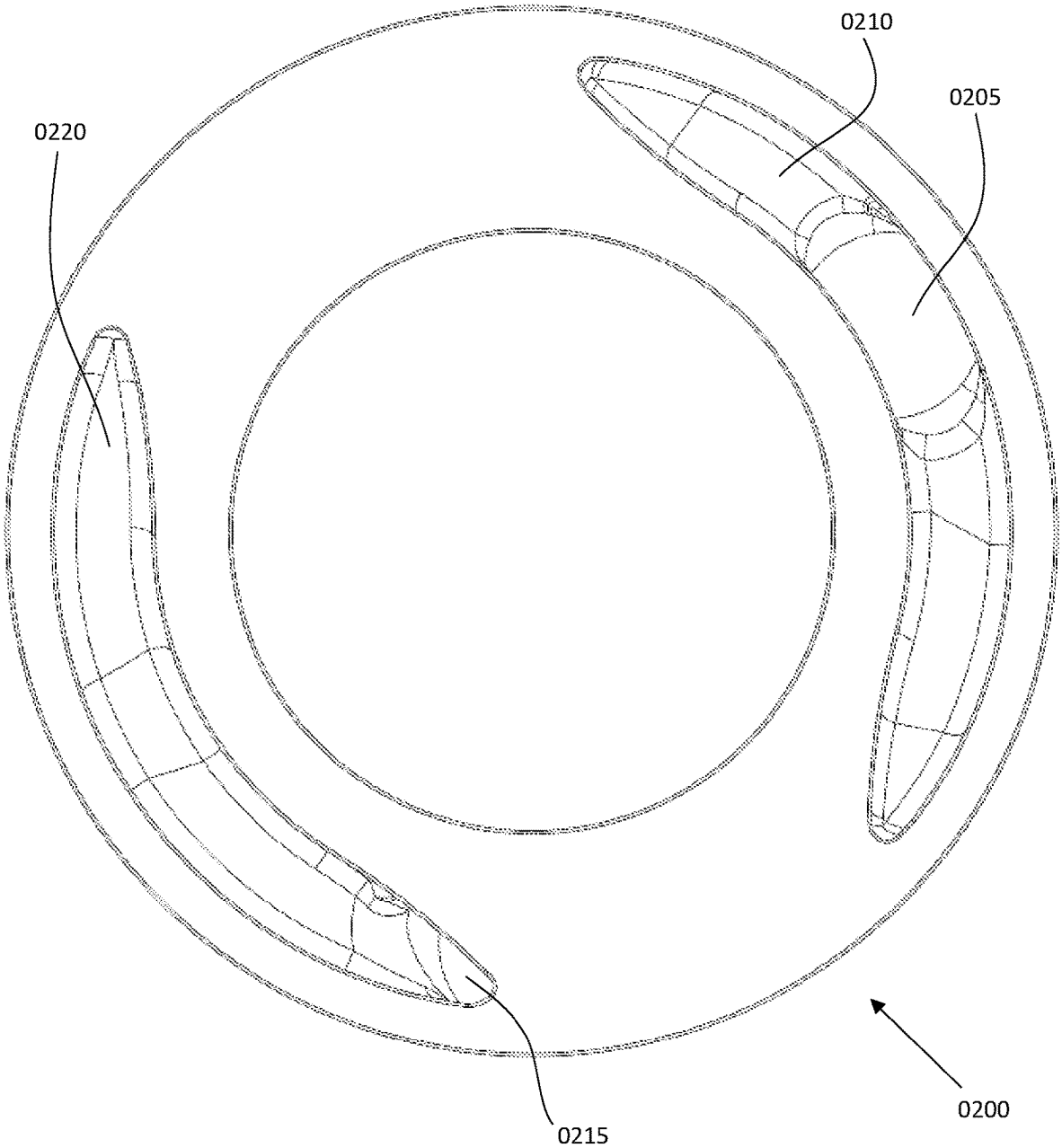
FIG. 2 is a top view of the port plate of the exemplary fluid transfer device of FIG. 1.
Figure 4:
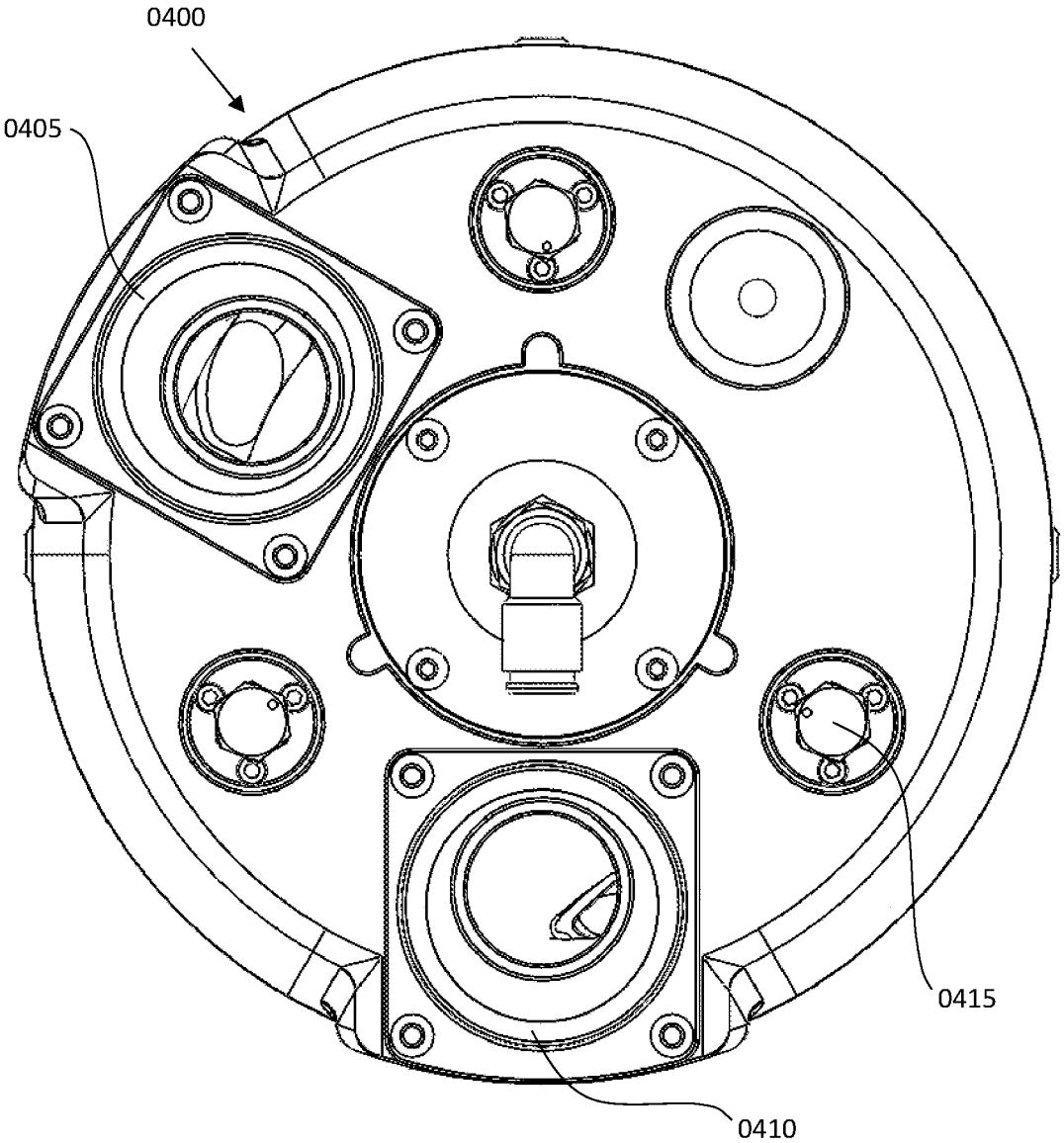
FIG. 4 is a bottom view of the housing of the exemplary fluid transfer device of FIG. 1 showing intake and exhaust ports, and port plate adjustment screws.

In FIG. 3, the preferred direction of rotation of the inner rotor 0305 and outer rotor 0310 in this non-limiting exemplary embodiment is shown by arrow 0315. As shown in FIGS. 2, 3, and 4, port plate 0200 may have an inlet port 0205, which may be connected to a port channel 0210 which may be exposed to one or more chambers which are undergoing expansion as the inner rotor 0305 and outer rotor 0310 rotate and may act as a manifold to combine and smooth flow from multiple chambers. Similarly, outlet port 0215 may be connected to outlet port channel 0220 which may be exposed to one or more chambers which are reducing in volume and expelling fluid into the outlet port channel as the inner rotor 0305 and outer rotor 0310 rotate and may act as a manifold to combine and smooth flow from multiple chambers. The fluid passes through the housing 0400 via intake port 0405 and exhaust port 0410.

Figure 7:
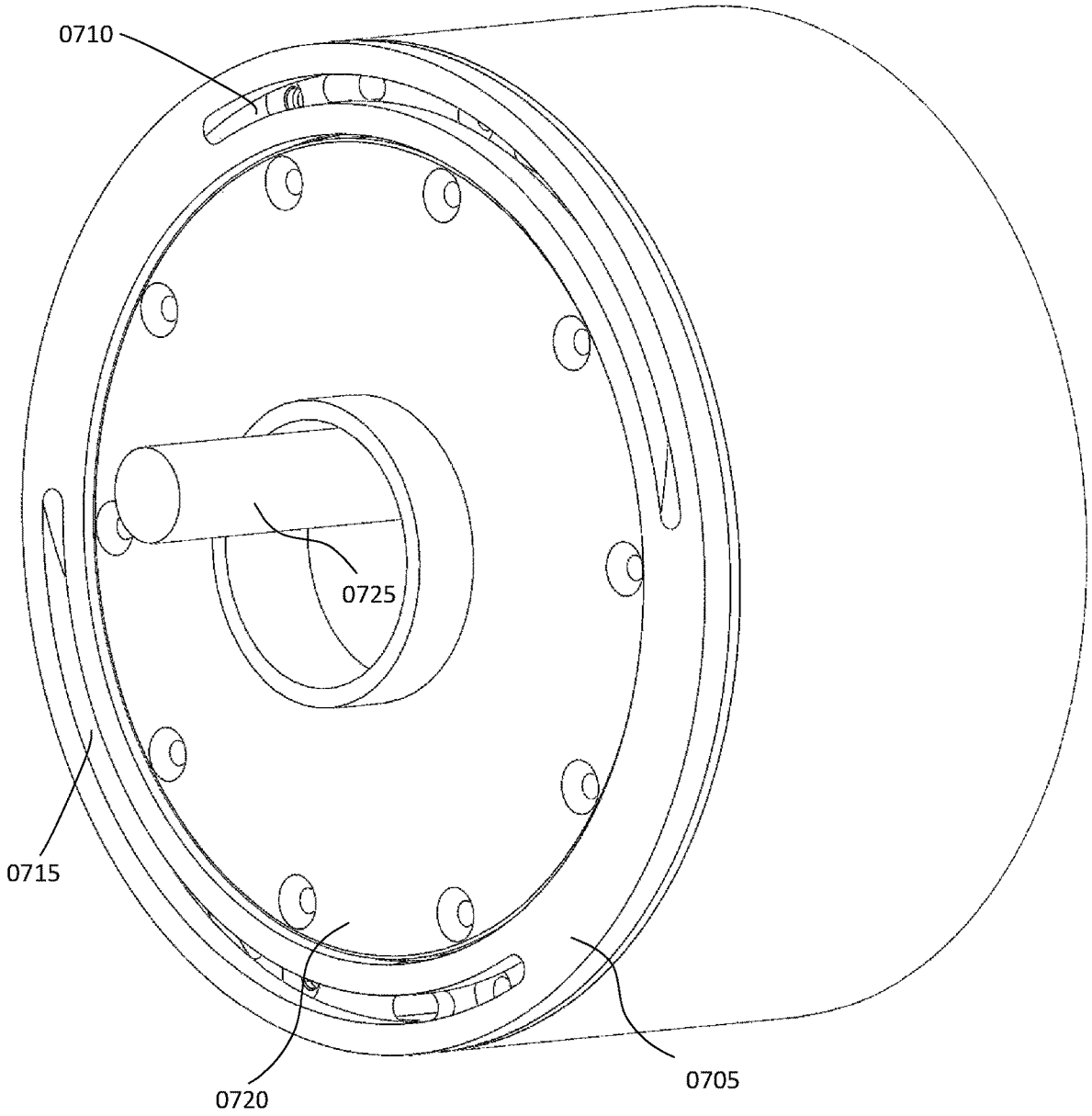
FIG. 7 is an isometric view of the further exemplary fluid transfer device of FIG. 5 showing a port plate, intake port and exhaust port.

A further non-limiting embodiment is shown in FIG. 7. This embodiment will be discussed in relation to operation as an expander. Whereas in a compressor arrangement port 0710 would be used as an intake with port 0715 acting as exhaust and shaft 0725 acting as a mechanical input for the inner rotor, the inventor anticipates that the device may be operated in an expander configuration wherein fluid is supplied to port 0715 which acts as the intake at a higher pressure than the pressure of the port 0710 which acts as a discharge port. As the fluid travels into the chambers formed between the rotors and expands, it causes the inner rotor and shaft 0725 to rotate, providing mechanical work. Many other port configurations are possible and are conceived of by the inventors.

Figure 5:
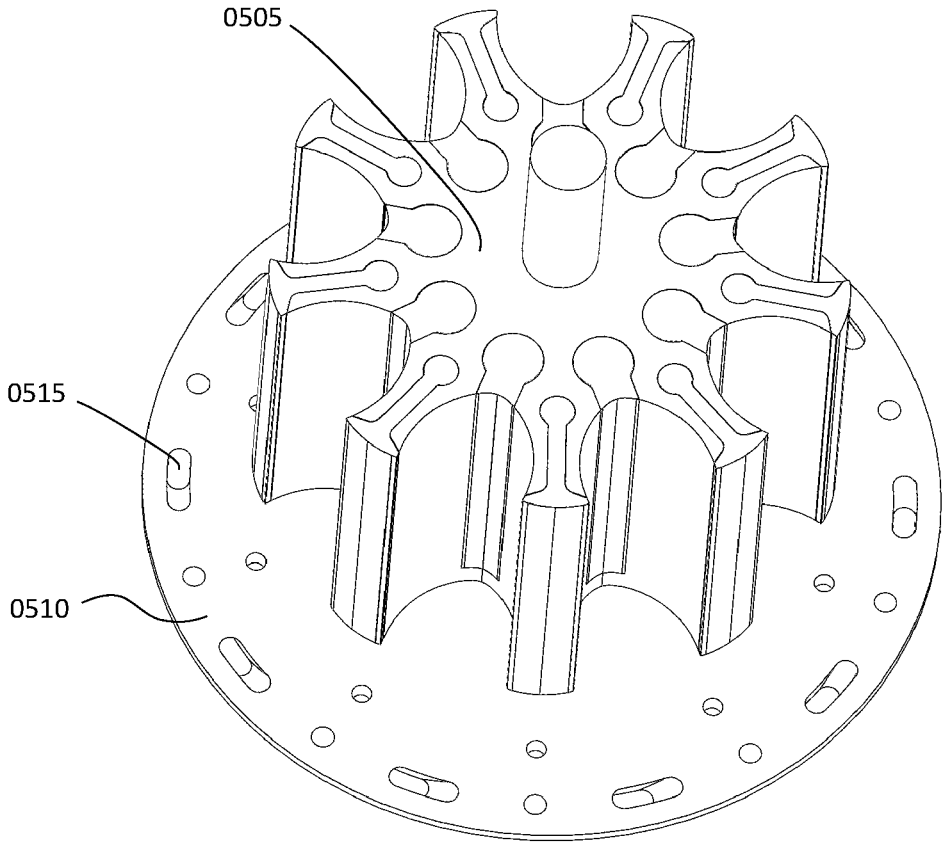
FIG. 5 is an isometric view of an assembly of components of a further exemplary fluid transfer device including an inner rotor with radially movable apex seals, and outer rotor endplate.

FIG. 5 shows an inner rotor 0505 and outer rotor endplate 0510 of the embodiment of FIG. 7. For reference the endplate 0510 is shown in FIG. 1. The inner rotor 0505 rests against an outer rotor endplate 0510. The outer rotor endplate 0510 has an array of rotating chamber ports 0515 that allow fluid flow into and out of the device. Radial ports allowing fluid flow to the inlet and outlet could also be used but are considered by the inventors to be more difficult to seal than the axial port exemplary embodiment shown. This is because radial ports require the external radial surface of the outer rotor to seal against the internal radial surface of a housing or other surface, and these surfaces must form coaxial cylinders that remain coaxial and maintain a tight gap as they undergo thermal expansion and/or the rotor expands and deforms due to centrifugal forces.

Figure 9:
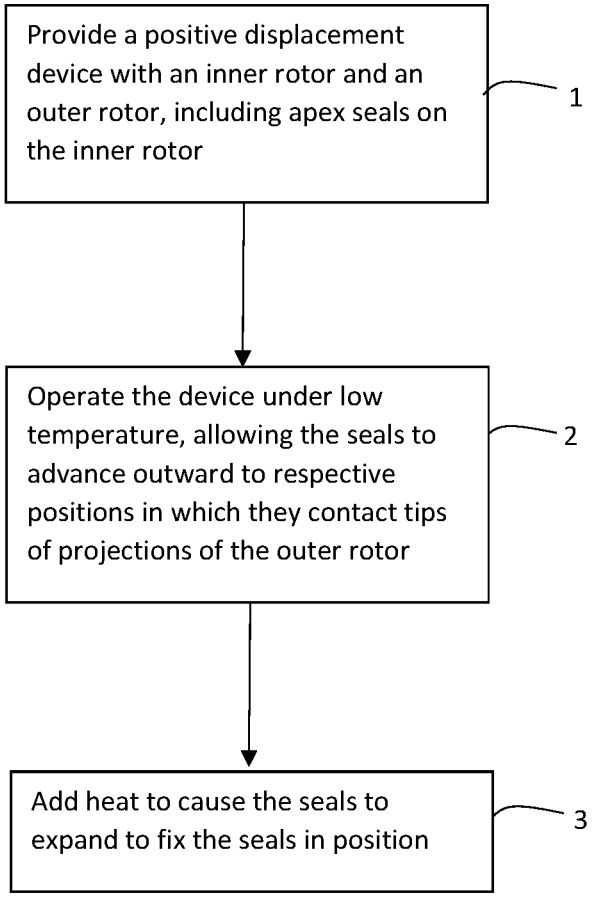
FIG. 9 is a flow chart illustrating a method of running in a fluid transfer device.
Figure 13:
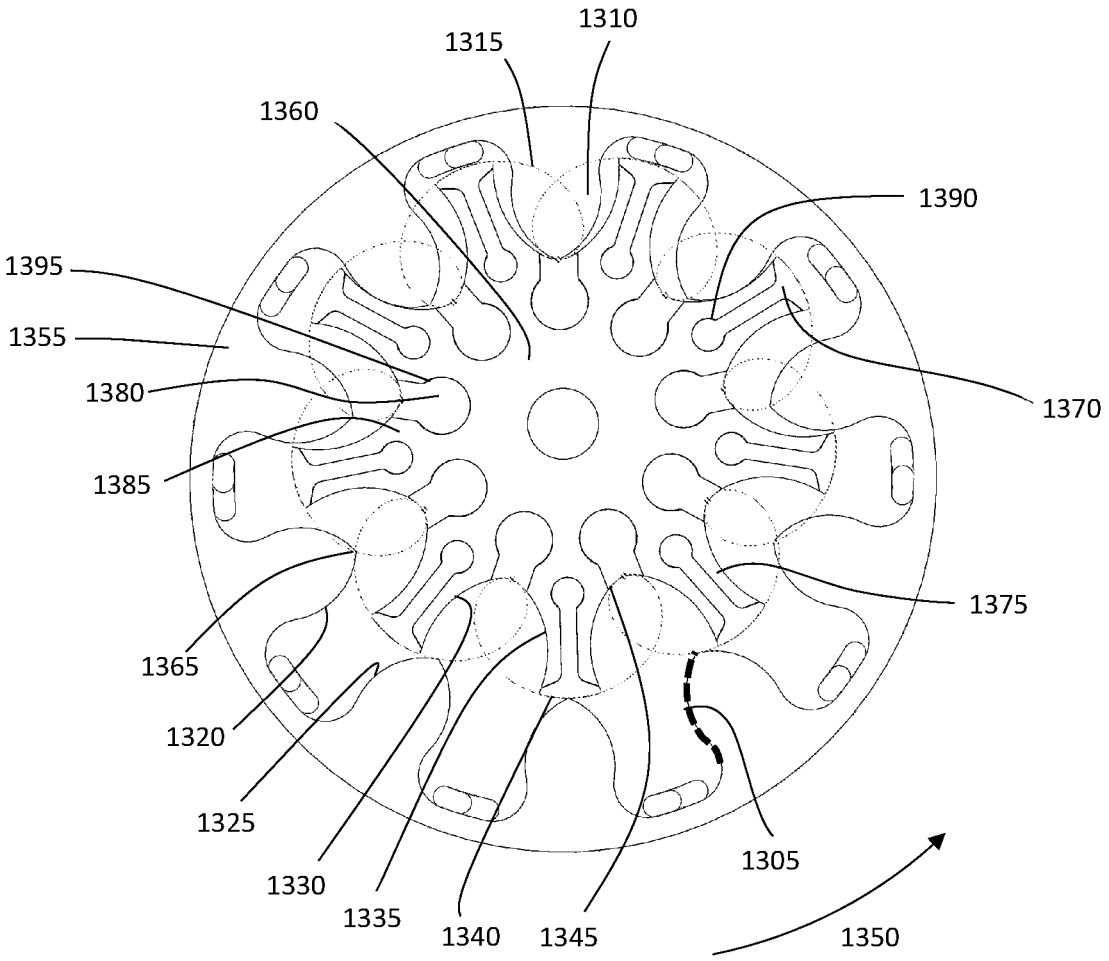
FIG. 13 is a top view of the inner rotor and outer rotor of the exemplary machine of FIG. 5, showing the hypotrochoid path as traced by the tips of the outer rotor projections.
Figure 14:
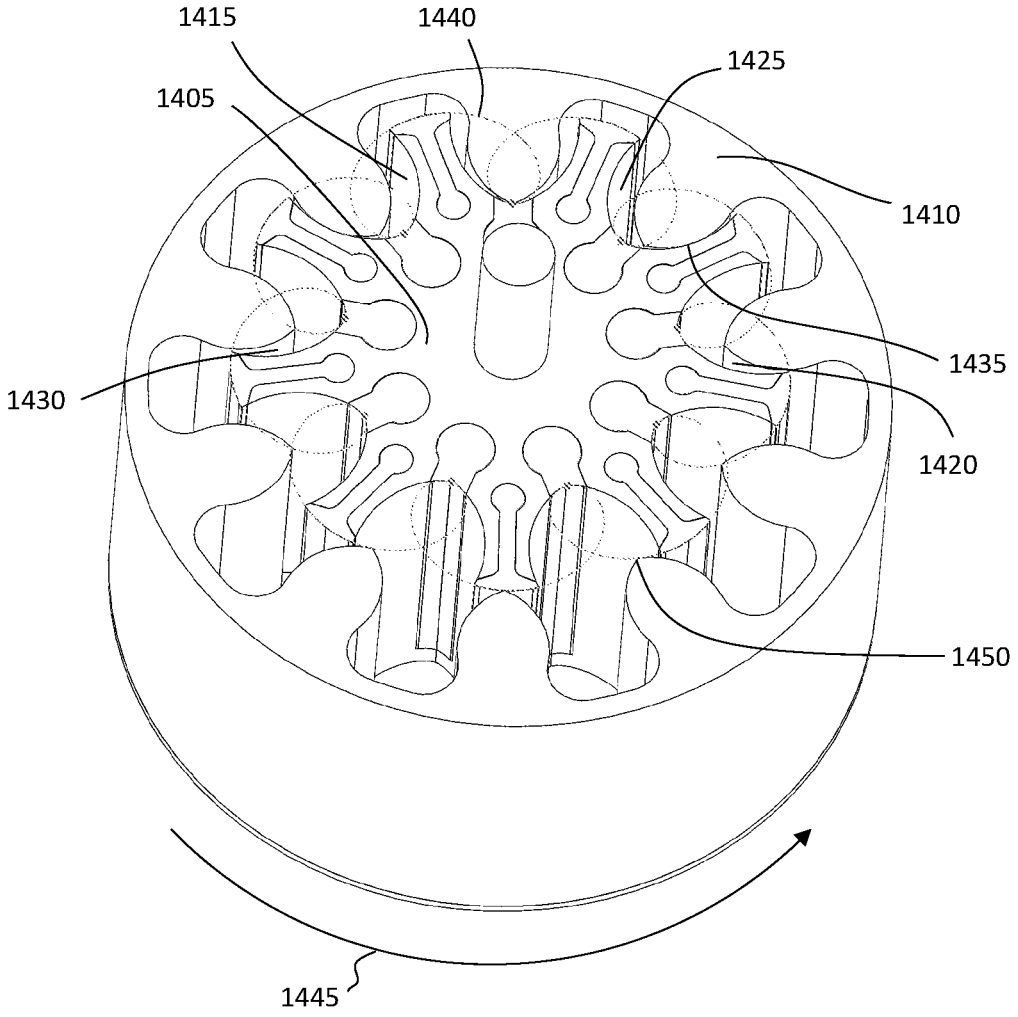
FIG. 14 is an isometric view of the inner rotor and outer rotor shown in FIG. 13.

In the embodiment shown in FIGS. 5, 13, and 14 it is an objective of this device to provide radially movable radially sliding apex seals in the sealing zones at TDC and BDC without an additional leakage route around the edges of these seals. A geometry and method is proposed as illustrated in FIG. 9. In step 1, an inner rotor/outer rotor positive displacement device is provided with radially sliding apex seals on the inner rotor. The term "apex seals" commonly refers to seals on the tips of projections, but here refers to seals that seal against the tips of projections of the other rotor regardless of whether the seals are on the tips of projections or in troughs between projections of the rotor on which the seals are mounted. In exemplary embodiments shown in FIGS. 5, 13, 14, the apex seals include seals at the tips of the inner rotor lobes, for sealing against tips of fins of an outer rotor at Bottom Dead Center (BDC) and seals at the troughs between the inner rotor lobes, for sealing against the tips of the fins of the outer rotor at Top Dead Center (TDC). This usage of separate radially movable seals at TDC and BDC allows each to set their own position. The radially movable seals may be radially movable at a first temperature and configured to become radially fixed or to provide a smaller gap clearance around the sides of the seal at a second temperature. In the exemplary method shown in FIG. 9, in step 2 the radially movable seals are allowed to advance radially outward at a temperature which is lower than the expected operating temperature, to respective positions in which they contact the tips of the projections of the outer rotor ("top-out position"), for example under the influence of centrifugal force as the device is operated at the low temperature, the seals may advance to a radially outward position. In step 3, operating temperature heat is added to the system causing seals to expand in all directions to take up gaps along sides of grooves. The seals are made of a material with a higher coefficient of thermal expansion as compared to the material of the inner rotor comprising the seal grooves. Run-in must be gradual enough to allow the seals to wear and not catch on mating surfaces. In an embodiment, seals may preloaded radially inward, such as with springs which are configured to return the seals to an inward position at rest, and centrifugal force is used to push seals outward toward their top-out position. This allows the run-in to be done by gradually increasing speed while cold, to where the seals cease outward motion at their top-out position, and then adding heat to expand them to close the seal-groove gaps. Seals may be of a flexible, elastomeric or rigid material. Closing of the gaps may allow the seals to then be fixed in position, or may allow the seals to be tighter in their grooves reducing leakage around the seals within the grooves, or both.

Figure 6:
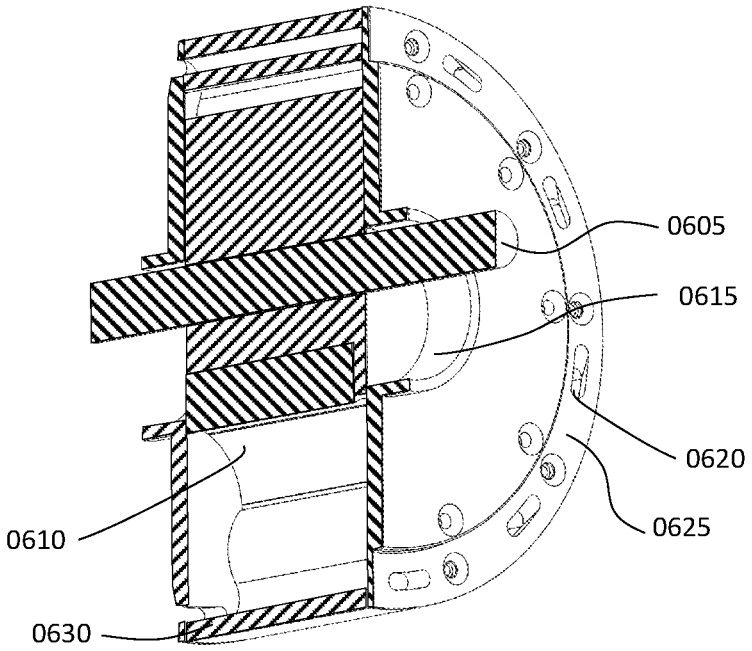
FIG. 6 is an isometric section view of the further exemplary fluid transfer device of FIG. 5 showing an input shaft, inner rotor, outer rotor, and endplate.

FIG. 6 is an isometric cutaway view of the device shown in FIG. 7 showing drive shaft 0605 for inner rotor 0610 eccentric to bearing seat 0615 of outer rotor. Note that the housing is not shown in either FIG. 5 or FIG. 6, but someone skilled in the art would understand that a component having ports with sliding seals, such as the port plate 0705 shown in FIG. 7, which has intake port 0710 and exhaust port 0715 when operating as a pump or compressor, would typically be placed in close proximity to the rotating ports 0620 located on axial end of the outer rotor endplate 0625. Moving again to FIG. 7, stationary ports comprising intake port 0710 and exhaust port 0715 located on seal plate 0720 allow fluid flow into the volumes formed between the projections of inner rotor 0610 and outer rotor 0630 as the aforementioned rotors rotate and allow fluid to exit the volumes formed between the projections of the aforementioned rotors, while also sealing the rotating ports 0620 located on endplate 0625 at top dead center, where the fluid volumes between the rotors is at or near its minimum, and at bottom dead center, where the volume between the fluid volumes is at or near its maximum. During operation fluid flows through an axial port 0620 in the outer rotor that rotates with respect to stationary ports, (e.g. comprising intake port 0710 and exhaust port 0715 located on a stationary port plate 0705) as shown in FIGS. 6 and 7.

FIG. 6 also shows parallel axes of the inner rotor shaft 0605 and outer rotor axis and bearing supports 0615. In the non-limiting exemplary embodiment, both rotors 0610 and 0630 are supported for rotation at both axial ends for high rigidity. The bearings are not shown for clarity, but their implementation, with the shaft 0605 of the inner rotor 0610 extending through the bearing seat 0615 for the outer rotor, may be understood from FIG. 6 by someone of ordinary skill in the art. This bearing arrangement may also be achieved in other ways which have been conceived by the inventor.

Figure 8:
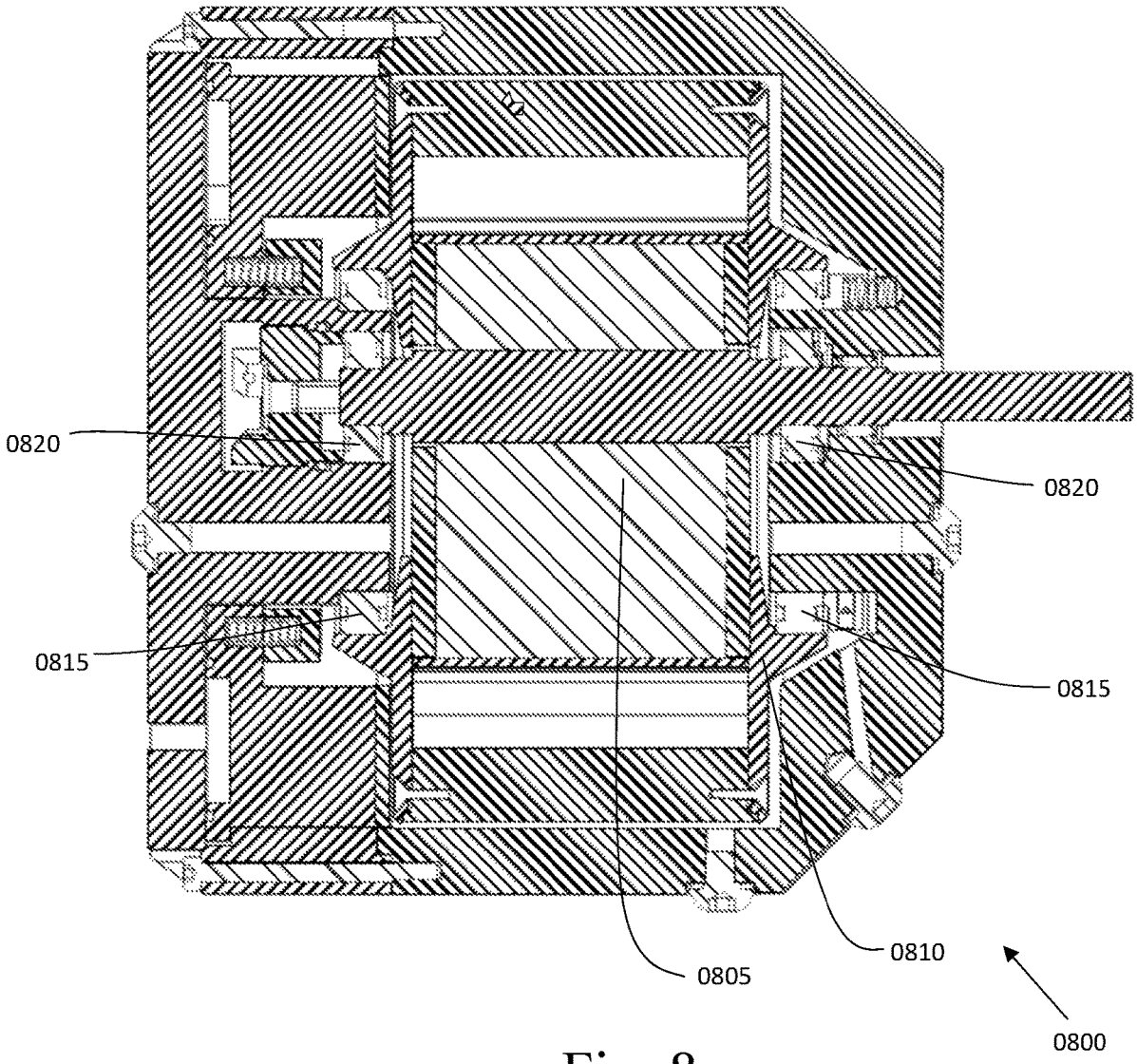
FIG. 8 is a section view of another exemplary fluid transfer device, showing the inner rotor, outer rotor, input shaft, port plate, and housing.

For example, in an embodiment shown in FIG. 8 machine 0800 comprises an inner rotor 0805 and outer rotor 0810 which form chambers between the inner rotor and the outer rotor. Whereas in the embodiment shown in FIG. 1 the inner rotor 0105 and outer rotor 0100 are cantilevered, each having two bearings on one axial end of each respective rotor, in the configuration shown in FIG. 8, the inner rotor 0805 and outer rotor 0810 are each supported by a bearing on both axial ends of the respective rotor, allowing for high rigidity and a compact form factor. In the non-limiting embodiment shown in FIG. 8, the bearing seats for the inner rotor bearings 0820 are within the inner diameter of the outer rotor bearings 0815. Alternatively, the bearings 0820 for the inner rotor could be offset axially, allowing for larger inner rotor bearings 0820, and/or smaller outer rotor bearings 0815.

Hypotrochoid Derivation

Aspects of the design of the disclosed invention may be determined by the following method:

Selecting a preferred ratio of the speeds of the two rotors of the device, which is the ratio of an inner rotor projection number, or where the inner rotor projections are lobes, the number of lobes, $N_{lobes}$, on an inner rotor to an outer rotor projection number, or where the outer rotor projections are fins, the number of fins, $N_{fins}$, on an outer rotor. That is:

$$\text{Ratio} = \frac{N_{lobes}}{N_{fins}}$$

This ratio will also determine the relative ratio of speeds at which each rotor rotates relative to the housing. In several examples, the outer rotor projection number is greater by one than the inner rotor projection number.

Selecting also a preferred offset of the axes of the 2 rotors of the device, which is the distance between the axes, which shall be referred to as Axis Offset.

Selecting also the preferred size of the device, as defined by the inner radius of the Outer Rotor, measured at the inner tips of the outer rotor's fins, which shall be referred to as Radius. In an embodiment wherein the tips of the Outer Rotor are rounded as opposed to points, Radius is measured from the axis of rotation of the Outer Rotor to the center points of the circles that define the rounded tips of the Outer Rotor.

Constructing the sealing geometry of the inner rotor, which may driven by the parametric equations:

$$X = -\text{Axis Offset}*\cos(t) + \text{Radius}*\cos((\text{Ratio}-1)*t)$$

$$Y = -\text{Axis Offset}*\sin(t) - \text{Radius}*\sin((\text{Ratio}-1)*t)$$

Figure 10:
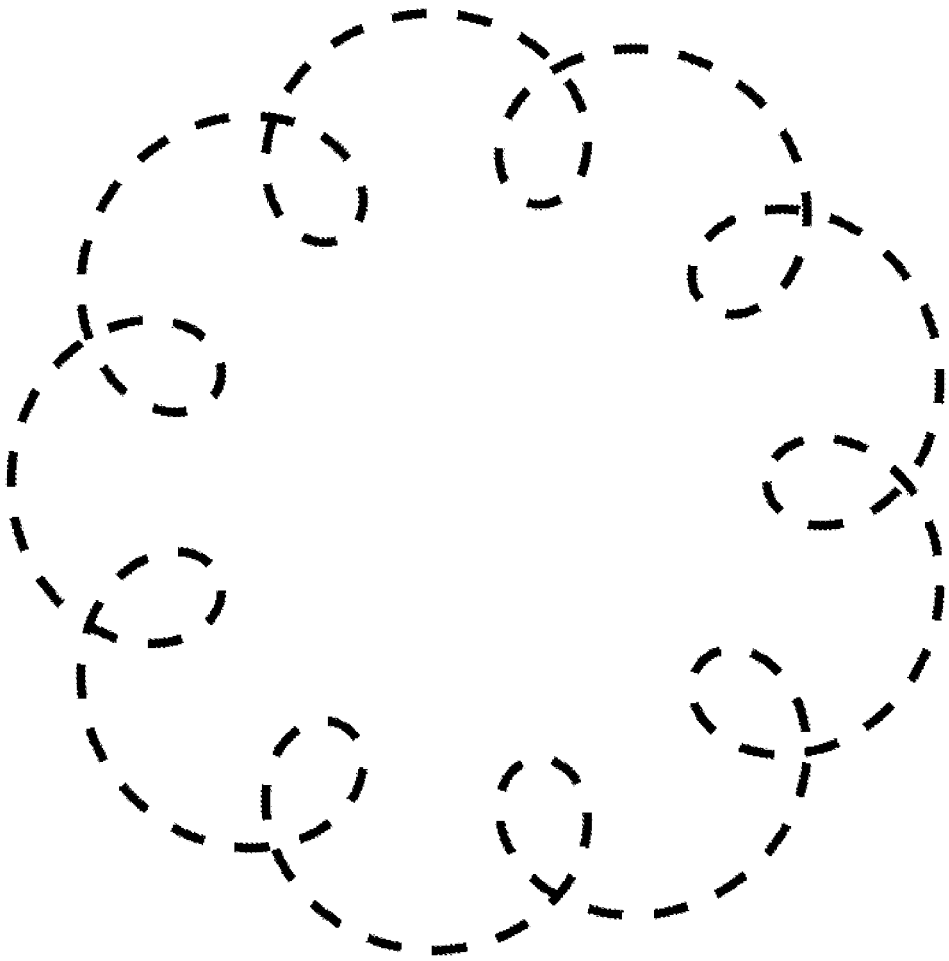
FIG. 10 is a schematic drawing of a hypotrochoid path traced by the ends of the outer rotor lobes relative to the inner rotor.

Noting that, when X and Y are plotted with t varying from 0 to $2\pi*N_{fins}$, the parametric equations yield a hypotrochoid, having a size which is determined by Radius and having a shape which is determined by the Axis Offset and Ratio. Such a hypotrochoid has $N_{lobes}$ lobes. For example, a hypotrochoid defined by these equations and having 9 lobes is shown in FIG. 10.

Figure 11:
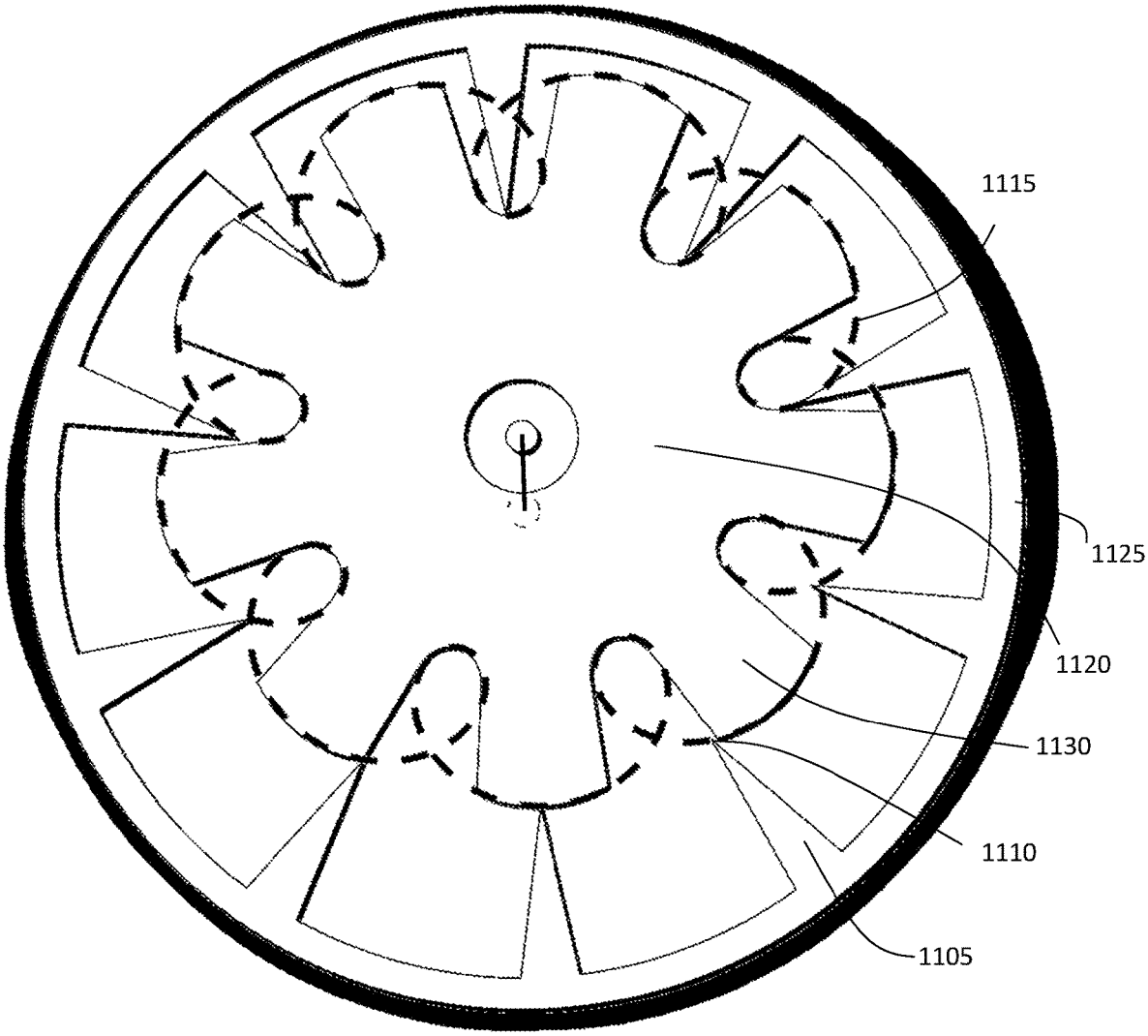
FIG. 11 is a top view showing the schematic drawing of the hypotrochoid path shown in FIG. 10 as traced by the tips of the outer rotor projections overlayed over the inner and outer rotor of an exemplary machine.

Portions of the exterior and interior of this hypotrochoid may correspond to surfaces of the inner rotor, these portions forming sealing zones against which the tips of the outer rotor fins will seal. In embodiments, the sealing zones include portions at tips of inner rotor lobes and at troughs between the inner rotor lobes. The sealing zones may comprise explicit movable seals, as shown above as for FIG. 5, or may be integral portions of the inner rotor. In either case, the sealing zones at the tips, troughs, or both, may be configured, with the inward-most tips of the outer rotor, to be shaped, for example machined, by the inward-most tips, for example via material selection of the sealing zones as compared with the inward-most tips, geometry of the inward-most tips, or both. Other manners in which a tip may shape a surface include pushing a shapeable material (plastic deformation), abrading an abradable material, or by pushing, and thus moving, a movable element, for example a movable seal. In an embodiment where the outer rotor tips are not infinitely sharp, but have radii of $R_{OuterRotorTip}$, all sealing surfaces of the Inner Rotor must be offset inward (that is, offset in a direction normal to the sealing surface of the inner rotor) by a distance equal to $R_{OuterRotorTip}$ from a hypotrochoid defined by the motion of the center points of the circles defining the rounded outer rotor tips relative to the inner rotor. A hypotrochoid plot is shown in FIG. 11 superimposed upon a non-limiting embodiment of the device disclosed herein, which possesses straight fins 1105 and infinitely sharp outer rotor fin tips 1110. It may be noted that the tips of the outer rotor fins 1105 trace a hypotrochoid path 1115 relative to the inner rotor 1120 when the outer rotor 1125 is rotated about its axis relative to a housing, as the inner rotor 1120 also rotates at a different speed proportional to the relative number of projections, resulting in the hypotrochoid path 1115 relative to the inner rotor 1120. It may be further noted that the geometry of the inner rotor 1120 is defined by the path of the hypotrochoid 1115, with certain exceptions, such as on the leading and trailing edges of the inner rotor lobes 1130 to allow the fin tips 1110 to trace a hypotrochoid path 1115 without interference of the rest of the fin with the inner rotor lobes 1130.

Figure 12:
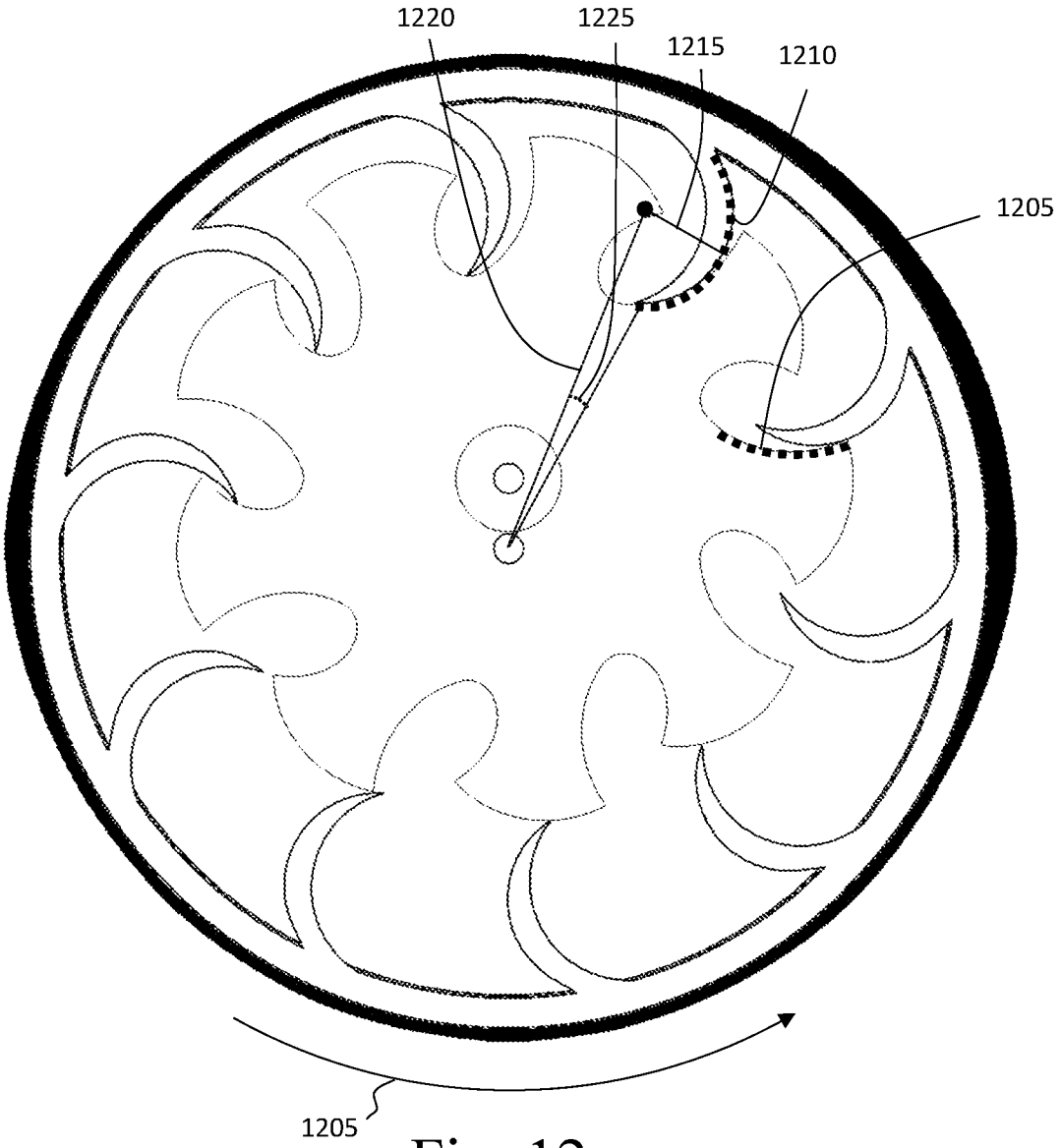
FIG. 12 is a top view of an exemplary machine showing a driving surface of an inner rotor and a corresponding driven surface of an outer rotor.

The geometry illustrated in FIG. 11 is further developed in FIG. 12. In this non-limiting embodiment, an inner rotor is considered to be supplied with an external source of torque, for example from a shaft driven by an electric motor. Because it is considered by the inventor to be disadvantageous (due to the very small surface are of the outer rotor fin tips in contact with the inner rotor) for an inner rotor to drive an outer rotor solely at the tips of an outer rotor, there is designed an additional driving surface 1205 on the inner rotor lobes, which drives the outer rotor via an additional driven surface 1210 on the outer rotor fins. In the embodiment shown in FIG. 12, this driven surface is an arc which nearly intersects an outer rotor fin tip. In some embodiments, it may exactly intersect the outer rotor fin tip; however, in this embodiment the arc has been moved radially outwards to create a transition zone on the outer rotor fin tip to aid the transition between an outer rotor fin driven surface being driven by the inner rotor lobe and the outer rotor fin tip shaping the sealing zone between inner rotor lobes. The angle of the arc at the fin tip should be selected for an appropriate rake angle for shaping the inner rotor sealing zones. This concept is explained in more detail below.

The inventor notes that this outer rotor surface need not be an arc; however, an arc is considered to provide a suitable combination of rolling and sliding contact between an inner rotor and outer rotor. Regardless of the selected shape of the outer rotor fin trailing/driven surface 1210, this surface may define the driving surface 1205 of the inner rotor lobes. In the case of an arc, the driving surface of the inner rotor lobes may be defined with the following method.

Selecting the location of the center of a circle that contains the arc that defines the driven surface of the outer rotor fin and the circle's radius (Fin Backing Radius, 1215).

Determining the distance from this circle's center point to the axis of the outer rotor (Fin Backing Circle Radial Distance, 1220).

Determining the angle formed between a radial line through the outer rotor axis and the center point of this circle and a radial line through the outer rotor axis and the fin tip (Fin Backing Circle Offset Angle, 1225).

Using the following hypotrochoid equations to define a curve on the inner rotor:

$$X = -\text{Axis Offset}*\cos(t) + \text{Fin Backing Circle Radial Distance}*\cos((\text{Ratio}-1)*t)$$

$$Y = -\text{Axis Offset}*\sin(t) - \text{Fin Backing Circle Radial Distance}*\sin((\text{Ratio}-1)*t)$$

Note, these are the same equations as were used to define the sealing surfaces, except with a different point radius based on the Fin Backing Circle Radial Distance.

Rotating the hypotrochoid defined in the equations above by the Fin Backing Circle Offset Angle, 1225 divided by Ratio (about the axis of the inner rotor and in the direction of rotation of the Fin Backing Circle Offset Angle, 1225).

Offsetting the hypotrochoid by the Fin Backing Circle Radial Distance, 1220. This will yield the conjugate surface of the inner rotor driving surface 1205 that an arc on the outer rotor defines. Note, this method can also be used to define sealing surfaces of the inner rotor at TDC and BDC when rounded fin tips are used on the outer rotor.

If the OR fin driven surface is not an arc, then the following method can be used to define the conjugate surface on the inner rotor:

Selecting an adequate number of points on the outer rotor fin driven surface.

For each of these points, determining the distance to the axis of the outer rotor (Point Radial Distance).

Determining the angle formed between a radial line through the outer rotor axis and said point and a radial line through the outer rotor axis and the fin tip (Point Offset Angle).

Using the following hypotrochoid equations to define a curve:

$$X = -\text{Axis Offset}*\cos(t) + \text{Point Radial Distance}*\cos((\text{Ratio}-1)*t)$$

$$Y = -\text{Axis Offset}*\sin(t) - \text{Point Radial Distance}*\sin((\text{Ratio}-1)*t)$$

Rotating the hypotrochoid defined in the equations above by the Point Offset Angle divided by Ratio (about the axis of the inner rotor and in the direction of rotation of the Point Offset Angle).

Selecting the extreme points (i.e. the points that are deepest into the inner rotor lobe) of all the points in the collection of hypotrochoids formed by each of the points selected in 1 and use them to define a curve representing the driving surface of the inner rotor lobe. A spline or similar interpolation between the set of extreme points may be preferred.

FIG. 13 shows an embodiment that uses arcs 1305 for the driven surfaces of the outer rotor fins 1310 and shows the resultant offset hypotrochoids 1330 formed on the inner rotor driving surface. The surfaces opposite those defined by arcs 1305 on the same outer rotor fins, used for reverse operation such as for a pump application, may be defined as arcs, as shown in this non-limiting exemplary embodiment so as not to interfere with the inner rotor. Their design will be discussed further below.

FIG. 14 shows an isometric section view of inner rotor 1405 and outer rotor 1410 showing the hypotrochoid path 1440 of the outer rotor projection tips 1450 relative to the inner rotor 1405. Arrow 1445 depicts the direction of rotation of outer rotor 1410 and inner rotor 1405 for the above description.

Contact Ratio

Another feature of the described geometry is the ability to design for a contact ratio of the inner rotor 1405 against the outer rotor 1410, as seen in FIG. 14, which is greater than or equal to 1, and rotationally positions both rotors relative to each other at all times and provides the torque necessary to spin the outer rotor 1410. Contact ratio, in this document, is defined as the average number of points of contact between the driving, leading surfaces 1415 of the inner rotor 1405 and the driven, trailing surfaces 1420 of outer rotor 1410 as they rotate. In devices of the disclosed embodiment, a ratio greater than or equal to one ensures that there is always at least one point of contact between the inner and outer rotor. It is noted that this assumes that once a driving surface stops contacting a driven surface, it does not regain contact with the driven surface until the next rotation. Similarly, contact ratio can be used to refer to the non-driving timing contact of the trailing surfaces 1425 of the inner rotor and the leading surfaces 1430 of the outer rotor which prevent the driven rotor from turning faster than it is being driven; for example, during deceleration of the inner rotor 1405. In this document, leading is used to describe a feature facing largely towards a direction of rotation and trailing is used to describe a feature facing largely away from a direction of rotation. A contact ratio which is greater than or equal to 1, for both driving and timing surfaces, in combination with other features of the device, such as the hydraulically rotationally balanced driven rotor described herein, is considered by the inventor to provide operation of the device without the need for external timing gears. The primary driving contact 1435 is between two surfaces with similar curvature which is considered, by the inventor, to be ideal for low wear due to reduced contact pressure. In embodiments, these surfaces include a convex surface on an outer rotor driven surface and a concave surface on an inner rotor driving surface. This combination of concave and convex surfaces along with similar curvature is also ideally suited for creating a fluid film between these surfaces to reduce rotor-to-rotor contact in operation. A further reduction of wear is believed, by the inventors, to result from the constant progression of the contact between the driving and driven surfaces along both of these surfaces. This results in only a momentary contact at each point along a surface of a rotor once per revolution of said rotor. This provides for only a small amount of heating and wear at each point and the rest of the rotation of that rotor to allow cooling of that point. Alternatively, the outer rotor may be the driving rotor, but this will result in higher contact pressures because the inner rotor is not hydraulically rotationally balanced For clarity, embodiments of the device, such as that shown in FIG. 13 have sliding surfaces 1320, 1325, 1330, and 1335 and sealing surfaces 1340 and 1345. In the non-limiting embodiment shown in FIG. 13, the sealing surfaces may comprise radially movable seals 1370 and 1380. Thus, the outer rotor 1355 has first sliding surface 1320, which is on the leading side of the direction of rotation indicated by arrow 1350, and second sliding surface 1325, which is on the trailing side of the direction of rotation. Inner rotor 1360 has a first sliding surface 1330, which is on the leading side of the direction of rotation and second sliding surface 1335 which is on the trailing side of the direction of rotation. Inner rotor 1360 also has sealing surface 1340 at the outward-most point of its lobes and sealing surface 1345. The interaction of sliding surfaces provides angular timing between the inner and outer rotors so as to achieve conjugate motion and are not intended to provide sealing. The sealing zones, for example defined by the radially movable seals or by areas of contact or near-contact where sealing occurs, are not intended to provide rotational timing and do provide a near-zero clearance seal which has the advantage of low leakage and low drag torque. The contact between the inner rotor leading surfaces and outer rotor trailing surfaces preferably starts after the seal zone at BDC and ends before the seal zone at TDC. The timing contact between the inner rotor trailing surfaces and outer rotor leading surfaces preferably starts after the seal zone at TDC and ends before the seal zone at BDC.

Portions of the outward facing projections of the inner rotor contact the leading or trailing surfaces of the outer rotor described above to provide rotational positioning of the outer rotor relative to the inner rotor. These surfaces of the inner rotor may also comprise a shapable material where the sealing zones comprise a shapable material. In an example, an entire radially exterior envelope of the inner rotor comprises a shapable material as shown in FIG. 17 whereby the contact pressure of the outer rotor tips 1735 is high enough on the sealing zones at TDC and BDC to shape the shapable material at TDC and BDC but low enough to slide with minimal wear on the driving surfaces 1770 of the inner rotor.

The sliding surfaces are preferably designed with a contact ratio of 1 or more in the direction of rotation indicated by arrow 1350. During forward rotation of the inner rotor resulting in displacement of the fluid out of the discharge port, rotational resistance on the outer rotor is expected from viscous friction with the fluid. This will resist forward rotation of the outer rotor 1355 and create a contact force between the driving surfaces 1325 and driven surfaces 1330. During deceleration, the rotational momentum of the outer rotor 1355 may cause the outer rotor 1355 to advance, relative to the inner rotor 1360 so the sliding surfaces 1320 and 1335 may come into contact.

The sliding contact surfaces are preferably characterized by having similar curvature on the corresponding surfaces of the inner rotor and outer rotor to provide low contact force. For example, sliding surface 1325, and sliding contact surface 1335 have similar forms. The sliding contact surfaces are further preferably characterized by having a simultaneously sliding and rolling interaction as seen by either rotor during operation, which provides two benefits. The first benefit is a reduced sliding speed for a given rotational speed of the rotors. The second benefit is that, for a pair of rotors, at least one of which has an arced sliding surface, an amount of rolling contact ensures that no point on any sliding surface is in contact at the same place for more than an instant. In other words, the contact point between the inner and outer rotor sliding surfaces is always moving so there is only a moment, once per rotor rotation, of local heating from sliding at any given point on a sliding contact surface, while the rest of the rotation of the rotors serves to allow for cooling of the surfaces. Wear of these type of surfaces is affected greatly by the amount of heat that is generated and thus the sliding surfaces of this device are well suited to provide low wear, even with thin fluid films or no lubrication.

Figure 17:
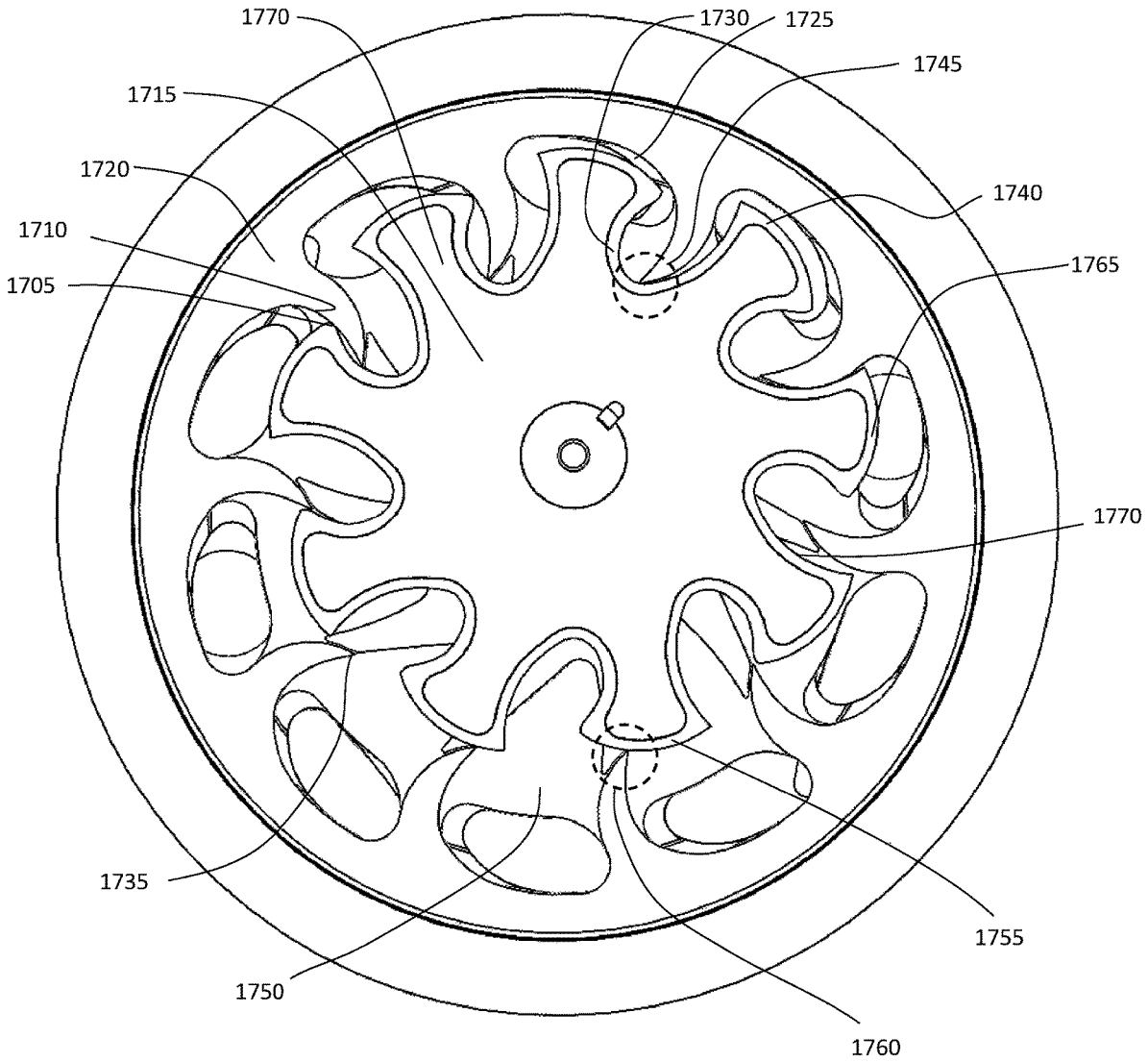
FIG. 17 is a top view of an exemplary machine which has an inner rotor having nine outward-facing projections and an outer rotor having ten inward-facing projections.

The contact surfaces which contact during a deceleration event as described above are also preferably characterized by a 1 or greater contact ratio but may have a shorter contact surface and a greater difference in the arc radii as shown by surfaces 1705 and 1710 in FIG. 17, where 1705 denotes a rounded surface on inner rotor 1715 and 1710 denotes a curved surface on outer rotor 1720. This is less beneficial to wear, however the deceleration contact surfaces are primarily responsible for preventing an outer rotor from advancing relative to an inner rotor as may occur during a deceleration event as described above. This deceleration can be limited through speed control of a driving motor so the deceleration contact surfaces are only ever lightly engaged, or not engaged at all during normal service. In many applications, it is more important that the device accelerates quickly than it is that it decelerates quickly so this is considered to be a useful operating parameter.

It should be noted that a certain amount of backlash can be tolerated in this device and a small amount of backlash may be preferable for low friction operation.

Radial Shaping (Round OR Fins)

Returning to FIG. 13, one of the significant features of this device is that the sharp tip 1365 (which may be a sharp edge for cutting into the inner rotor, a small radius, preferably with an abrasive texture to wear into the inner rotor, or a range of other geometry with various effects) only seals at or near top dead center (TDC) and at or near bottom dead center (BDC) but does not need to contact and/or seal in-between these extremes. The sealing at TDC and BDC separates the displacement device into higher and lower pressure portions.

The outer rotor projections may be configured to receive substantially equal and opposite torques from their surface areas exposed to the higher and lower pressure portions at TDC and BDC. By using a sharp or small radius tip 1365 on the outer rotor lobes 1310 as the seal at TDC and BDC, the surface area of the outer rotor 1355 that is exposed to the high-pressure fluid is equal or nearly equal at TDC and BDC. This creates the situation where the outer rotor 1355 does not have any or any significant torque acting on it, as a result of fluid pressure. This effect is referred to in this disclosure as rotationally hydraulically balanced and the motion of the outer rotor 1355 without significant net torque from fluid pressure is referred to in this disclosure as freewheeling. This freewheeling reduces the torque that must be transferred from the inner (driving) rotor 1360 to the outer (driven) rotor 1355, for example by the intermeshing of the respective lobes of the two rotors. This results in very low surface contact force between the inner and outer rotors 1360 and 1355 for low wear, low friction, and high efficiency.

The sharp tip 1365 may be designed so as to cut or wear its path through the seal surfaces 1340 and 1345 of the inner rotor 1360, removing material from the seal areas on inner rotor 1360 during certain operating conditions. This may allow the device to be initially constructed with low tolerances but to achieve very high precision seal geometry in operation as the outer rotor tips 1365 carve their own paths through the inner rotor 1355 seal surfaces 1340 and 1345. Design and operation of the disclosed invention in such a manner is expected to result in a close fit between the sharp edges 1365 with the inner rotor 1360 during operation. This close fit and narrow gap act to reduce the leakage rate of the fluid media through the gap, while simultaneously providing low friction.

Radially sliding seals, such as lobe tip seal 1370 located on inner rotor lobe 1375 and concave seal 1380 located in inner rotor lobe roots 1385, are also shown in the non-limiting exemplary embodiment depicted in FIG. 13. They may be sprung inward or outward with a spring and/or their position may be determined by centrifugal force (centrifugal force being used in the colloquial sense), such that during operation the seals have a tendency to contact the outer rotor, forming an effective seal. As shown by the geometry of the seals 1370 and 1380 in FIG. 13, the seals may have a mechanical stop feature which prevents their outward movement beyond a desired point. In the embodiment shown in FIG. 13, such mechanical stop features are provided by the fitting rounded bases of the seals 1385 and 1390. If the seals are sprung inward, the shaping of the seal surfaces may be done gradually at increasing speed during the run-in phase as centrifugal force pushes the seals radially outward, opposing the spring force, until the seals have been completely shaped by the outer rotor fin tips 1365 to the desired shape.

This construction has the advantage of allowing a movable seal, possibly made of a lower strength material than that of an inner rotor body, to be inserted into an inner rotor body. It allows for high pressure operation with excellent sealing immediately after assembly and continued sealing effectiveness after long term operation even if the seals wear due to sliding contact. Another significant advantage of this construction is that the outer rotor tips contact different inner rotor seals at TDC and at BDC. This prevents a gap being formed at either the TDC zone or the BDC zone if the inner and outer rotor axes are not precisely located in production and assembly. The seals are all constructed with a "top-out" function where, for example, fluid pressure, a pre-load spring, centrifugal force in many higher speed applications, or other mechanisms move the seals outward until they hit a hard-stop. This contains the seals from centrifugal ejection and prevents wear from occurring during operation past the point when the shaping effect of the outer rotor fin tip no longer contacts with enough force to cause further wear.

The non-limiting embodiment shown in FIGS. 13 and 14 has a lobe-to-fin ratio of 9/10 (as defined above) and has the benefit of enabling a driving rotor-driven rotor contact ratio which is greater than one. Other lobe-to-fin ratios are also possible, preferably with a difference of 1 between the numbers of inner rotor lobes and outer rotor fins. It may also be possible to have larger differences than 1. This would affect the shape of the hypotrochoid as was previously taught.

Figure 15:
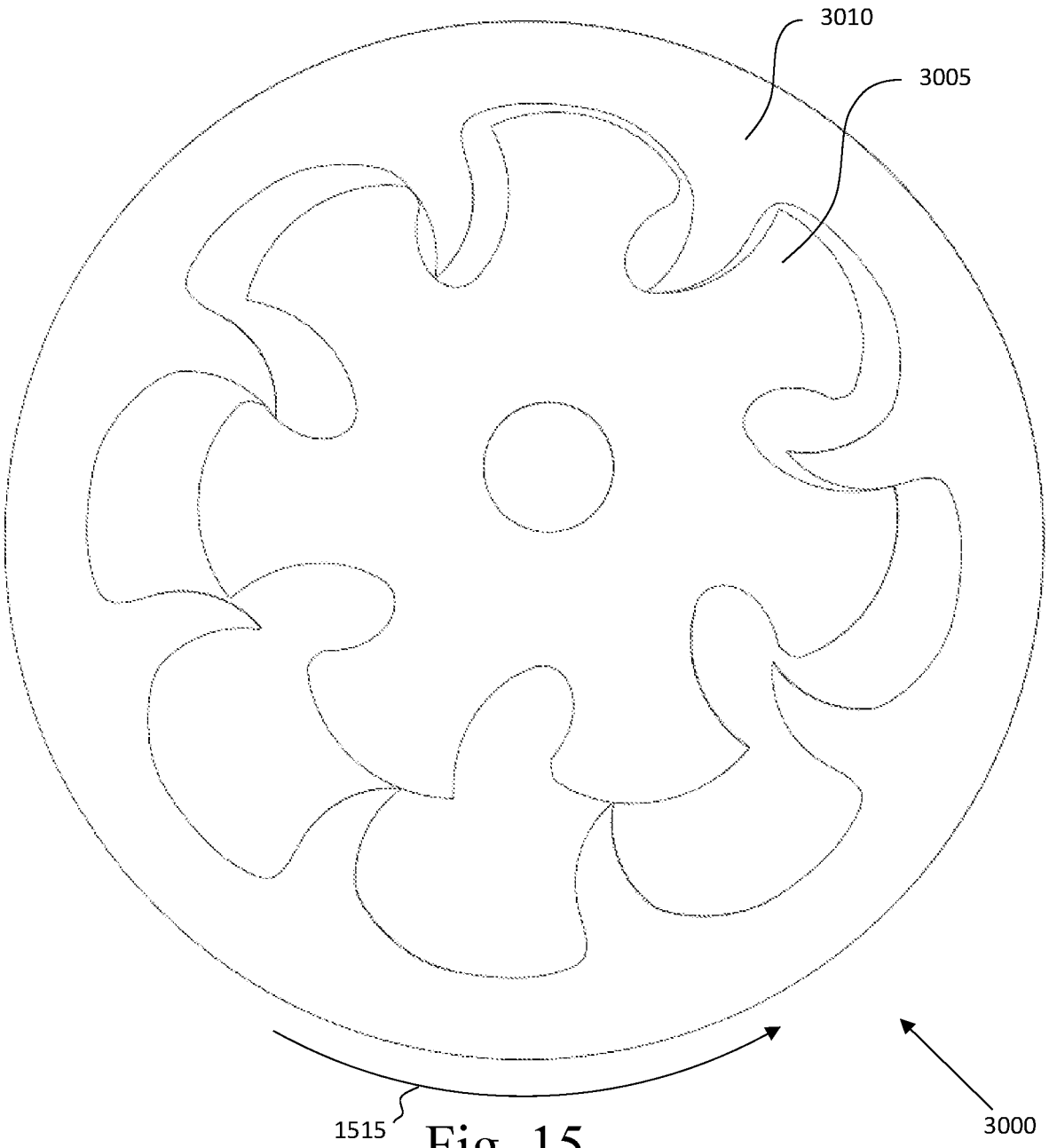
FIG. 15 is a top view of an inner rotor and an outer rotor of an exemplary machine, the inner rotor having seven outward-facing projections and the outer rotor having eight inward-facing projections.

FIG. 15 shows a simplified semi-schematic embodiment in which the inner rotor has seven outward-facing lobes and the outer rotor has eight inward-facing fins. The direction of rotation of the inner rotor 3005 and outer rotor 3010 is shown by arrow 1510. This non-limiting exemplary embodiment has a lobe-to-fin driving-driven contact ratio of one or more, and one or more points of sealing contact between the inner and outer rotor at TDC at all times and one or more points of sealing contact between the inner and outer rotor at BDC at all times.

Figure 16:
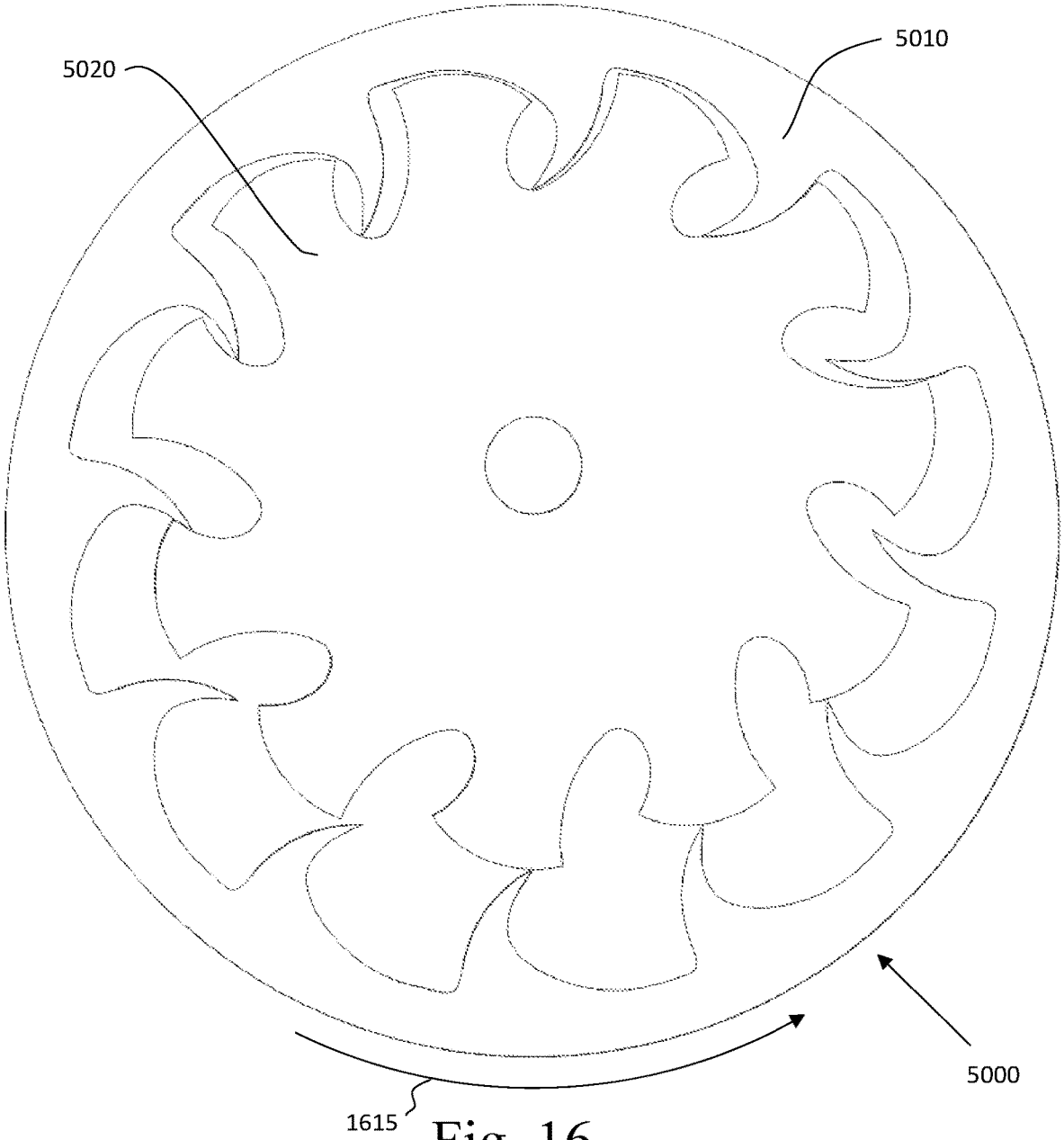
FIG. 16 is a top view of an inner rotor and an outer rotor of an exemplary machine, the inner rotor having eleven outward-facing projections and the outer rotor having twelve inward-facing projections.

FIG. 16 shows an embodiment in which the inner rotor 5020 has eleven outward-facing lobes and the outer rotor 5010 has twelve inward-facing fins. This non limiting exemplary embodiment has a lobe-to-fin driving-driven contact ratio of one or more, and one or more points of sealing contact between the inner and outer rotor at TDC at all times and one or more points of sealing contact between the inner and outer rotor at BDC at all times. The direction of rotation of the inner rotor 5020 and outer rotor 5010 is shown by arrow 1615.

Radial Shaping (Pointed Outer Rotor Fins)

Referring to FIG. 17, as the inner rotor 1715 and outer rotor 1720 rotate in unison, two areas of sealing contact occur. At TDC, which occurs at or near the point when a chamber reaches its minimum volume, such as approximately shown by chamber 1725 in FIG. 17, the innermost portions 1730 of the radial surface of the inner rotor 1715 come into contact with outer rotor fin tips 1735 causing shaping through machining, abrading, and/or wear to occur between the fin tips 1735 of the outer rotor 1720 and the machinable or shapable or abradable portion 1740 of the inner rotor 1715. An instance of this shaping contact at TDC is shown within the dotted circle 1745.

Similarly, at BDC, when a chamber reaches or is close to its maximum volume as approximately shown by chamber 1750 in FIG. 17, the top of the outermost portions 1755 of the radial surface of the inner rotor 1715 lobes come into contact with the fin tips 1735, of the outer rotor 1720, causing machining and or abrading of the outer surface of the inner rotor to occur. An instance of this shaping contact at BDC is shown within the dotted circle 1760.

Figure 18:
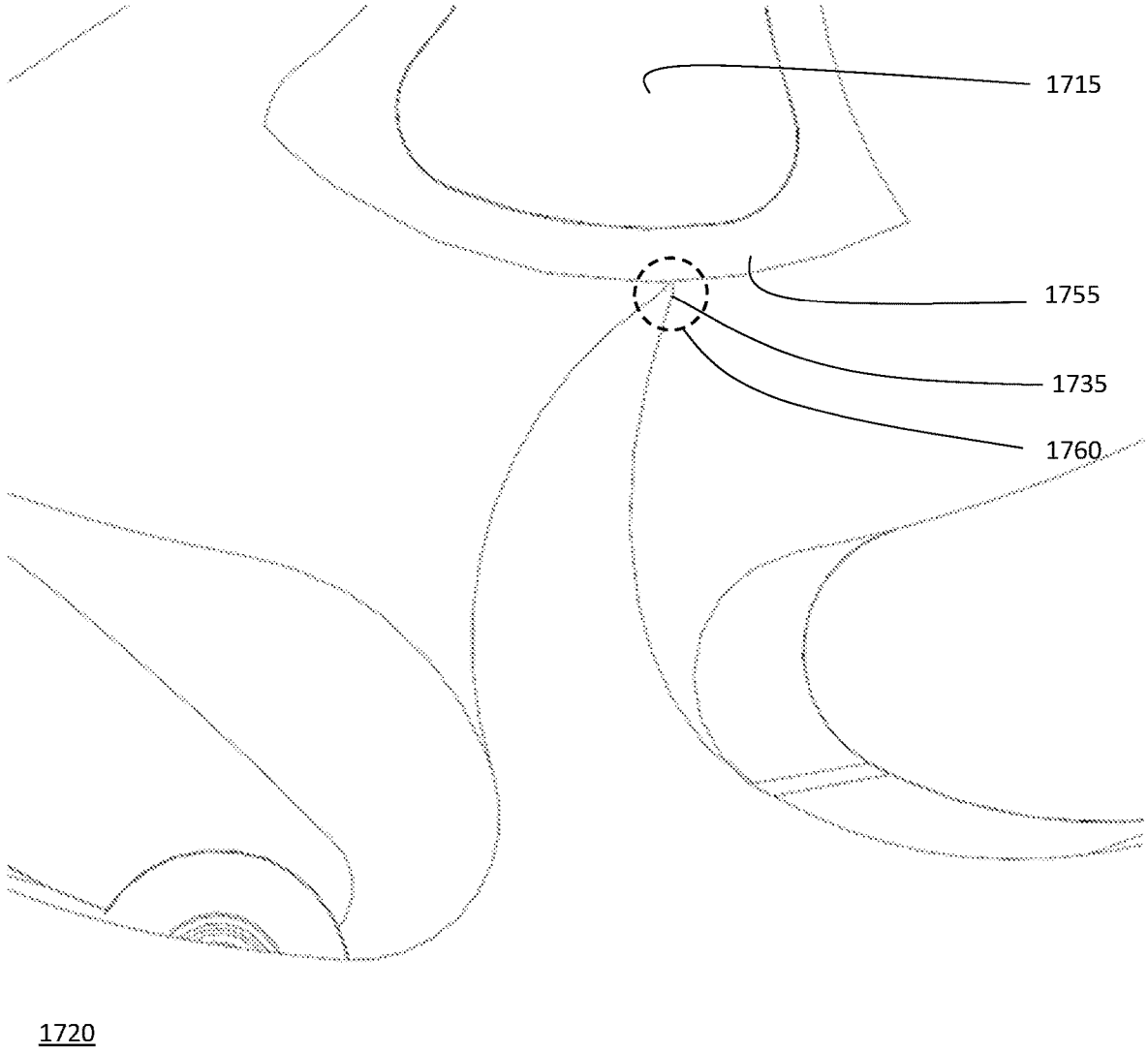
FIG. 18 is a close-up top view of inner and outer projections of the machine of FIG. 17 meeting near Bottom Dead Center (BDC) showing a detailed view of the sealing/shaping interaction between the inner and outer rotor.

FIG. 18 provides a closer view of the interaction of the fin tips and inner rotor at a point near BDC. For clarity, the same reference numerals used in FIG. 17 are provided in FIG. 18 where applicable.

Figure 19:
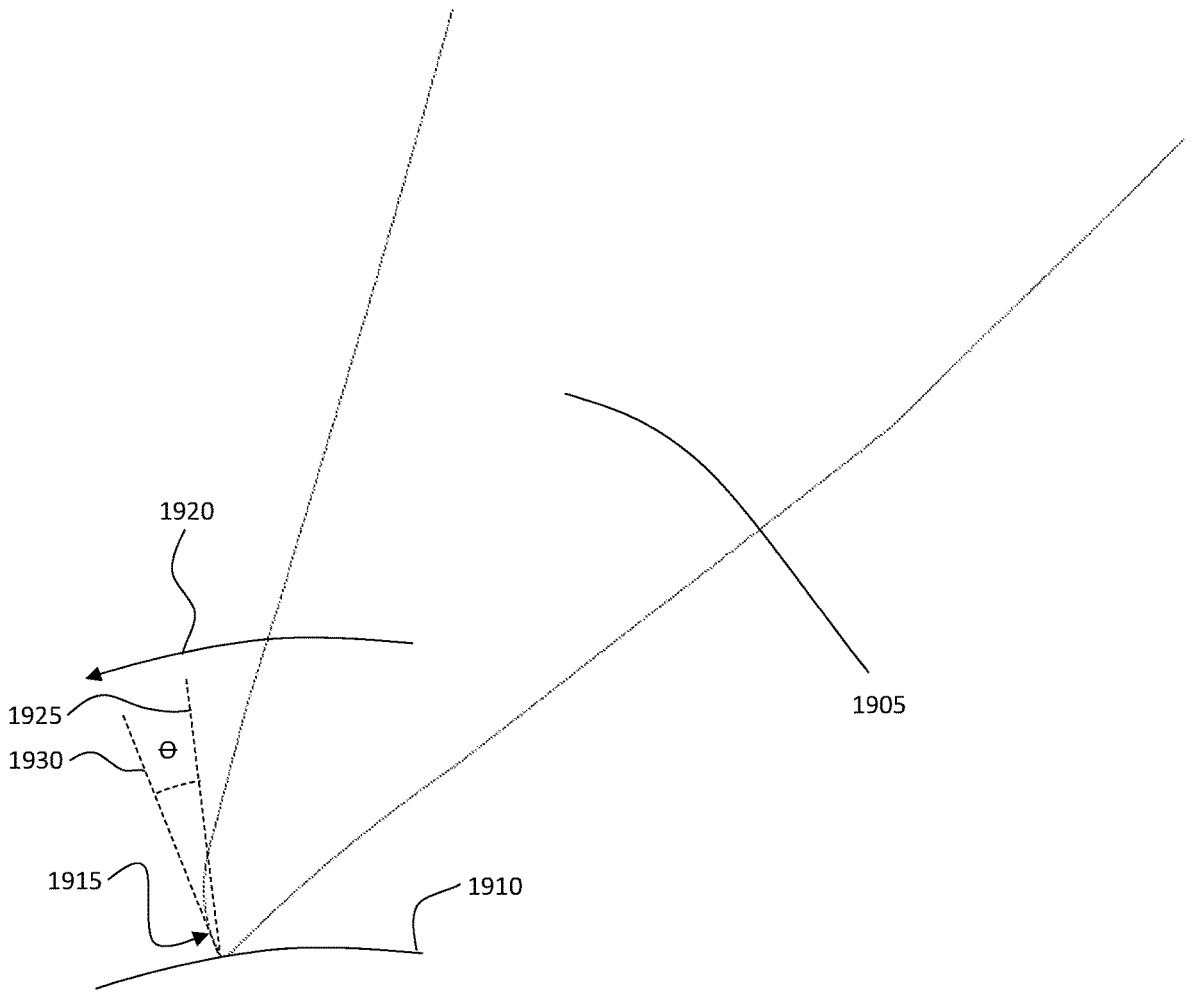
FIG. 19 is a close up top view of a shaping edge of an outer rotor projection.

To aid the below description, the rake angle referenced below refers to the angle between a shaping edge of an outer rotor fin tip and a reference plane perpendicular to the plane tangent to the shaped surface of the inner rotor at the point where the shaping edge intersects the shaped surface in the direction of relative motion of the two components. The rake angle is measured from a reference plane which is perpendicular to the tangent plane. In FIG. 19, a nonlimiting embodiment with a rake angle of approximately −12 degrees is shown. The dotted line 1925 is the reference plane and dotted line 1930 is a plane representing the leading face of the shaping edge. A rake angle in which the leading face of the shaping edge 1930 is farther forward in the direction of rotation 1920 than the reference plane 1925, as shown in FIG. 19, is called a negative rake angle and a rake angle in which the reference plane 1925 is farther forward in the direction of rotation 1920 than the leading face of the shaping edge 1930, is called a positive rake angle.

Figure 20:
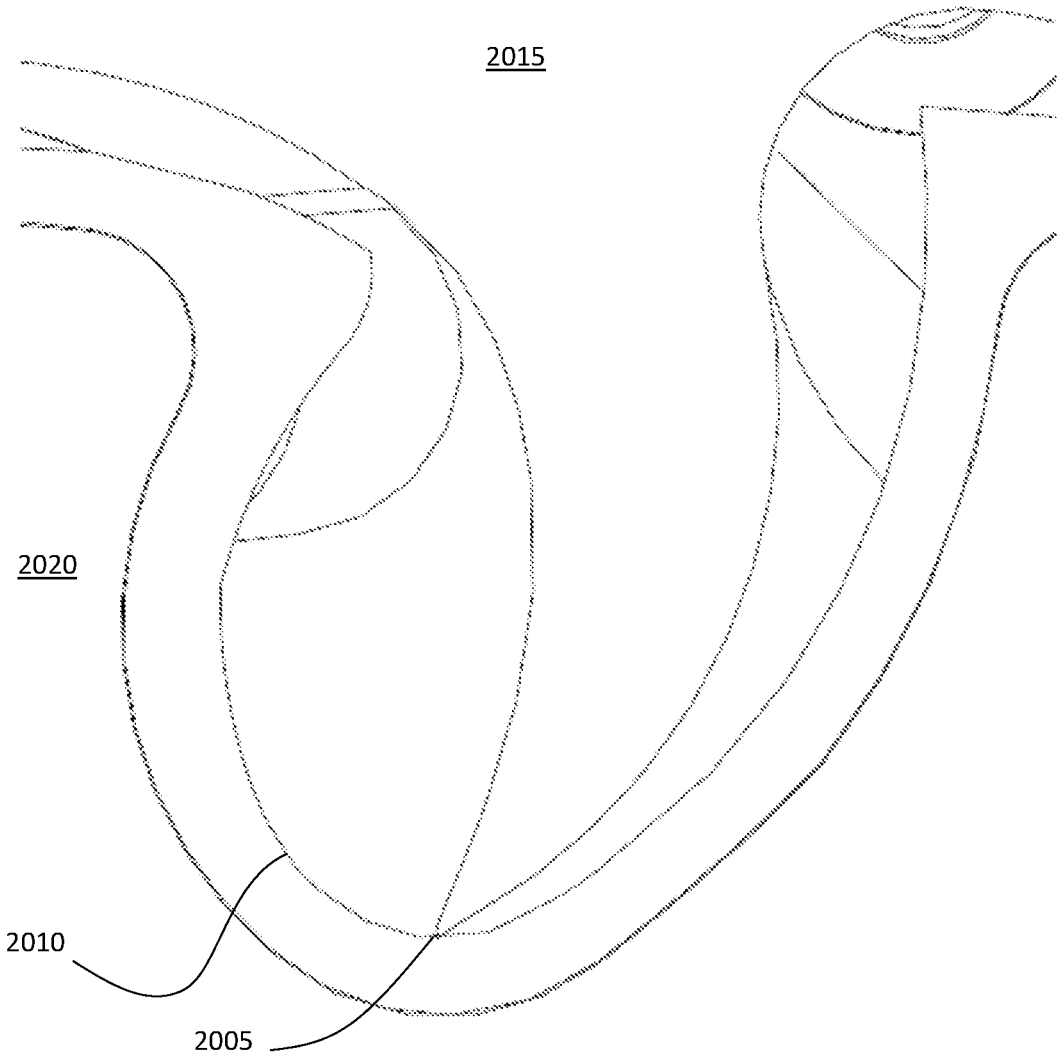
FIG. 20 is a view of a projection of an outer rotor in shaping contact with an inner rotor near Top Dead Center (TDC).

As shown conceptually in FIG. 19, the inventor has determined through experimentation that when using an outer rotor fin 1905 with a sharp tip labeled as 2005 as shown in FIG. 20 to shape a shapable surface, such as PTFE, although the inventor considers that many other shapable materials, including machinable or abradable, materials may be used with various effects. Abradable materials do not generally require a sharp tip. An example shapable surface 1910 is shown in FIG. 19 and is labeled as 2010 shown in FIG. 20 (which is a close up view of the fin 1905 shown in FIG. 19, displayed in the context of an interaction between the fin tip 2005 and a shapable inner rotor 2020 surface 2010), the rake angle carries importance in ensuring proper machining/shaping characteristics. For example, the rake angle, shown by $\Theta$ in FIG. 19, that the inventor has found for steel as an outer rotor fin material and PTFE as a shapable surface material the shaping edge 1915 should have no more than a 26 degree negative rake angle when the aforementioned shaping edge 1915 is moving relative to the shaped surface in the direction shown by arrow 1920. Angles more negative than about 26 degrees negative rake angle have shown to result in less-than-optimal surface finishes with a sharp steel outer rotor tip and PTFE as the inner rotor 2020 shapable surface. Maximum (in the sense of as negative as allowable) and ideal rake angles for other materials and tip sharpness can be determined by experimentation.

The maximum rake angle depends on a number of factors including material combinations and tip hardness, sharpness and rigidity of the shaping edge. Furthermore, the effective rake angle between the shaping edge 1915 of the outer rotor 2015 and the shapable surfaces of the inner rotor continuously changes as the inner rotor 2020 and outer rotor 2015 rotate in unison and the shaping edge 1915 travels over the shapable surfaces of the inner rotor 2020. Consequently, in many configurations, such as the ones shown in this disclosure, achieving an optimal shaping angle at TDC would require sacrificing optimal rake angle at BDC or visa-versa. This is because the contact angle between a fin tip and the inner rotor sealing surfaces varies over the course of contact, making it challenging for the same tip angle to maintain an optimal rake angle.

To address this, the inventor proposes a non-limiting exemplary embodiment shown in FIGS. 21-24 in which every other fin of the outer rotor has a shaping edge designed to operate at an optimized angle for shaping the inner rotor at some points of contact. The remaining tips have a shaping edge designed to operate at an optimized angle for shaping the inner rotor at other points of contact, whereby as the inner rotor and outer rotate in unison, the inner rotor experiences alternating tip geometries with corresponding alternating rake angles.

Figure 21:
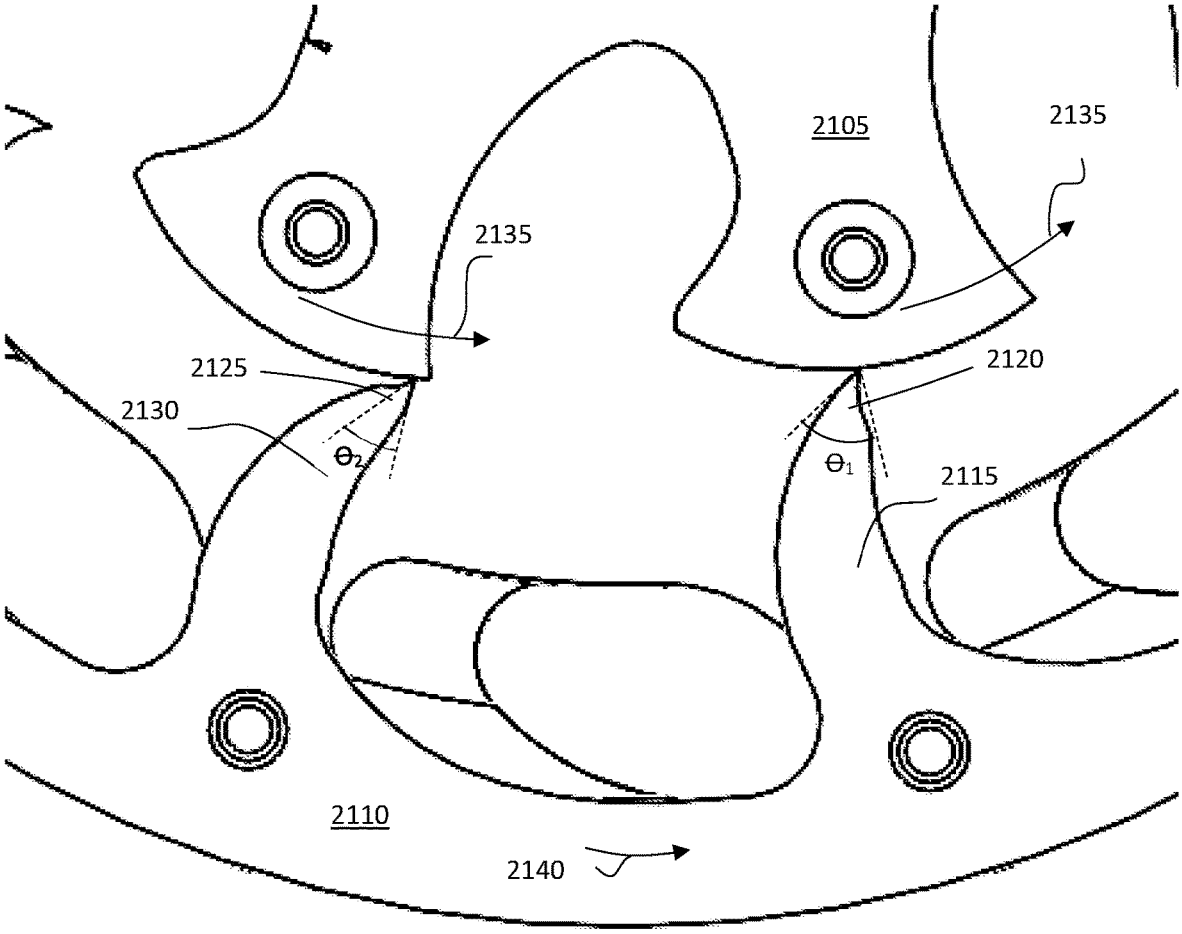
FIG. 21 is a top view near BDC of inward-facing projections of an inner rotor in an exemplary machine showing two different types of shaping edges on alternating projections of the outer rotor.
Figure 22:
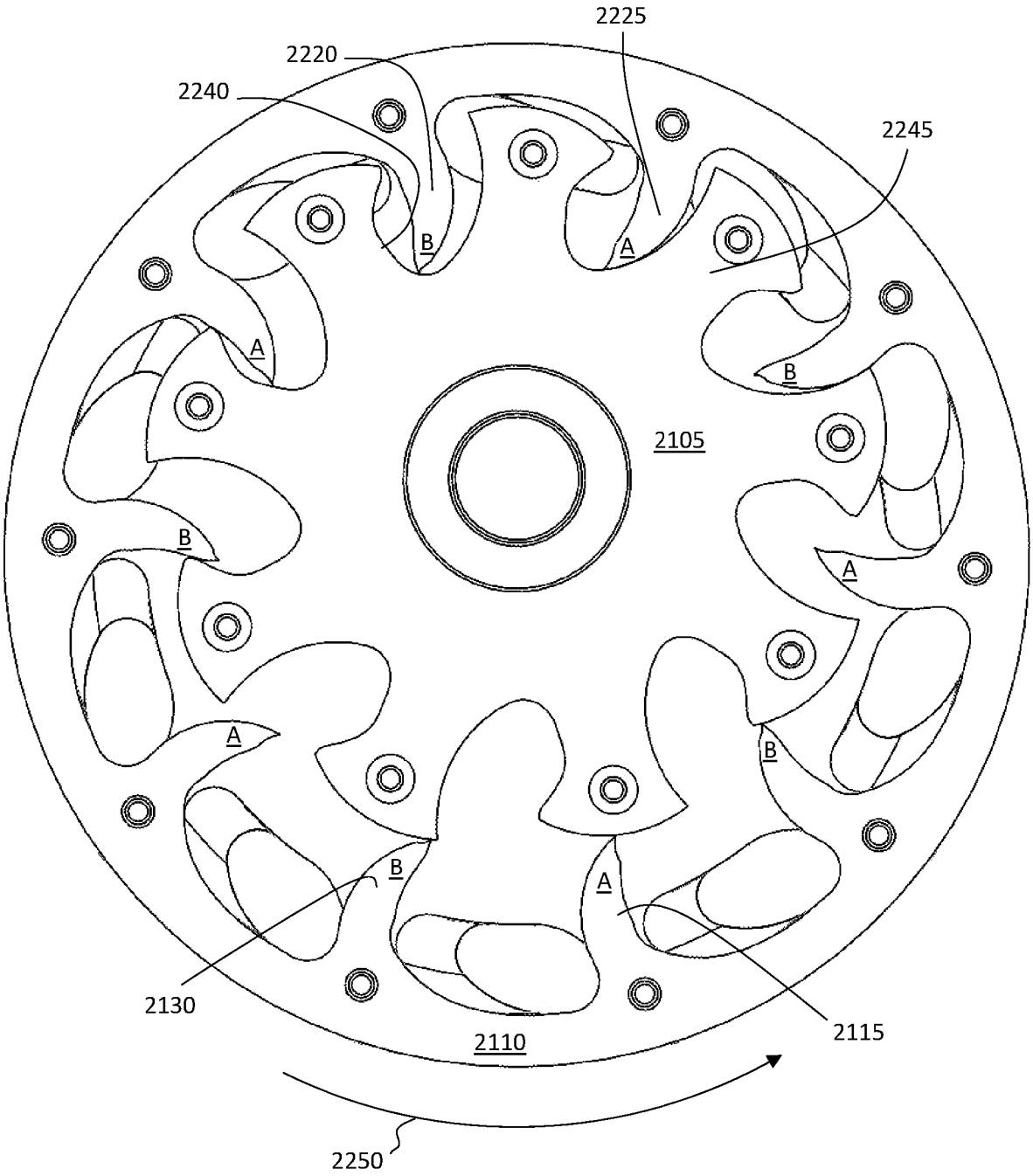
FIG. 22 is a top view of the exemplary machine of FIG. 21, which has an inner rotor having nine outward-facing projections and an outer rotor having ten inward-facing projections, with adjacent outer rotor projections having different shaping edges.
Figure 23:
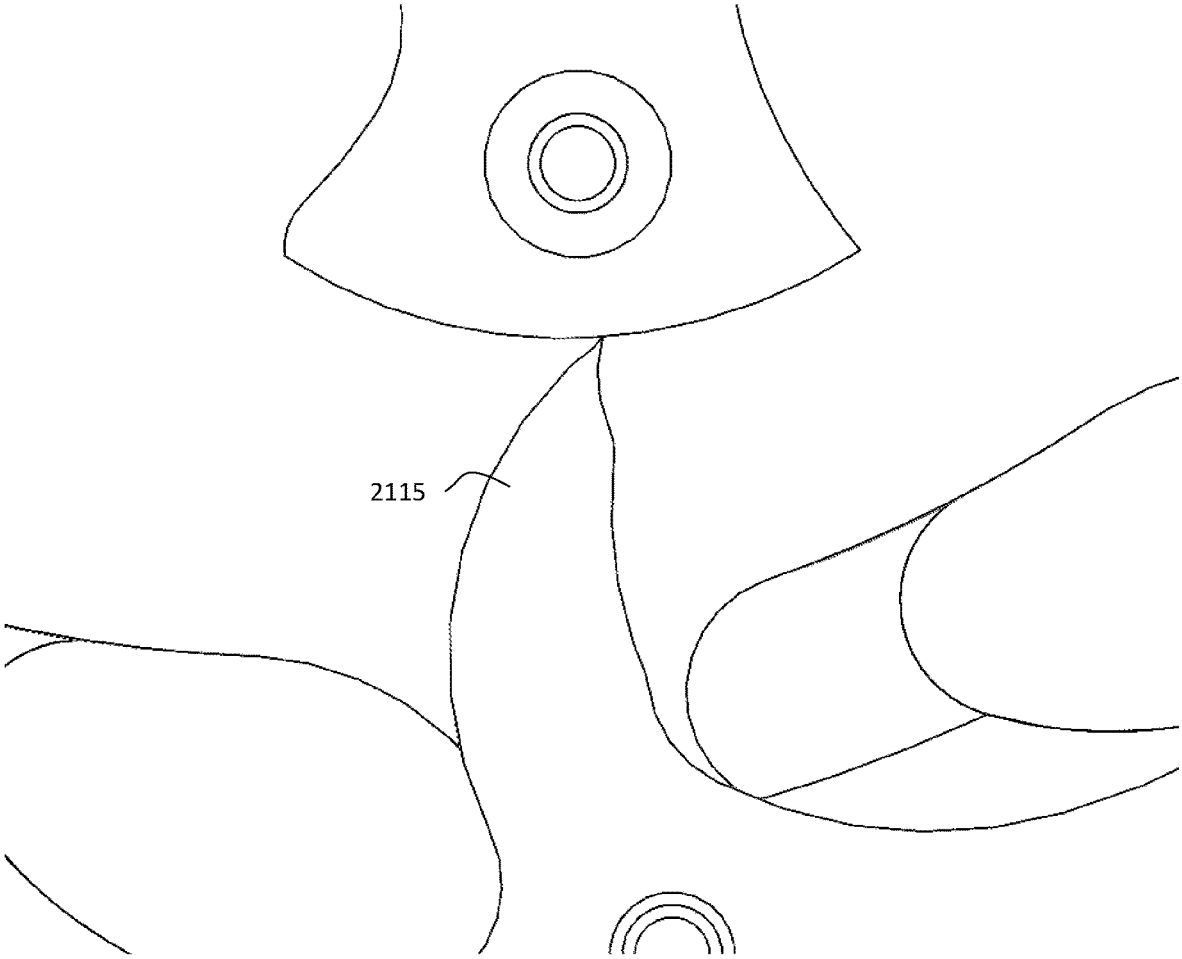
FIG. 23 is a top view close-up showing the shaping edge of an outer rotor projection of the embodiment of FIG. 21.

Thus, for all or most of the areas to be shaped, half (or in other embodiments, one or more) of the fins have a shaping/rake angle optimized for shaping the inner rotor seal surfaces at TDC, while the other half (or in other embodiments, one or more) of the fins have a shaping/rake angle optimized for shaping the inner rotor seal surfaces at BDC. This is in contrast to the case where all of the fins have the same rake angle and the optimal shaping occurs only at TDC or BDC or is not optimized for either. This non-limiting configuration is shown in FIG. 21 wherein a first outer rotor 2110 fin 2115 has a shaping feature 2120 which has a different shaping rake angle, $\Theta_1$, than the shaping rake angle, $\Theta_2$, of the shaping feature 2125 at the tip of the adjacent second outer rotor 2110 fin 2130. The direction of rotation of the inner rotor is shown by arrows 2135 and the direction of rotation of the outer rotor is shown by arrow 2140. Because there are a greater number of outer rotor projections than inner rotor projections, the outer rotor spins more slowly than the inner rotor, as shown in an exaggerated manner by the difference in length of the tails of arrows 2135 and 2140. In this figure the inner rotor is shown and given reference numeral 2105. Thus, the second outer rotor fin 2130 has a greater (i.e. in the non-limiting example shown in FIG. 21, less negative) rake angle $\Theta_2$ at the tips of the outward-facing projection of the inner rotor in the direction of relative motion at Bottom Dead Center (BDC). On the other hand, the first outer rotor fin 2115 will have a greater rake angle at the troughs between the outward-facing projections of the inner rotor in the direction of relative motion at Top Dead Center (TDC). An alternate view showing more context is shown in FIG. 22 and a close-up view of a single fin is shown in FIG. 23. In FIG. 22 the direction of rotation of the inner rotor 2105 and outer rotor 2110 is shown by arrow 2250. In FIG. 22 it may be observed that a fin 2225 (of the same form as fin 2115) has a greater rake angle on inner rotor surface 2240 than that between a fin 2220 (of the same form as fin 2130) and an inner rotor surface 2240 when the fins contact the inner rotor surface 2240 in the troughs between the lobes 2245 of an inner rotor. For clarity, the same reference numerals are used in FIGS. 22 and 23 as were used in FIG. 21, where applicable.

Figure 24:
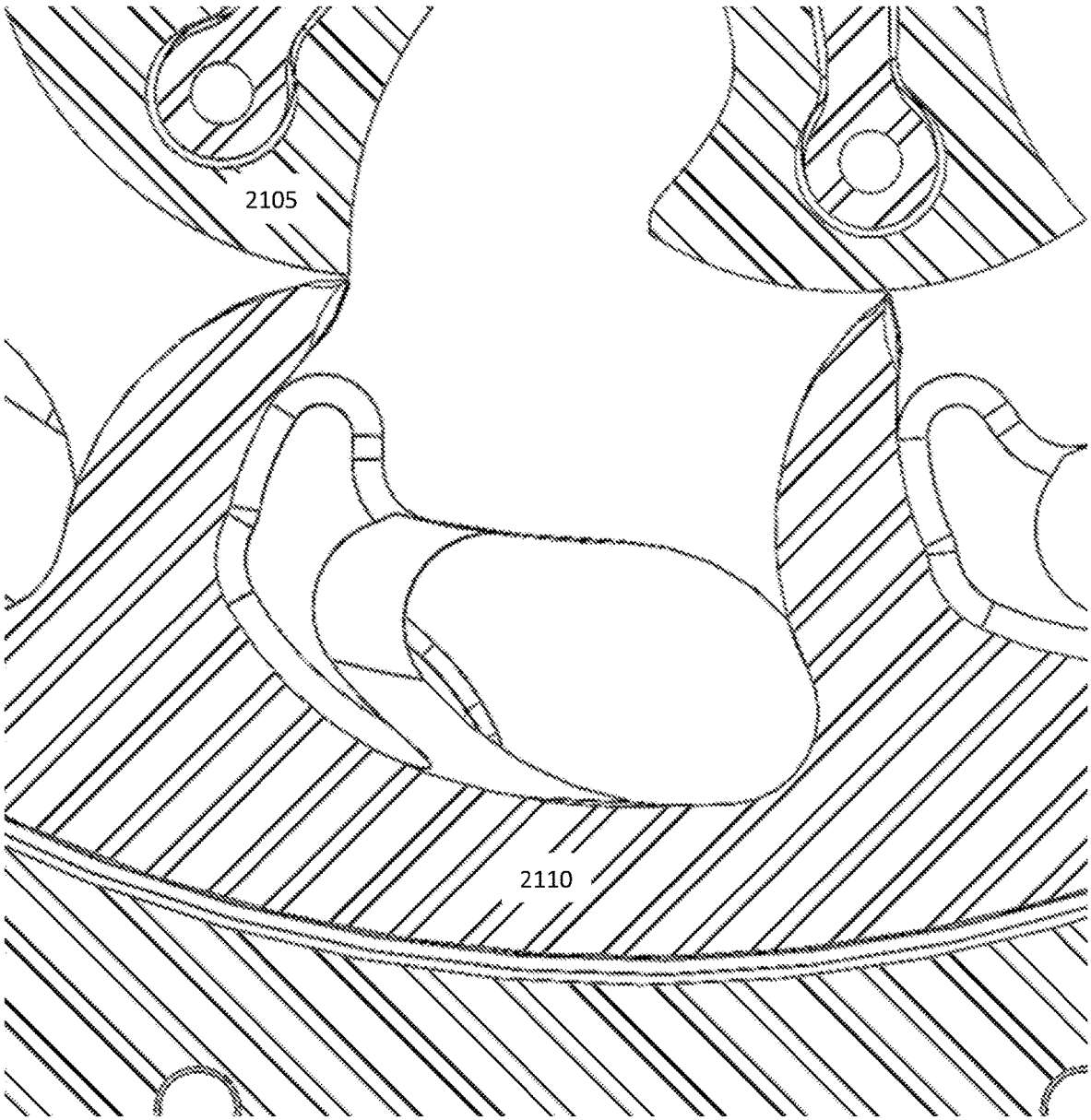
FIG. 24 is a top view overlay of two different outer rotor shaping edges of another exemplary machine on top of each other to show that the tips seal at the same location.

An important feature of the alternating fin tip angle embodiment is that the shaping tips of both fin geometries 2120 and 2124, trace a common hypotrochoid path relative to the inner rotor. This allows both tips to participate in sealing with a consistent contact or gap clearance. FIG. 24 shows a superimposed image of both fins (that is, fin 2115 and fin 2130 from FIG. 21) to show that their tip locations are at the same place relative to the sliding/timing surface of the outer rotor fin. By ensuring that the tips of both (or all) fin geometries are located in the same place relative to the sliding surface of the outer rotor fins, it ensures that a consistent seal gap and timing is provided for all fin tips.

For clarity, the same reference numerals are used in FIG. 24 as were used in FIG. 21, where applicable.

It is understood and anticipated by the inventor that two or more tip geometries may be used, for example in plural sets of projections, the projections of each set having a respective common shape. It is considered preferable, but not essential by the inventor that the number of outer rotor fins is divisible by the number of different tip geometries, i.e. the number of the plural sets where the different tip geometries correspond to plural sets of projections, to maintain rotational balance and consistent shaping during the run-in phase. For example, as shown in FIG. 22, there is a set of five tips with a first geometry, each labeled with "A", and a set of five tips with a second geometry, each labeled with "B", and the number of the plural sets is thus two, which divides the total number ten of outer rotor fins.

Axial Shaping

In an embodiment it is an objective of this device to limit the leakage of the pumping media along the axial faces of an inner rotor, 2505 from a high-pressure side of the device to a low pressure side of the device as doing so may result in, among other benefits, higher efficiencies for the device. An inner rotor may have first and second axially facing surfaces. A first axially facing surface of the inner rotor may face an axially facing surface of an outer rotor to comprise a first surface pairing. A second axially facing surface of the inner rotor may face a housing or another axially facing surface of the outer rotor to comprise a second surface pairing. In an example shown in FIGS. 25-27, an outer rotor 2510 includes an outer rotor endplate 2515, the outer rotor having a first axially facing surface contacting the first axially facing surface of the inner rotor and the endplate 2515 having the axially facing surface facing the second axially facing surface of the inner rotor. To achieve a close tolerance seal with low friction between the outward facing axial ends of the inner rotor 2505 and the inward facing axial ends of the outer rotor 2510, and outer rotor endplate 2515 a similar approach may be taken to that which has already been described for creating near-contact seals in the radial direction. That is, the inclusion of a feature which is sharp, abrasive, or otherwise capable of removing material from another part of the device may be used. An example of such features is the plurality of shaping features shown in FIGS. 25-27. An abradable coating may also be used on either or both of the mating surfaces such that one surface may rapidly wear or both surfaces may wear into each other. Any of the axial surface pairings described may have such features or coatings, and the features may be on either surface of the pairing and the coating may be on either or both surfaces of the pairings.

Figure 25:
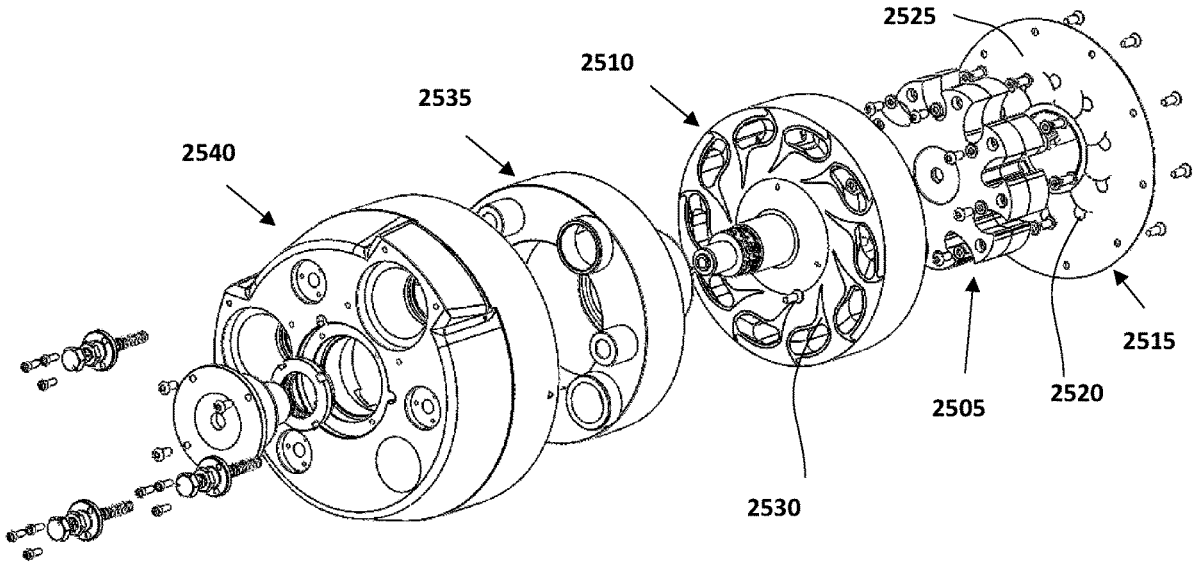
FIG. 25 is an isometric exploded view of the exemplary machine of FIG. 22.
Figure 26:
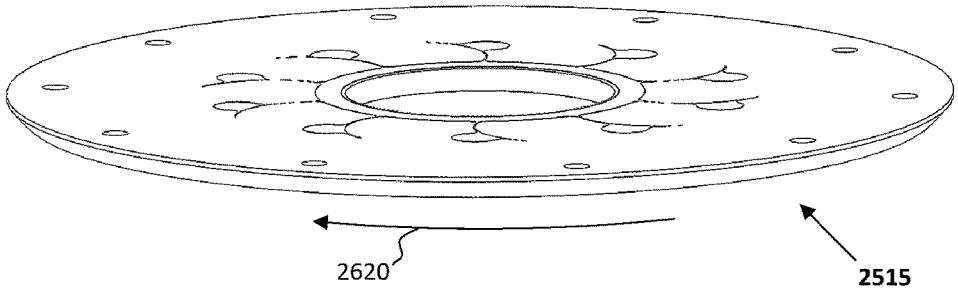
FIG. 26 is an isometric view of an endplate of the exemplary machine of FIG. 25 showing shaping features.

In the non-limiting embodiment shown in FIG. 25, first shaping features 2520 are small protrusions on an outer rotor endplate 2515, which are proud of the plate surface 2525 by a distance of approximately 0.01 mm. The exact magnitude of the protrusion may be greater or smaller, resulting in different effects, although it may be advantageous to select a protrusion of 0.01 mm as shown in FIG. 26, so as to augment the sealing of the device in the axial direction, not only at the top of the shaping feature, but also, on one or both of the leading and trailing edges. Furthermore, the geometry of the shaping feature may be designed to occupy a small percentage of the total sealing surface area such that the surface area of the top of the shaping surface feature has minimal surface area that may rub and cause local heating of the shaping edge and of the machinable/abradable/otherwise shapable material. The position of outer rotor plate 2515 and the orientation of the first shaping features 2520 within a non-limiting exemplary device may be seen in FIG. 25. In this orientation, it may be seen that the first shaping features 2520 are arranged so as to remove material from a rotating inner rotor 2505 during certain operating conditions, such as during a run-in phase. The removal of material on inner rotor 2505 by first shaping features 2520 may be controlled during a testing procedure or during a run-in period following initial start-up. Additionally, the inventor contemplates a run-in period occurring after a device is repaired or as a process to improve sealing if the device's sealing surfaces become damaged or worn during operation. A method for controlling such a removal is taught by the author below.

To improve device performance, the shaping features for any surface pairing described may be generally angled, in a counterclockwise outwardly spiraling direction for a clockwise rotation device (when the view is towards surface of endplate 2515 which has shaping features 2520) as is shown in FIG. 25 as a non-limiting example. This contributes to the removal of shaping debris toward the outside of the rotors where it can be expelled from the discharge port. FIG. 26 shows the endplate 2515 separated from the rest of the device. In FIG. 26 the direction of rotation of endplate 2515 is shown by arrow 2620.

Figure 27:
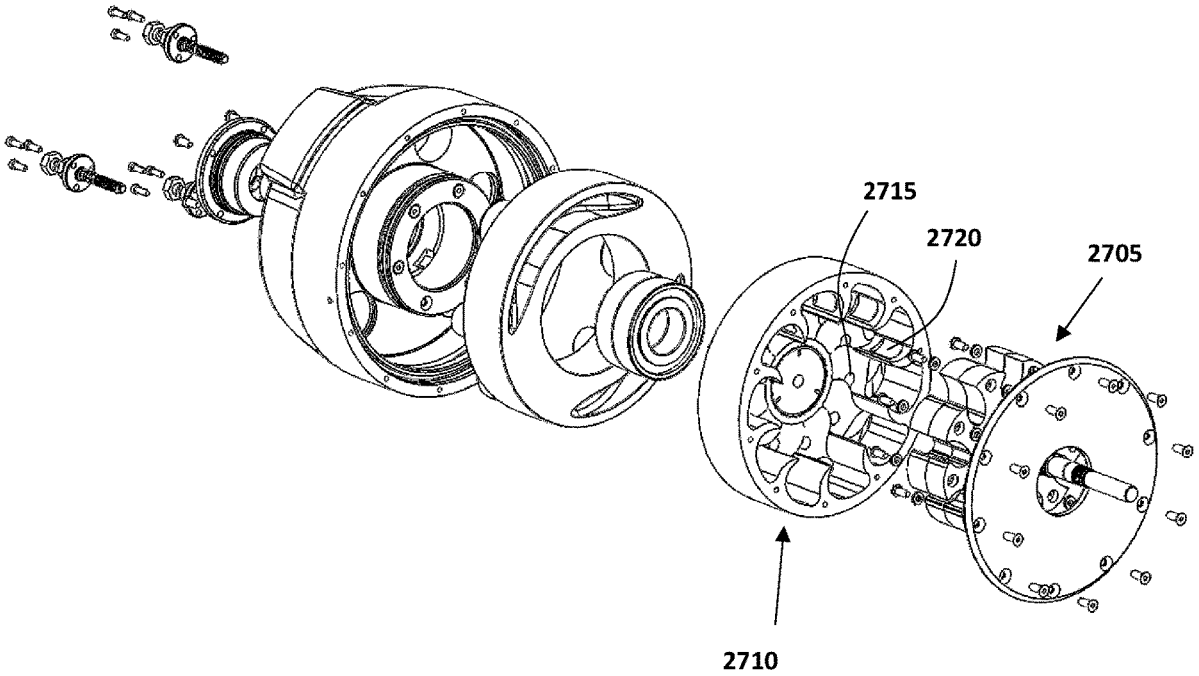
FIG. 27 is an isometric exploded view of the exemplary machine of FIG. 22 showing a different isometric perspective than FIG. 25.

Visible in FIG. 27 are second shaping features 2715, located on an Outer Rotor, 2710 which are constructed in a similar fashion to first shaping features 2520 from FIG. 25. In the non-limiting embodiment shown in FIG. 27, these second cutting features are oriented so as to remove material from an inner rotor 2705 when the device is in operation under certain conditions, such as during a run-in phase.

Depending on the embodiment there may also be further axial surface pairings between the inner or outer rotor and the housing, for example a port plate of the housing. Visible in FIG. 25 are third shaping features 2530, located on the axially outward face of an Outer Rotor, 2510 which are constructed in a similar fashion to first shaping features 2520. In the non-limiting embodiment shown in FIG. 25, these third shaping features are oriented so as to remove material from a sealing plate, 2535 when the device is in operation under certain conditions, such as during a run-in period.

Any interaction with such a port plate may also occur with other parts of the housing. In embodiments, discussed below, in which the rotors do not have endplates, such interaction may assist with sealing to the housing. Where the rotors do have endplates, interaction with a port plate may assist with sealing to the port plate, but there is less need to seal to other parts of the housing than a port plate where there is an endplate since typically the endplate will not need to have holes in this case, letting any chamber between the endplate and non-port plate housing portion be disconnected from the working fluid regions of the device.

The term "endplate" may be used in this document to refer to a separately constructed plate assembled to part of a rotor, as with the endplate 2515 in FIG. 26, or to a plate integral with the rest of a rotor and having an axial facing surface which faces the projections of that rotor and the other rotor, for example the surface including shaping features 2715 as shown in FIG. 27.

The inner rotor, outer rotor and housing collectively form a set of components arranged for relative motion in planes perpendicular to the axis (of any one of the rotors). There may be axially facing surfaces forming interfaces between any pair of these components. In some embodiments, the inner rotor contacts the outer rotor at two such interfaces. Both interfaces may include axially facing surfaces of integral or separately formed endplates of the outer rotor, as shown for example in FIGS. 25-27. In other embodiments, for example, the outer rotor may contact endplates of the inner rotor, so that the outer rotor is axially within the endplates of the inner rotor (a "spool" arrangement), or each of the inner and outer rotor may have a respective endplate contacted by the other rotor. In further embodiments, discussed below, there may be fewer than two such interfaces between the rotors.

Figure 52:
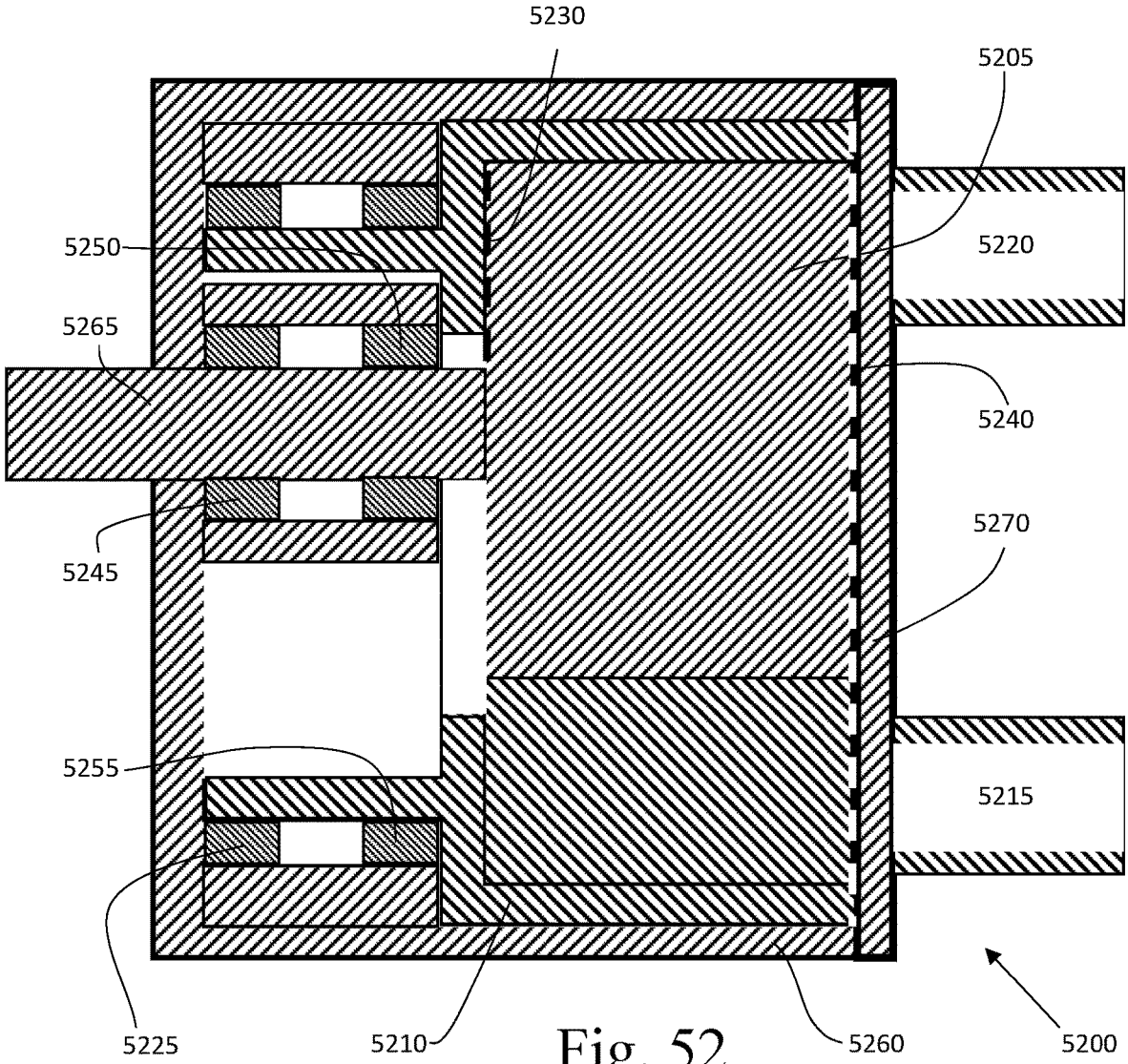
FIG. 52 is a side sectional view of an exemplary machine having and inner and outer rotor which interact in the axial direction only on one side, and both rotors interact with the axial face of the housing on the opposite side.

In the embodiment shown in FIGS. 25-27, the inner rotor is axially between outer rotor surfaces, so there are two surface pairings between inner and outer rotor axial surfaces, and only the outer rotor has a surface pairing with the housing. In other embodiments, for example as shown in the non-limiting simplified embodiment of the machine 5200 shown in FIG. 52, an inner rotor 5205 may have a single surface pairing with the outer rotor 5210, shown by dashed lines 5230 and each of the inner rotor 5205 and the outer rotor 5210 may have a surface pairing with and inner-facing axial face of the housing 5270. This pairing between the rotors 5205, 5310 and housing 5230 is shown via dashed line 5240. For reference, a lower portion of the housing 5260 supports bearings 5245 and 5250 which support the input shaft 5265 of the inner rotor 5205 and bearings 5225 and 5255 support the outer rotor 5210. Also, for reference, 5215 is an intake port and 5220 is an exhaust port.

Figure 56:
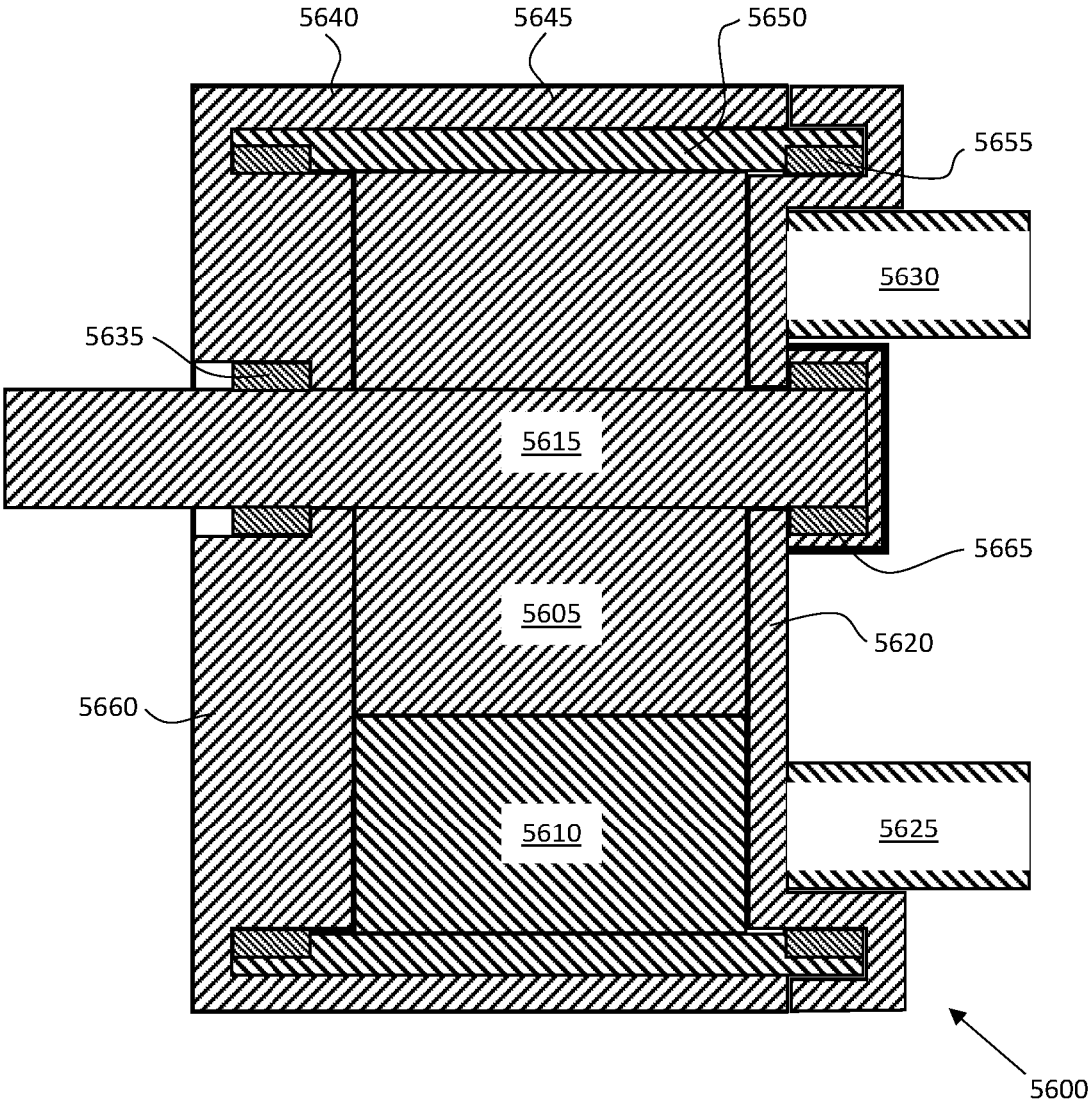
FIG. 56 is a section view of an exemplary machine having two surface pairings between an inner and outer rotor combination and a housing.

In an alternate simplified non-limiting embodiment shown in FIG. 56 the inner rotor is axially between two housing surfaces, so there are two surface pairings between inner rotor axial surfaces and housing surfaces and two surface parings between the outer rotor axial surfaces and the axial surfaces of the housing. As shown in FIG. 56, for ease of assembly the housing may comprise two parts, first housing portion 5660 and second housing portion 5620. An inner rotor 5605 may have a first surface pairing between the outward-facing axial surfaces of the aforementioned inner rotor and the axially inward-facing surfaces of a first housing portion 5660, and a second surface pairing between the outward-facing axial surfaces of the inner rotor and the inward-facing axial faces of a second housing portion 5620. The outward-facing axial surfaces of an outer rotor may also have a first surface pairing between the outward-facing axial surfaces of the aforementioned outer rotor and the inward-facing axial surfaces of the first housing 5660, and a second surface pairing between the outward-facing axial surfaces of the aforementioned outer rotor and the inward-facing axial surfaces of a second housing portion 5620. Where a rotor contacts the housing without an endplate, both rotors may contact the housing. In the claims, a mention of a surface of one rotor contacting a surface of the housing does not exclude the other rotor also contacting the same surface of the housing.

In the embodiment shown in FIG. 56, a first portion of the housing 5660 supports bearing 5670 which supports a first end of an outer rotor 5650, and bearing 5635 which supports a first end of inner rotor shaft 5615. Second housing portion 5620 supports bearing 5665 which supports a second end of outer rotor 5610, as well as bearing 5665 which a second end of input shaft 5215. Also, 5625 is an intake port and 5630 is an exhaust port. Other embodiments may have different arrangements of bearings and ports.

Figure 57:
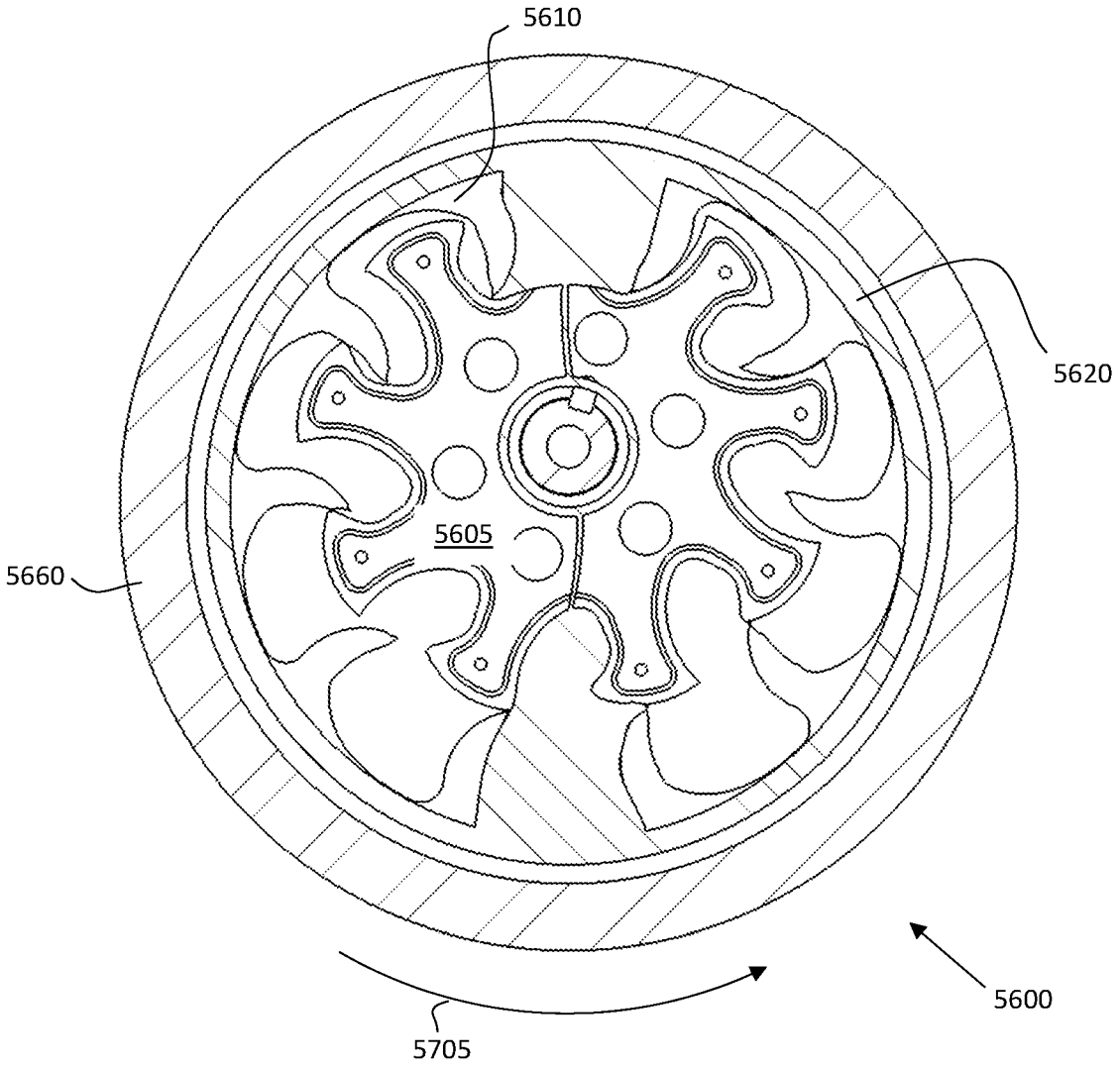
FIG. 57 is a section view of an exemplary machine shown schematically in FIG. 56 showing a housing which seals against the inner and outer rotors.
Figure 58:
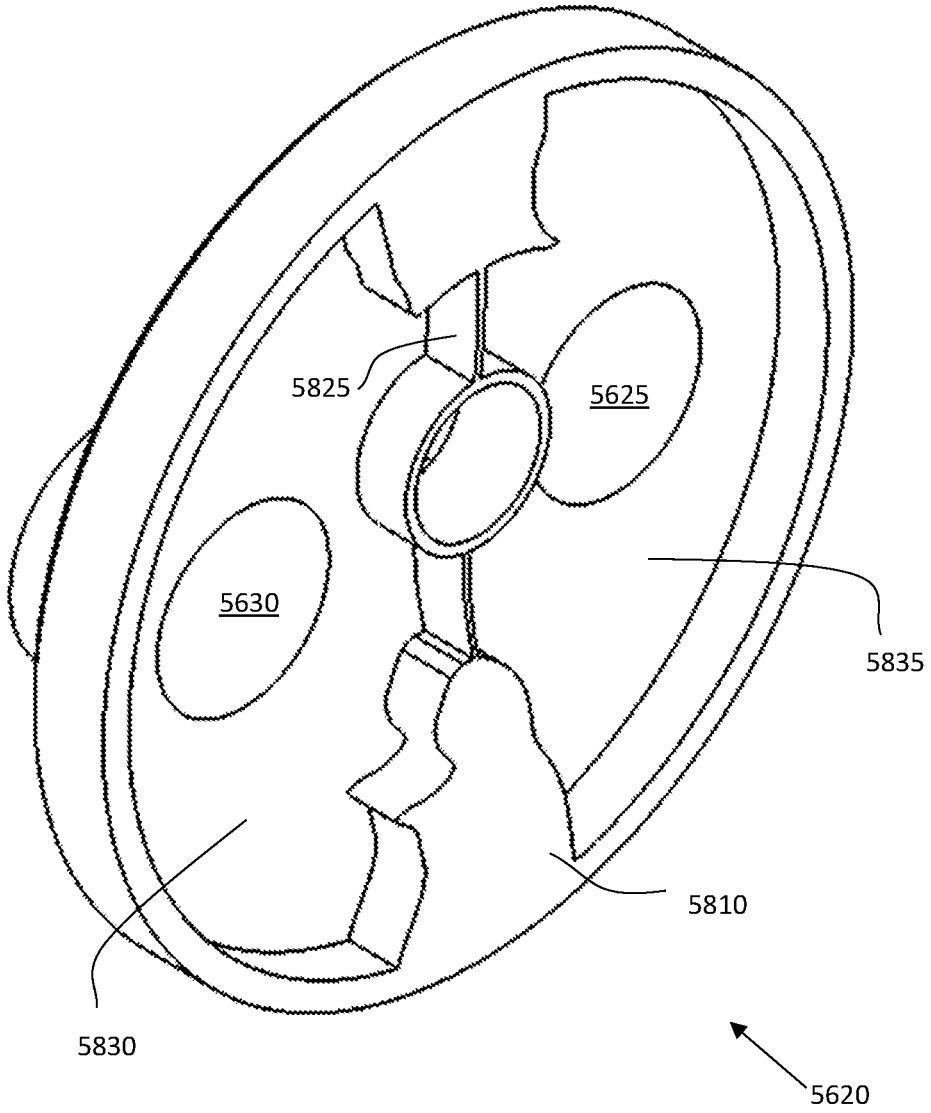
FIG. 58 is an isometric view showing the housing shown in FIG. 57 which seals against the inner and outer rotors.

To further illustrate the above embodiment, a sectional view of an embodiment similar to that shown in FIG. 56 is shown in FIG. 57. In the embodiment shown in FIG. 57, intake port 5625 and exhaust port 5630 are in different locations as seen in FIG. 58, but serve the same purpose as those shown in FIG. 56. It may be observed from FIG. 57 that no port plate interacts with the axially facing surfaces of inner rotor 5605 and outer rotor 5610. Rather, second housing portion 5620 has a first axially facing surface 5810 as shown in FIG. 58, which forms a surface pairing with axially facing surfaces on the inner rotor 5605 and outer rotor 5610. In such an embodiment, shaping features on any one or combination of the inner rotor 5605, outer rotor, 5610, or second housing portion 5620 may be configured to shape opposing faces in order to form a near-contact seal which may have low leakage and/or low friction. Sealing barrier 5825 splits the second housing portion 5620 into intake manifold 5835 and exhaust manifold 5830. Sealing barrier 5825 prevents leakage across the axial surfaces of the inner rotor 5605 between the axial surface of the inner rotor 5605 and the second housing portion 5620 from the exhaust manifold 5830 to the intake manifold 5835. In the non-limiting example shown in FIG. 56 second housing portion 5620 has been designed for a pump configuration to be used with non-compressible fluid. However, as shown in other embodiments it would be apparent to someone skilled in the art how to adjust the geometry for example to enable internal compression and/or expansion and/or to comprise a compressor configuration.

Figure 59:
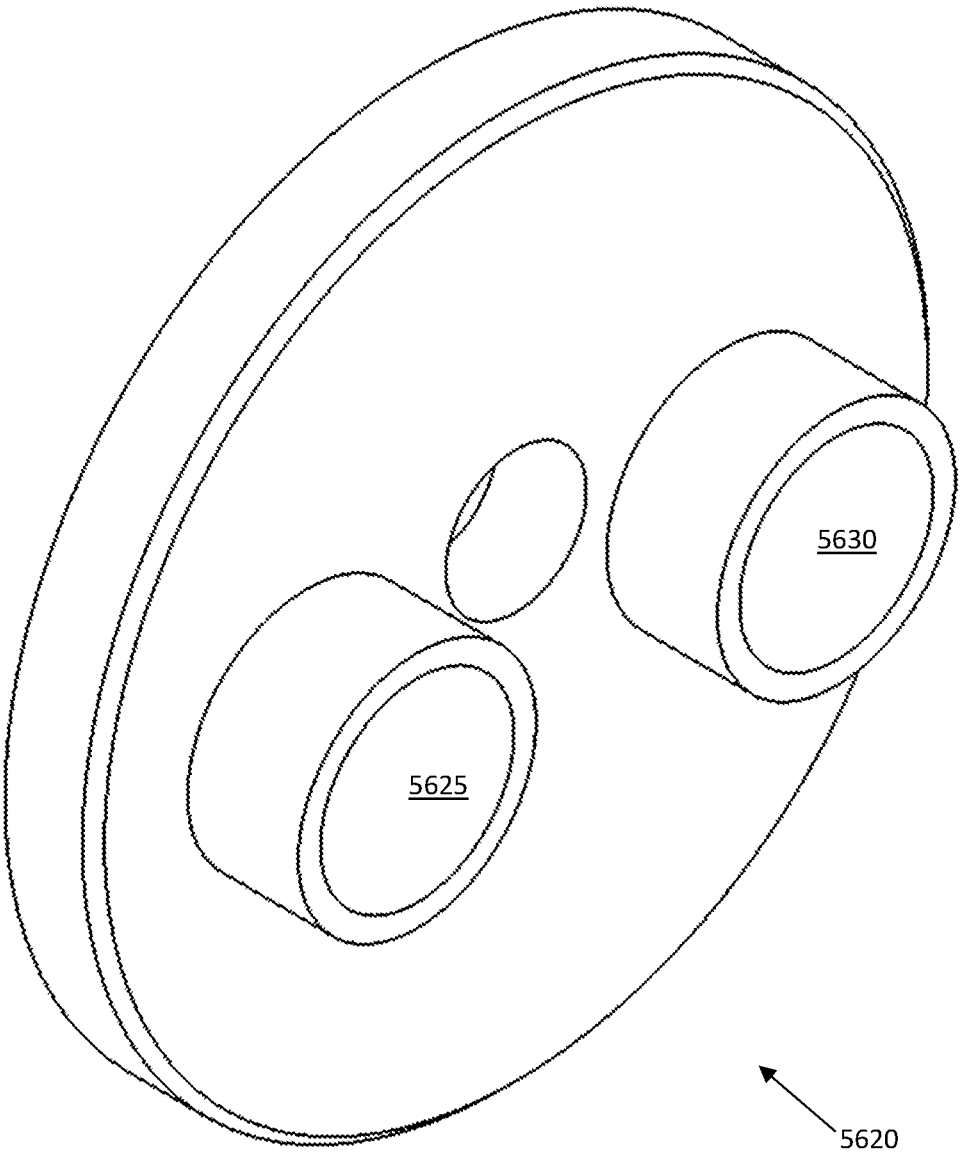
FIG. 59 is an alternate isometric view of the housing shown in FIG. 58 showing the exterior of the housing including intake and exhaust ports.

Alternate views of the second housing portion 5620 are shown in FIGS. 58 and 59. For clarity, reference numerals in FIG. 56 are re-used in FIGS. 57, 58, and 59 where applicable. For further clarity, a preferred direction of rotation is indicated in FIG. 57 by arrow 5705.

Figure 28:
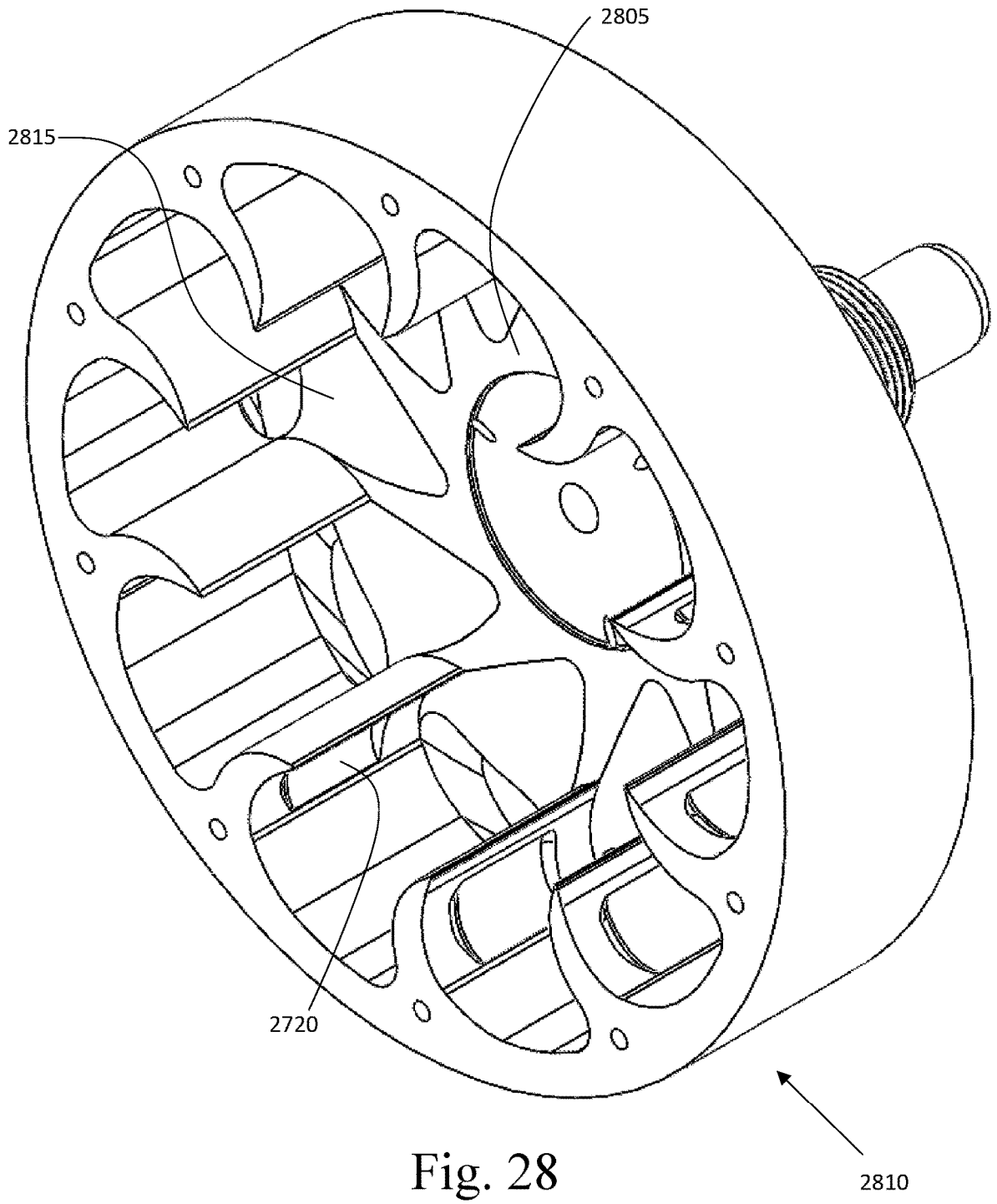
FIG. 28 is a first isometric view of an outer rotor of the exemplary machine of FIG. 22 showing non-sealing portions which provide flow channels which prevent secondary chambers from sealing as well as shaping features on an axial face of the outer rotor.

The inventor notes that the shaping features may adopt different configurations than those shown in FIGS. 25-27. For example, in the non-limiting embodiment shown in FIG. 28, first shaping features 2805 are small protrusions on the inward axial-facing sealing surface 2815, these first shaping features 2805 being proud of the outer rotor 2810 axial-facing sealing surface 2815. As was previously taught, various magnitudes of the protrusion may be used, although it may be advantageous to minimize the magnitude, as shown in FIG. 28, so as to augment the sealing of the device in the axial direction with a close clearance of the surface surrounding the shaping features. The position of the outer rotor 2810 axial-facing sealing surface 2815 and the orientation of the first shaping features 2805 within a non-limiting example device may be seen in FIG. 29. In this orientation, it may be seen that the first shaping features 2915 on an outer rotor 2910 are arranged so as to remove material from a rotating inner rotor 2905 when the device is in operation under certain conditions. The removal of material on inner rotor 2905 by first shaping features 2915 may be controlled during a testing procedure or during a wear in period following device assembly or repair. The method for controlling such a removal is taught by the author below.

Figure 32:
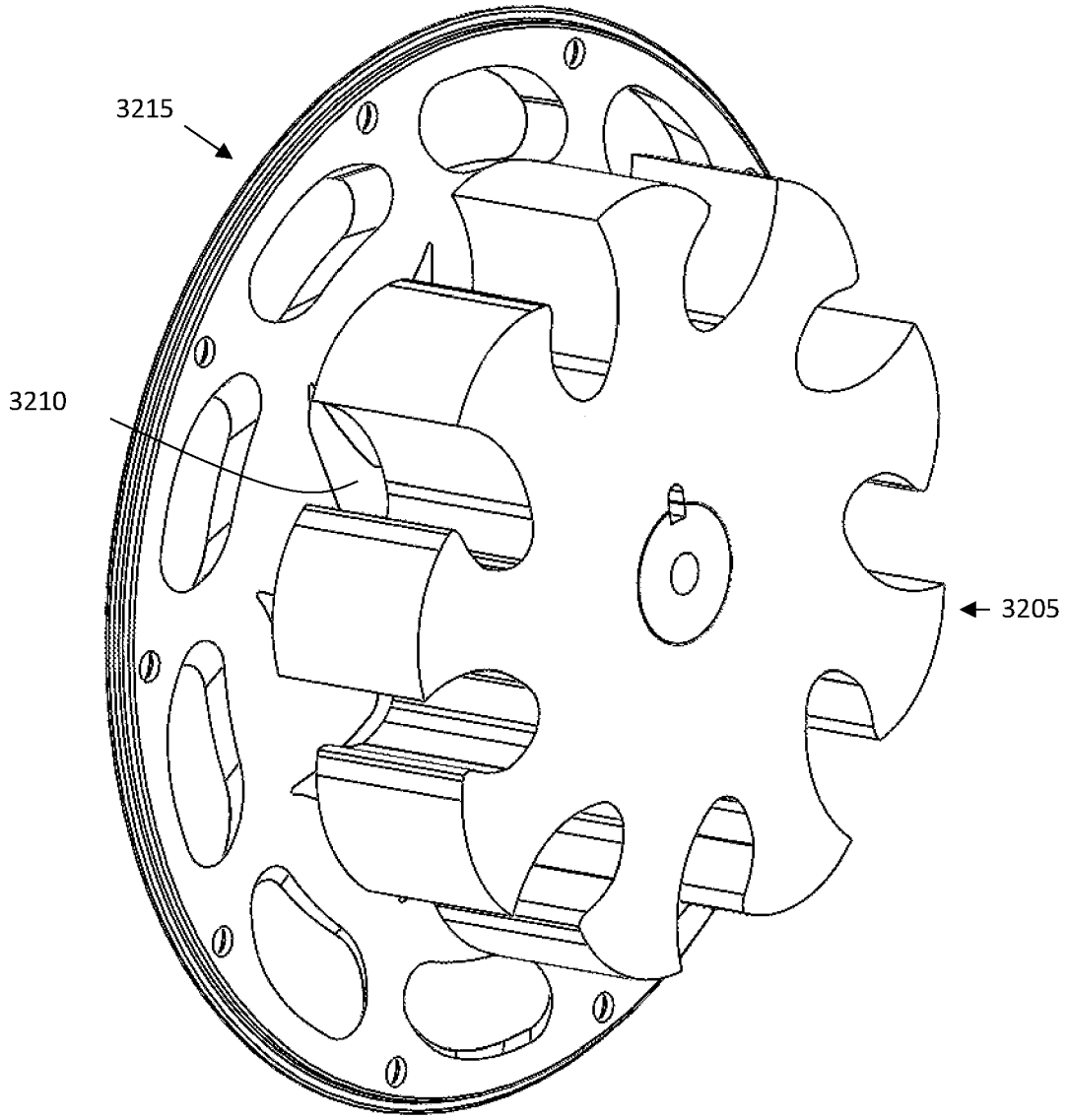
FIG. 32 is an isometric view showing an assembly of an outer rotor end plane and an inner rotor of the exemplary machine of FIG. 29 with shaping features shown on the outer rotor endplate.

Visible in FIG. 32 are second shaping features 3210, located on an outer rotor endplate, 3215 which are constructed in a similar fashion to first shaping features 2805 from FIG. 28. In the non-limiting embodiment shown in FIG. 32, these second shaping features 3210 are oriented so as to remove material from an inner rotor 3205 during certain operating conditions, such as run-in conditions for example.

Figure 29:
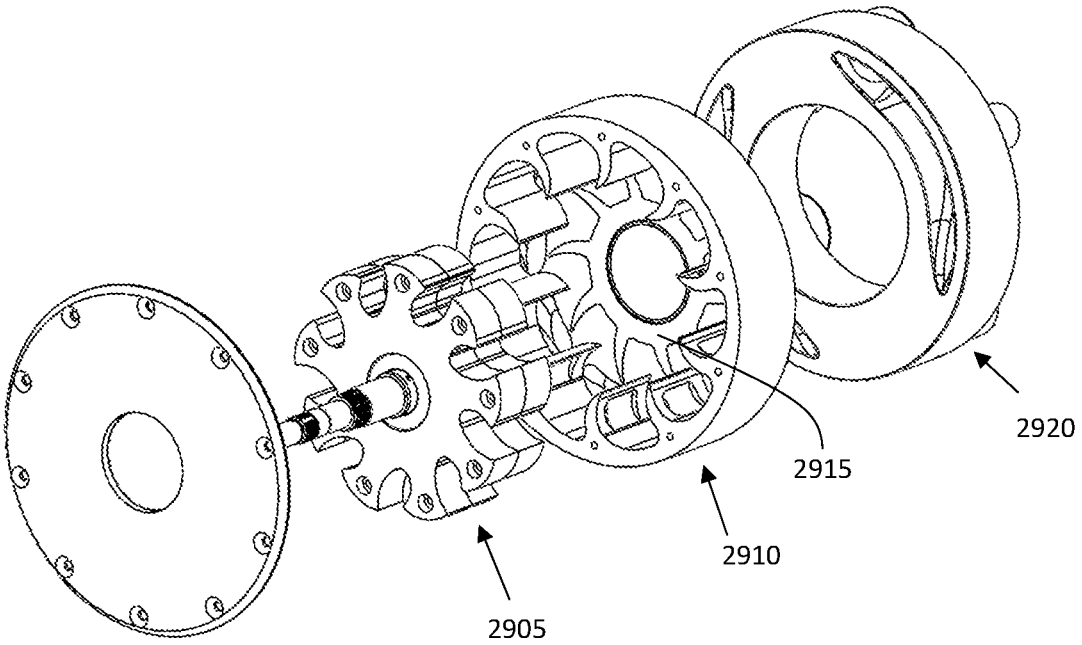
FIG. 29 is an isometric exploded view of selected components of the exemplary machine of FIG. 22.
Figure 30:
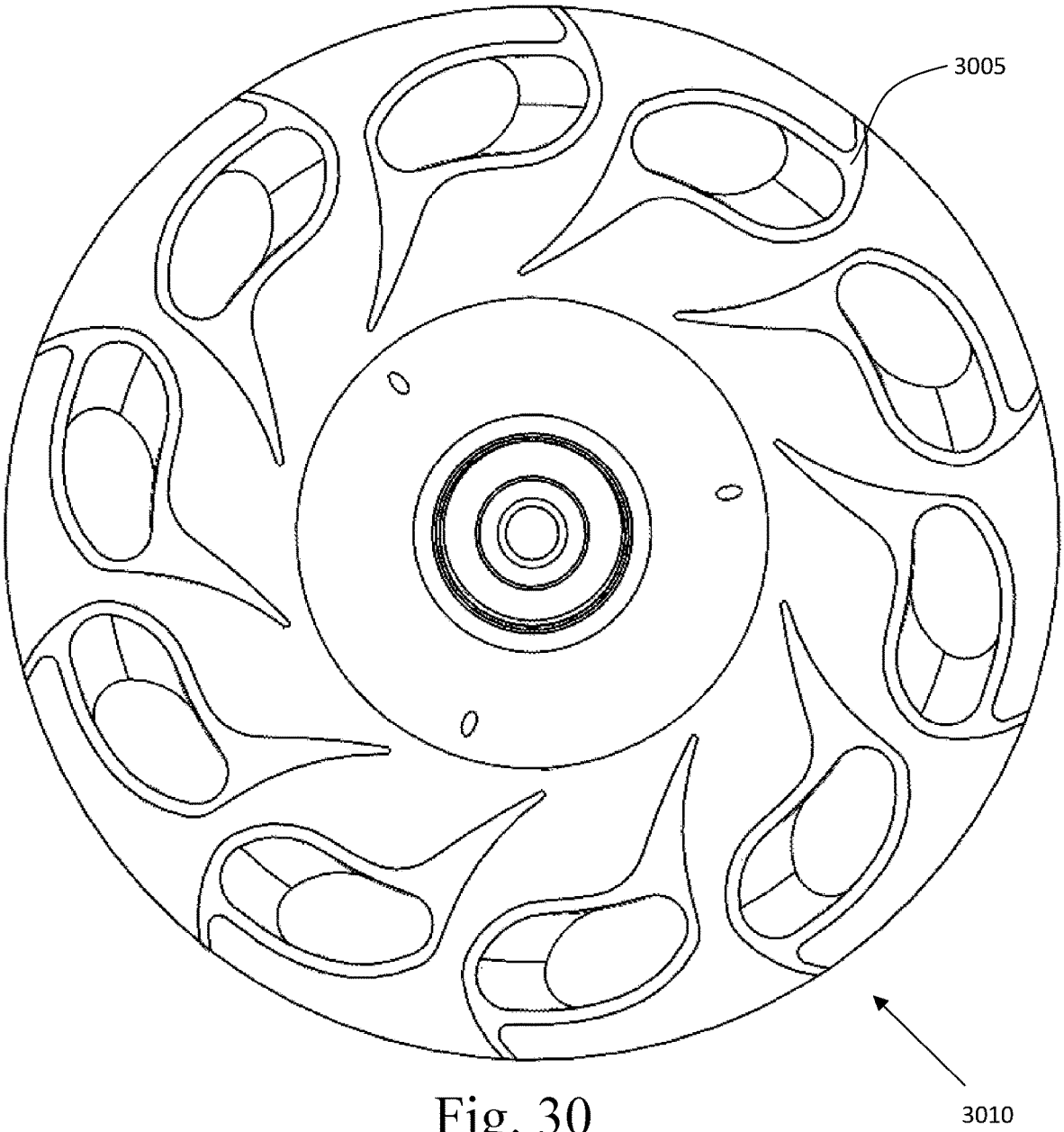
FIG. 30 is a bottom view of the outer rotor of the exemplary machine of FIG. 22 showing shaping features on an axial face of the outer rotor.
Figure 31:
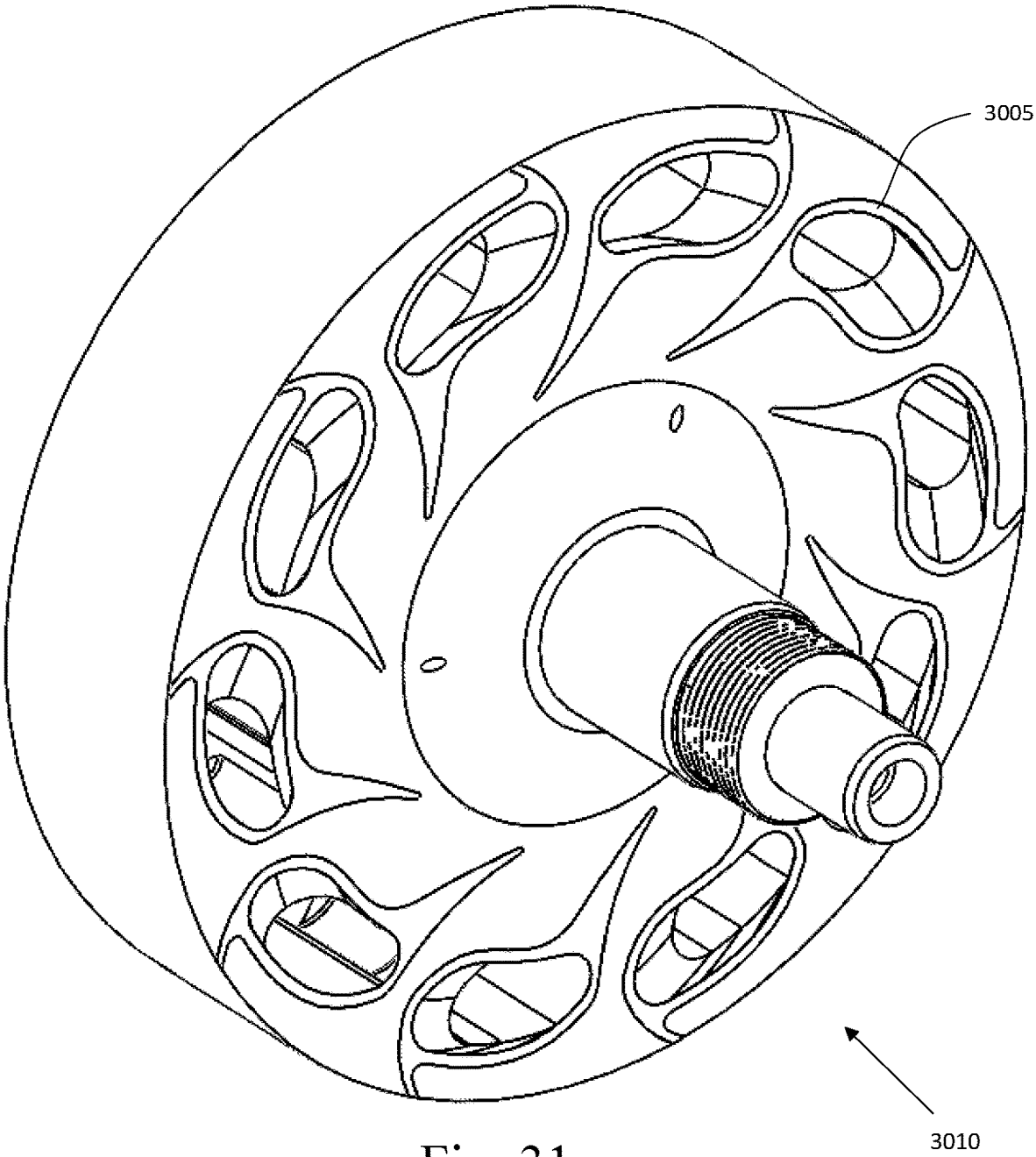
FIG. 31 is a second isometric view of the outer rotor of the exemplary machine of FIG. 22 showing shaping features on an axial face of the outer rotor.

Visible in FIGS. 30 and 31 are third shaping features 3005, located on an outer rotor, 3010 which are constructed in a similar fashion to first shaping features 2805 from FIG. 28 In the non-limiting embodiment shown in FIG. 30, these third shaping features 3005 are oriented so as to remove material from a sealing plate, 2920 in FIG. 29 when the device is in operation under certain conditions. For clarity, reference numerals from FIG. 30 are reused in FIG. 31 where applicable.

Figure 33:
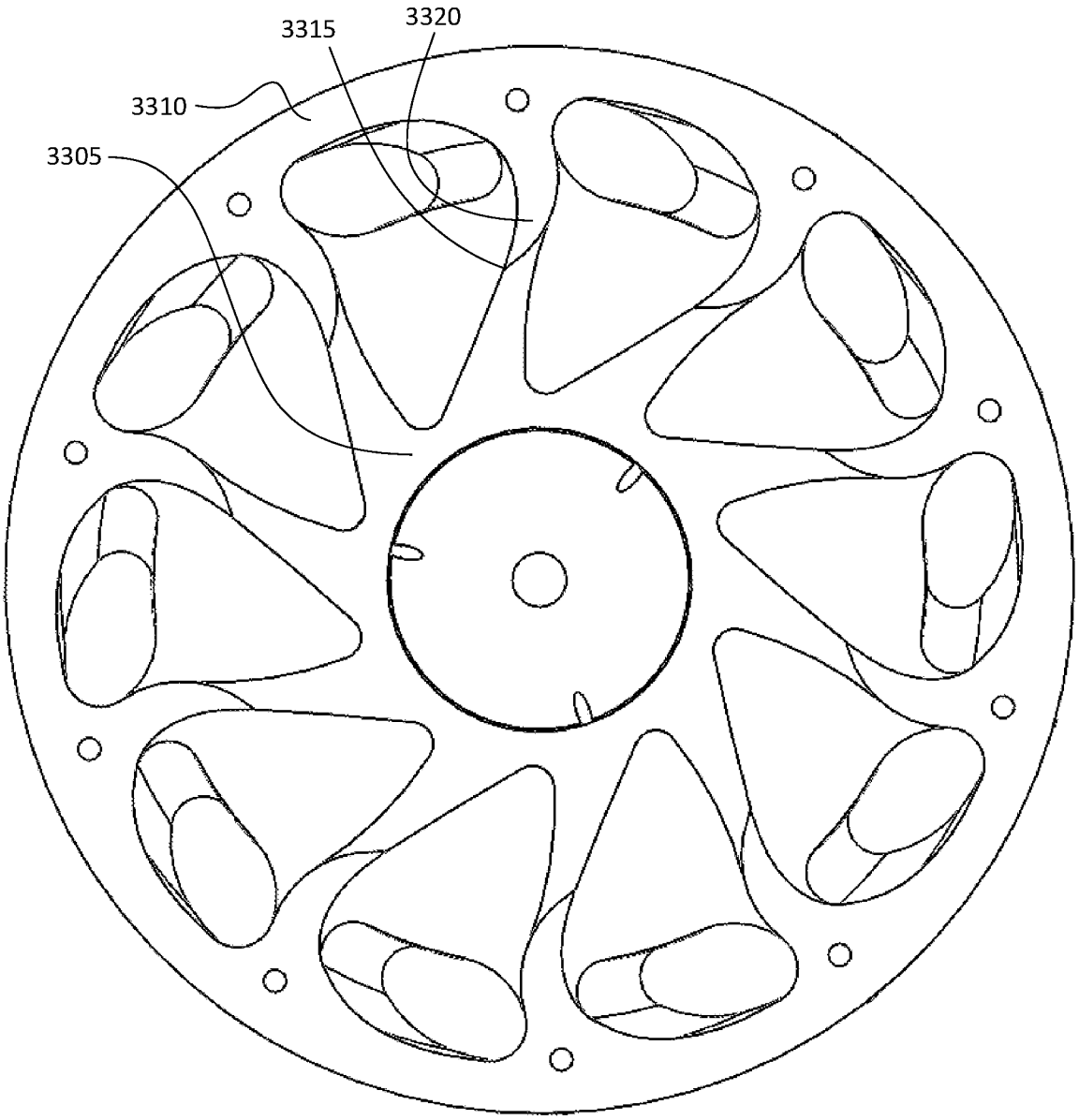
FIG. 33 is a top view of an outer rotor showing shaping features in the radial and axial direction.
Figure 34:
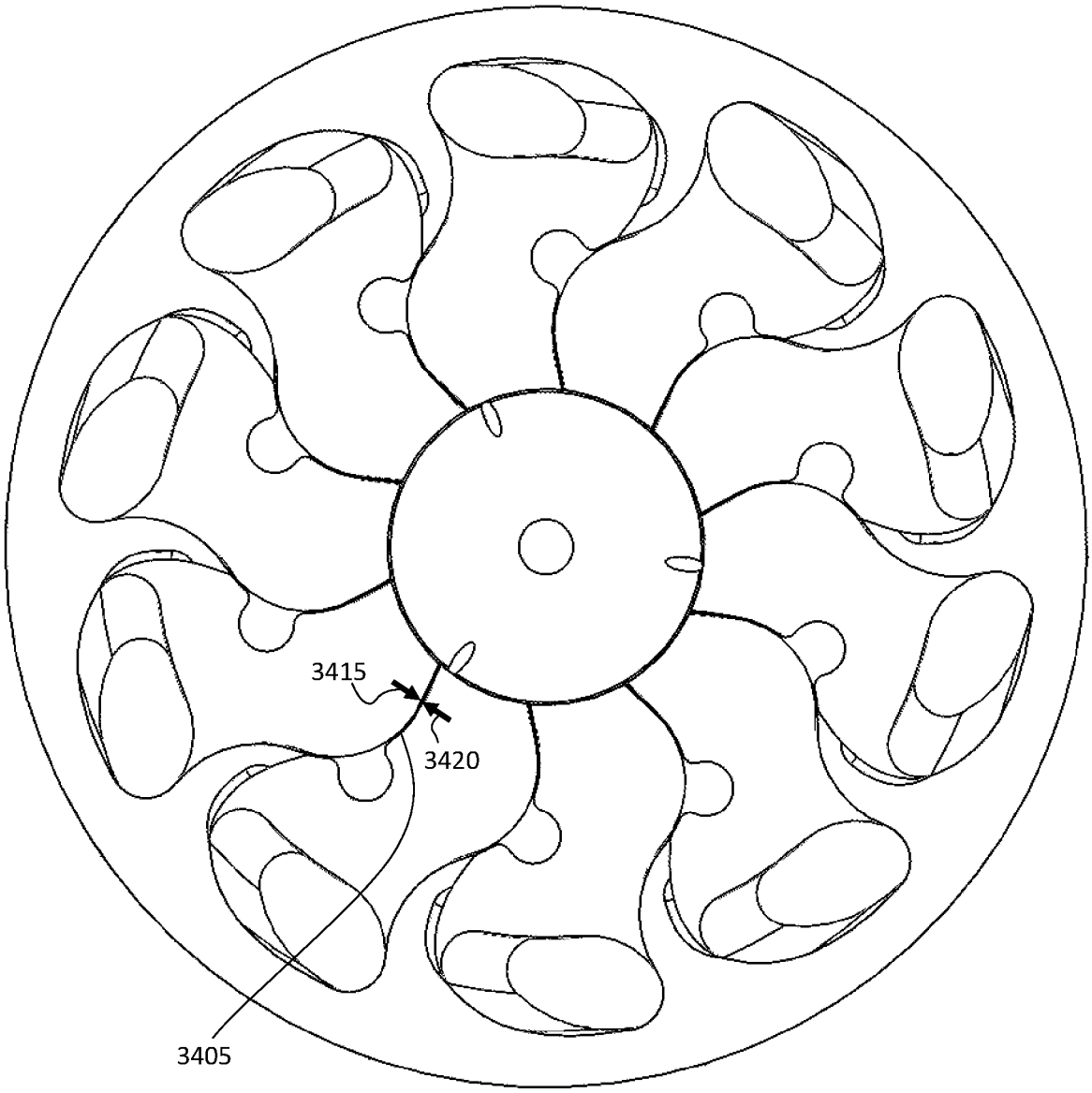
FIG. 34 is a top view of an outer rotor having an alternate shaping feature design to the one shown in FIG. 33, as well as a view of non-sealing portions which provide fluid channels.

The raised surfaces comprising the shaping features, such as first shaping features 2805, second shaping features 3210, and third shaping features 3005 have the two roles of shaping corresponding surfaces as well as forming a seal between the aforementioned raised surface and its corresponding shaped surface. Thus, the raised surfaces may be designed with a pre-determined balance between shaping and sealing. As shown in the non-limiting embodiment shown in FIG. 33, the raised surfaces 3305 are designed to extend from the ends 3315 of the outer rotor 3310 projections towards the central axis of the outer rotor 3310 so as to comprise a shaping edge while simultaneously providing uninterrupted sealing chambers between the inner rotor and outer rotor. Whereas circumferentially thicker raised surfaces such as 3305 shown in FIG. 33 provide a longer sealing passage in the largely tangential direction between chambers which provides improved sealing versus thinner raised surfaces, these thicker raised surfaces 3305 also indent or displace the shaped surface to which they are in contact as the raised surfaces pass over and press against the shaped surfaces. Softer materials being shaped may be more susceptible to heating excessively during shaping due to large sliding surface area and may require thinner raised surfaces, depending on the operating conditions and the amount of shaped surface material to be removed. The thickness of shaping feature 3405, shown as the distance between arrow 3415 and 3420 is approximately 10 thousandths of an inch, shown in a non-limiting embodiment shown in FIG. 34. Circumferentially wider and thinner shaping features have both been shown to be effective and the ideal width for a specific device may be determined through experimentation.

Figure 35:
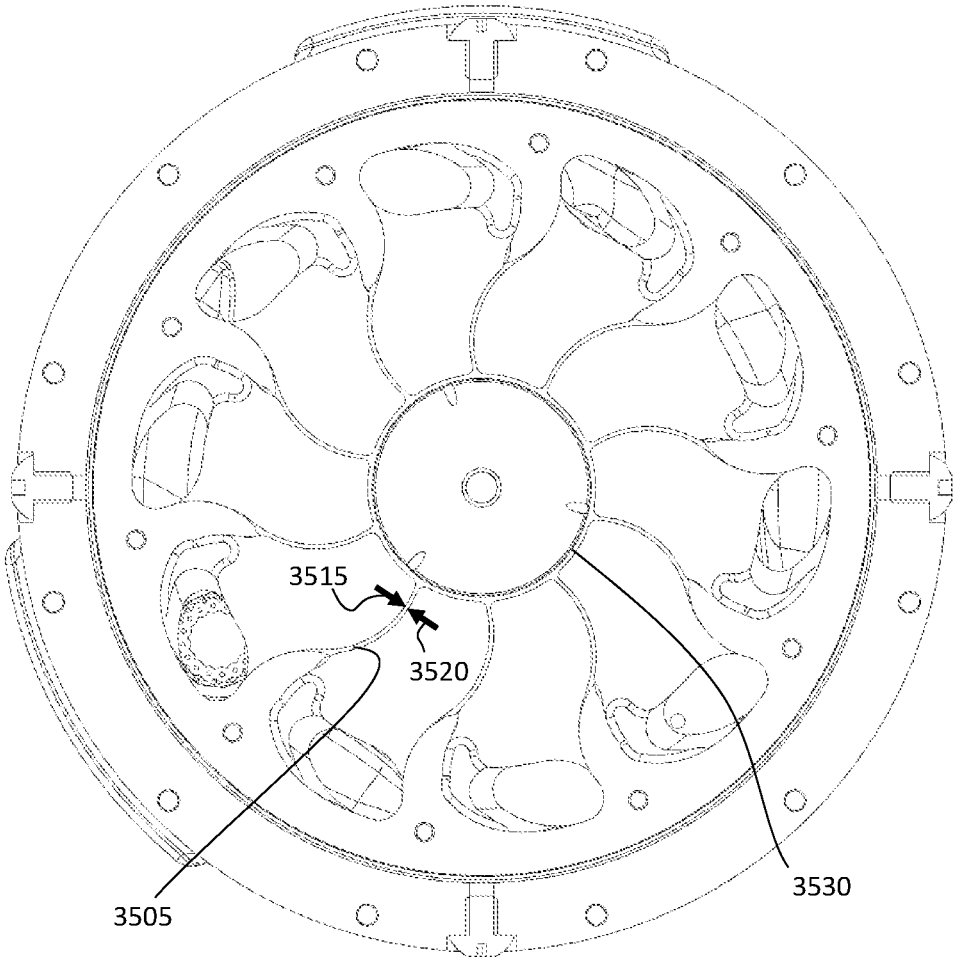
FIG. 35 is a top view of an outer rotor of an exemplary machine which has an inner rotor having nine outward-facing projections and the outer rotor having ten inward-facing projections, showing axial shaping features.

In the non-limiting embodiment shown in FIG. 35, the thickness of shaping feature 3505, shown as the distance between arrow 3515 and 3520 is approximately 35 thousandths of an inch which the inventor believes is sufficient to provide an adequate balance between sealing and shaping for certain applications when the raised shaping surfaces are made from steel and the shaped surfaces of the inner rotor are PTFE. In the non-limiting embodiment shown in FIG. 35 the raised surfaces radiate largely in the radial direction from the ends of the outer rotor fins to a radius more toward the center of the inner rotor axis. These radially extending raised surfaces 3505 are connected to each other via a circular portion 3530 of the raised surface.

Each of these shaping features serve to remove material from the corresponding machinable/abradable/otherwise shapable surface of another part in such a way as to bring the shaping part and the shaped part into near-contact when the shaping process has ended. In the case of paired abradable coatings, the coatings serve to abrade on both parts to bring them into near-contact when the abrading process is ended. In this way, the gap between the two and, accordingly, the leakage of the working fluid, from the high pressure side of the device to the low pressure side of the device, between the two parts is limited and the efficiency of the device is improved. As an added benefit, the small gap ensures there is little or no rubbing, dragging, or other contact of a significant magnitude between the two parts, reducing the required torque to spin the device, and improving the efficiency of the device.

All embodiments described above using shaping between axially-facing surfaces may also be implemented without such shaping, for example by using high precision machining to form the surfaces into the desired shape in initial construction. This may be desired particularly for embodiments which are intended to withstand higher pressure, such as a high-pressure pump. Where high pressure is expected, higher strength may be needed, making shapeable materials, which tend to be less strong, less desirable.

Run-In-Method

Figure 55:
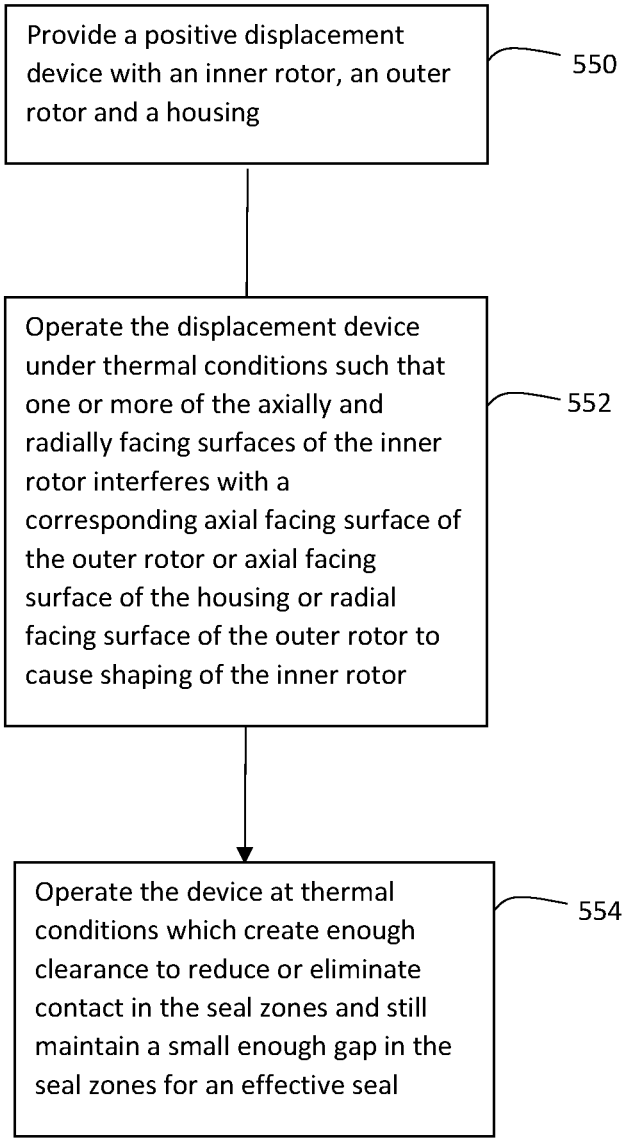
FIG. 55 is a flow chart showing an exemplary method of running-in a displacement device.

FIG. 55 illustrates an exemplary run-in method. In step 550, a displacement device including an inner rotor, an outer rotor and a housing is provided. The inner rotor may have radially outward-facing projections, the inner rotor being fixed for rotation relative to the housing about a first axis, and the outer rotor may have radially inward-facing projections configured to mesh with the radially outward-facing projections of the inner rotor, the outer rotor being fixed for rotation relative to the housing about a second axis parallel to, and offset from, the first axis, and the inner rotor having a first axial facing surface and a second axial facing surface. In step 552, the displacement device is operated under conditions that one or both of the axial facing surfaces of the inner rotor interferes with a corresponding axial facing surface of the outer rotor or the housing to cause shaping of the inner rotor.

In step 554, the displacement device can then be operated without interference between any of the sealing surfaces. The inner rotor may be constructed to cause interference when the displacement device is operated as constructed, and the subsequent operation without interference may be due to the shaping of the inner rotor when the displacement device is operated as constructed. Alternatively, the conditions causing interference may be conditions in which the inner rotor has a first temperature, and the inner rotor has a second temperature different from the first temperature during the subsequent operation without interference. The temperature change could be an increase or a decrease in temperature, depending on changes of temperature of other components and on the coefficients of expansion of different components.

An exemplary run-in procedure may include spinning the device up to the desired operating speed and then introducing heat (including, depending on the embodiment, allowing the device to heat up on its own) to bring the device temperature up to the temperature range expected in operation. By choosing an inner rotor shapeable (e.g. machinable/abradable) surface material (as a non-limiting example, PTFE, if used as a coating or overmold around a metal core, for example) with an adequate thickness, it is possible to use the centrifugal force and/or the thermal expansion of this layer to grow the shapeable surface radially and axially outward to where it contacts the shaping edges or to when the abradable surfaces contact to create a tight clearance seal. With a thick enough PTFE surface with adequate thermal expansion at the working temperature, it is also possible to construct the inner rotor with low precision manufacturing methods, such as injection molding, and to create the parts with enough clearance for ease of assembly. After assembly, the device is spun up to preferably slightly higher than the intended operating speed, and then the device is heated up (for example, by heating up the operating fluid entering the device) to preferably slightly higher than the intended operating temperature (to ensure that slightly more than the necessary material is removed during run-in, or slightly more than the necessary shaping of the material occurs) so that a small seal gap is achieved with no further shaping or contact of the sealing surfaces during operation at its intended range of speeds and temperatures.

Ice Clearing

Figure 36:
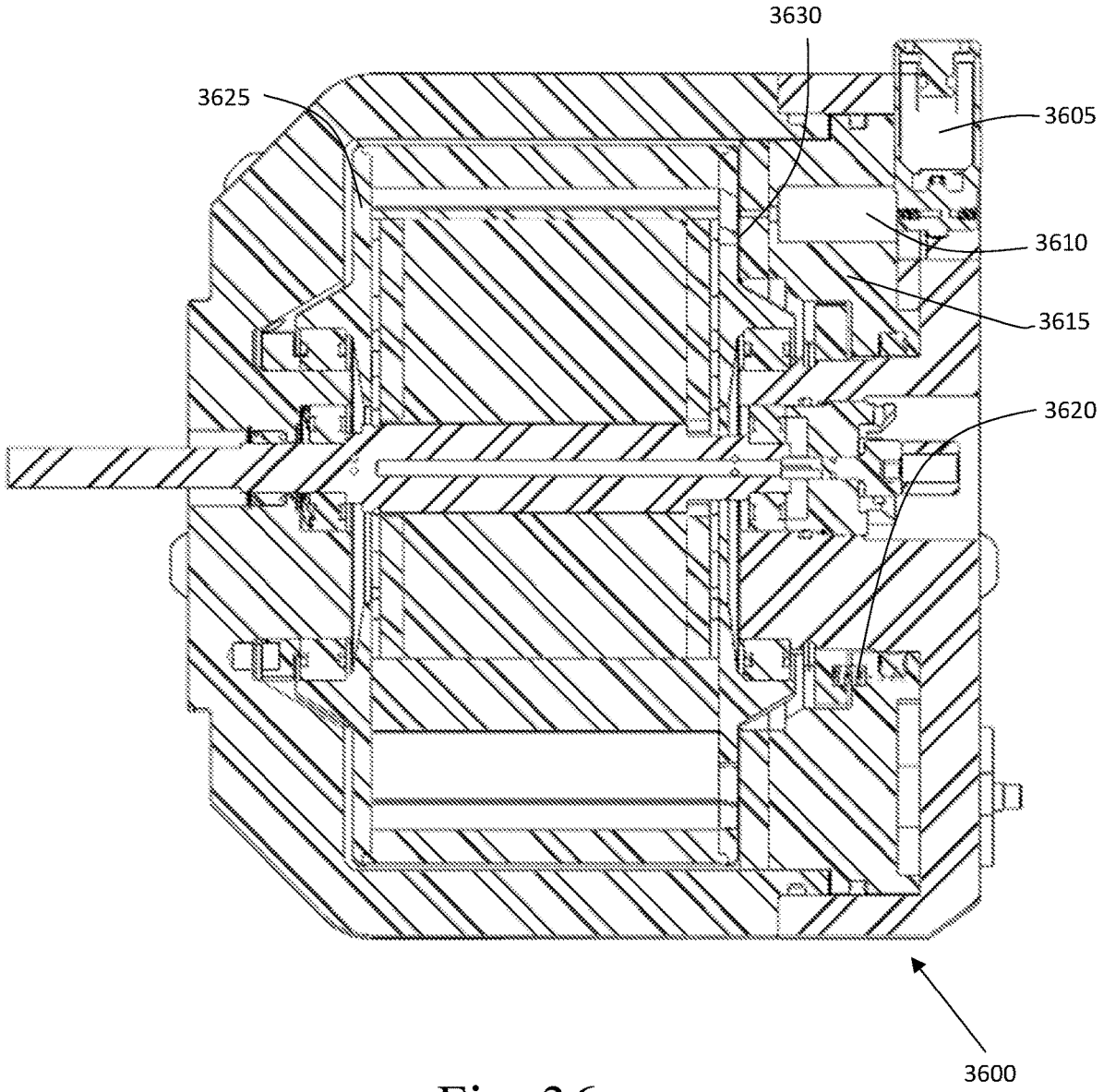
FIG. 36 is a section view of an exemplary machine which has an inner rotor having nine outward-facing projections and the outer rotor having ten inward-facing projections, showing ice-clearing components.

When a device such as the exemplary embodiment 3600 shown in FIG. 36 is used in a humid gas application, such as but not limited to a hydrogen recirculation blower for a fuel cell, the compressed hydrogen-mix is likely to contain water vapor which may condense and freeze in low temperature atmospheric conditions when the fuel cell is shut down. If a hydrogen recirculation blower containing water is subjected to freezing temperatures while it is inactive, and if not adequately designed to deal with this ice formation, as described below, there is a risk of components freezing together, rending the machine inoperable until the ice melts.

Machine 3600 may include a purge valve 3605 (described below) that depressurizes a chamber 3610. The purge valve 3605 may be configured to depressurize the chamber by opening a path from the chamber 3610 to the inlet side of the machine 3600 when machine 3600 is inactive, whereby the port plate 3615, biased by springs 3620 away from the outer rotor 3625, is stored with a relatively large gap between the corresponding axial surfaces of the outer rotor 3625 and port plate 3615 to prevent ice from forming between said surfaces. However, such a purge valve is likely not necessary because once the device is no longer operating, the near-contact seal between the port plate 3615 and the outer rotor 3625 will leak at a high enough rate to allow all pressure chambers to equalize and to allow the port plate 3615 to pull away from the outer rotor axial face 3630 as a result of spring 3620 force.

Even if ice were to form between sealing surfaces, the shaping features located on the inward-facing axial surfaces of the outer rotor and on the outward-facing axial end of the outer rotor may quickly cut or abrade away ice from the sealing surfaces.

Another approach to the ability to sub-zero temperature starting is to use the device at an attitude with the discharge port at the bottom of the device and with the device tilted from horizontal such as, but not limited to, between 1 deg and 45 degrees, such that any condensed water droplets that fall or run to the bottom of the outer rotor when the device is not spinning, will tend to flow downward to the discharge port. With an angle within this range, condensed water will tend to fall to the bottommost part of of each chamber and to the bottommost part of the outer rotor.

Figure 54:
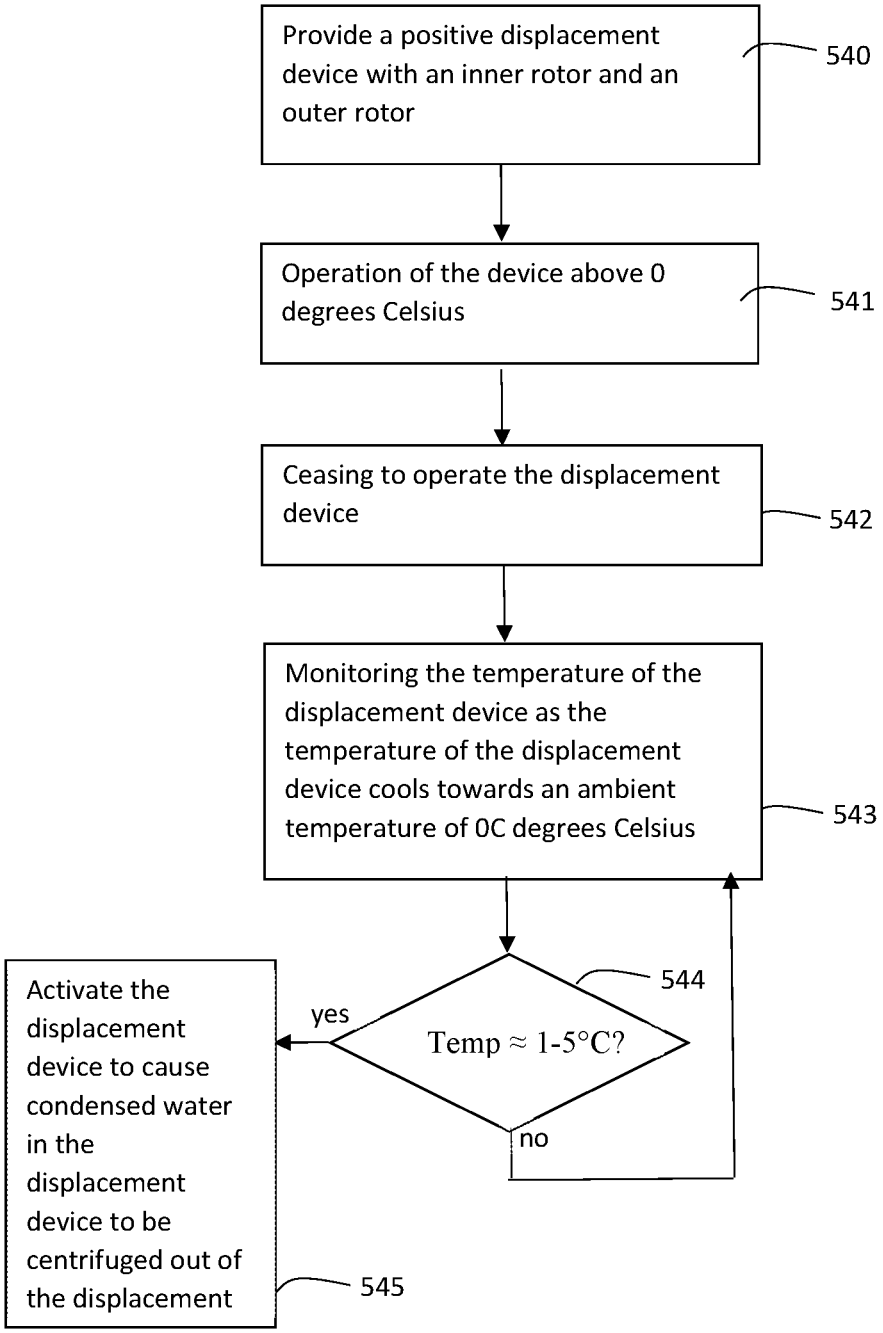
FIG. 54 is a flow chart showing an exemplary method of preventing ice formation in a displacement device.

Another approach to cold start ability that can be used on its own or in combination with the above, is illustrated in FIG. 54. In step 540, a positive displacement device with an inner rotor and an outer rotor is provided. In step 541, the device is operated at a temperature of the device during operation (for example, a temperature of a surface of the outer rotor which is facing fluid flow) being greater than 0 degrees Celsius. In step 542, the operation of the device is ceased. In step 543, the temperature of the device is monitored for example by using an internal temperature sensor that alerts a CPU to when the temperature inside the device reaches a temperature threshold. The temperature threshold may be, for example, slightly above 0 deg Celsius. In the non-limiting embodiment in FIG. 54, the threshold is set to between 1 and 5 deg Celsius. In decision step 544, if the temperature threshold is reached, the method proceeds to step 545, otherwise continuing to monitor. In step 545, the device would be instructed by a CPU to spin at a high enough speed to centrifuge any condensed water droplets to the outermost inward facing surfaces of the outer rotor chambers where some or all of this water can be pushed out of the discharge port. Any water droplets that remain in the rotor chambers after this short spin cycle will tend to fall to the bottom of the outer rotor into the outermost volume of the chambers. The outer rotor may be shaped to form a clearance between roots of the inward-facing projections of the outer rotor fins and the tips of the outward-facing projections of the inner rotor, the clearance may be selected to accommodate ice buildup during shut down and start up. The outermost portion of the chambers of this device can thus be constructed to have an adequate recirculation volume which will maintain a clearance with the inner rotor at TDC and the rest of a complete rotation. As a result, any water that freezes at the outermost volume of any chambers will not interfere with the meshing of the rotors during start-up. As the device warms up to operating temperature, the ice will melt and be discharged from the discharge ports.

Figure 53:
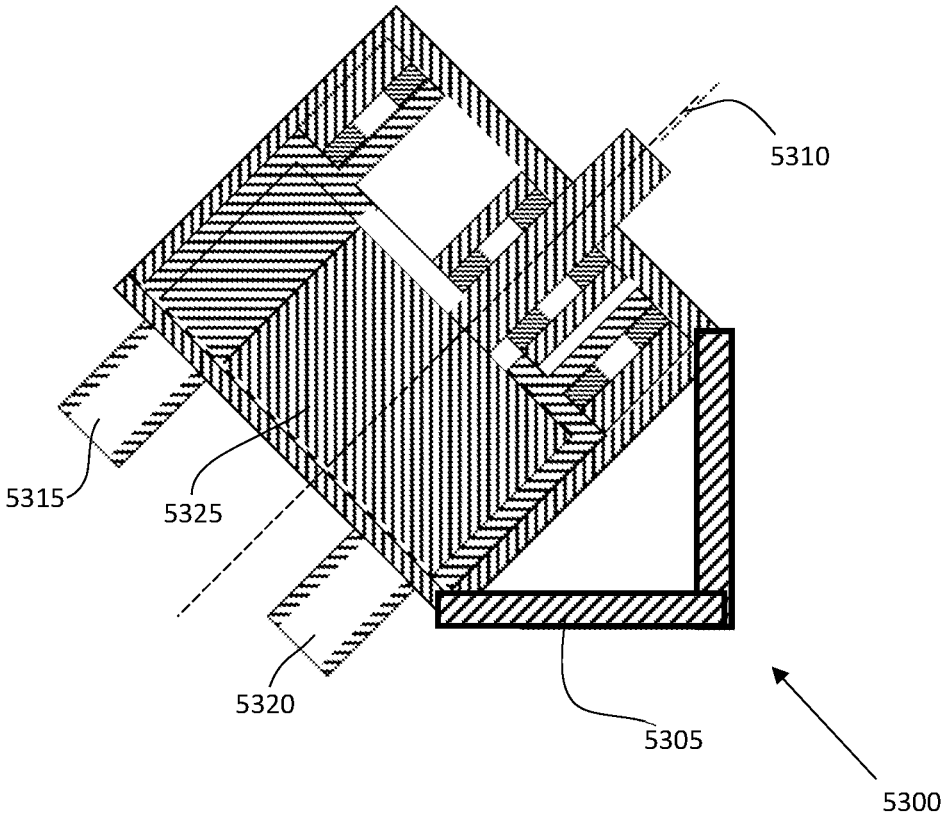
FIG. 53 is a side sectional view of an exemplary machine similar to that of FIG. 52, but with the axis of the inner and outer rotor tilted about 45 degrees from vertical to assist purging of fluid such as water from the chambers.

For the purpose of providing that the device can start at temperatures below freezing, it is preferable that the device is mounted so the discharge port is located at the bottom of the device. It is also preferable that the lowermost surfaces of the discharge port are angled downward and generally away from the outer rotor so water that enters the discharge port flows, as a result of gravity, away from the outer rotor. This can be done by angling the whole device, or by providing a taper on the outermost inward facing surfaces of the outer rotor chambers. As shown in the non-limiting example in FIG. 53, the device 5300 may be angled, for example using mounting features 5305 to mount the displacement device on an external surface or structure, such that the first axis has a nonvertical, non-horizontal orientation in which the discharge port 5320 of the displacement device is located substantially at a lowest part of an active volume of the displacement device. For example, the orientation of the inner rotor 5325 axis, the axis shown by dashed line 5310, may be between 1 degree and 45 degrees from vertical. The angle of the inner rotor axis is shown in FIG. 53 is about 45 degrees from vertical. For reference, the inlet port is labeled 5315.

Figure 37:
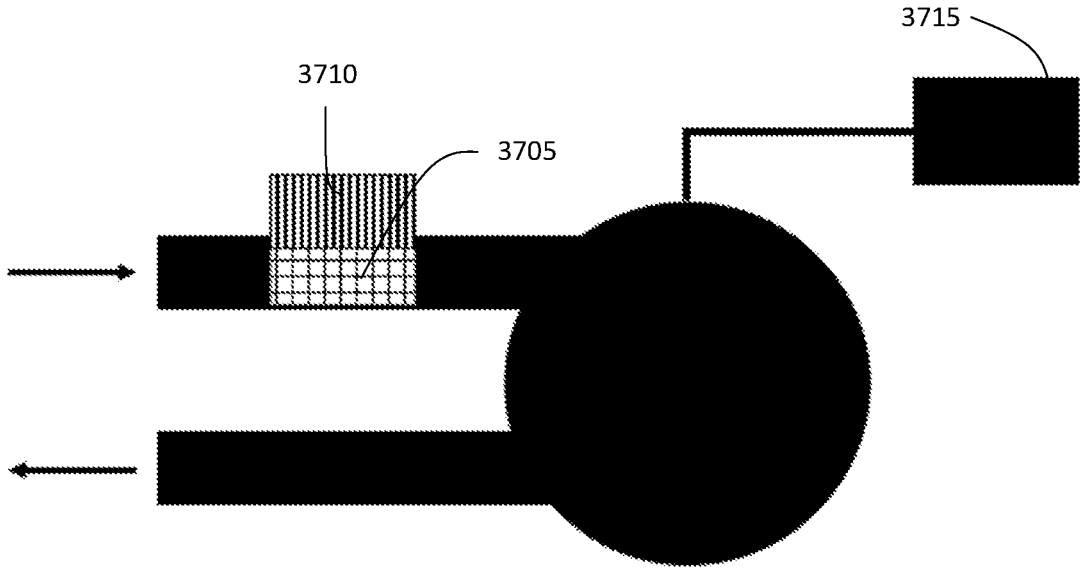
FIG. 37 is a schematic drawing showing a device including a mesh screen for reducing ice build-up in cold operating conditions.

It is possible to spin the device for a short time during cool-down just before components in the device reach 0 deg Celsius, so that condensed water is centrifuged to the outermost volume of the outer rotor chambers and then flows out the discharge port. By using a combination of centrifugal force and gravity to dispel water droplets from the outer rotor into the discharge port, it is believed, by the inventor, to allow this to be done at a slow enough rotational speed that condensed water droplets can be removed from the device without creating high enough flow rates to draw more water droplets in from elsewhere in the system. For example, if the rated operating speed of the device is several thousand rpm, it may be possible to discharge much of the condensed water during the device water-removal cycle of less than a minute at only several hundred rpm. To further enhance this effect, a high thermal conductivity mesh or screen 3705 made of a high thermal conductivity material such as aluminum, can be placed upstream of the device 3700 and connected to a frame/housing that is exposed to atmospheric temperature and will therefore act as a heat sink 3710 to cool the mesh/screen as shown in FIG. 37. In sub-zero external temperatures, this screen would reach below zero degrees Celsius, as a result of the heat sink, before the inner or outer rotor, for example fluid-facing surfaces of the outer rotor. The inner and outer rotor may have a larger thermal mass than the screen and are not directly exposed to the environment and should cool more slowly than the screen. When the inner or outer rotor are cooling during shut-down in sub-freezing environmental conditions, the screen will already be below freezing when the outer rotor, for example, is just above freezing. When an operator or CPU 3715 instructs the rotors to spin at low speed, at this point, water that has condensed on the rotors will be discharged from the surfaces of the rotors, and any humidity in the incoming flow will tend to condense and freeze on the screen 3705 so additional water droplets are less likely to enter the device.

Inner Rotor Construction

Figure 38:
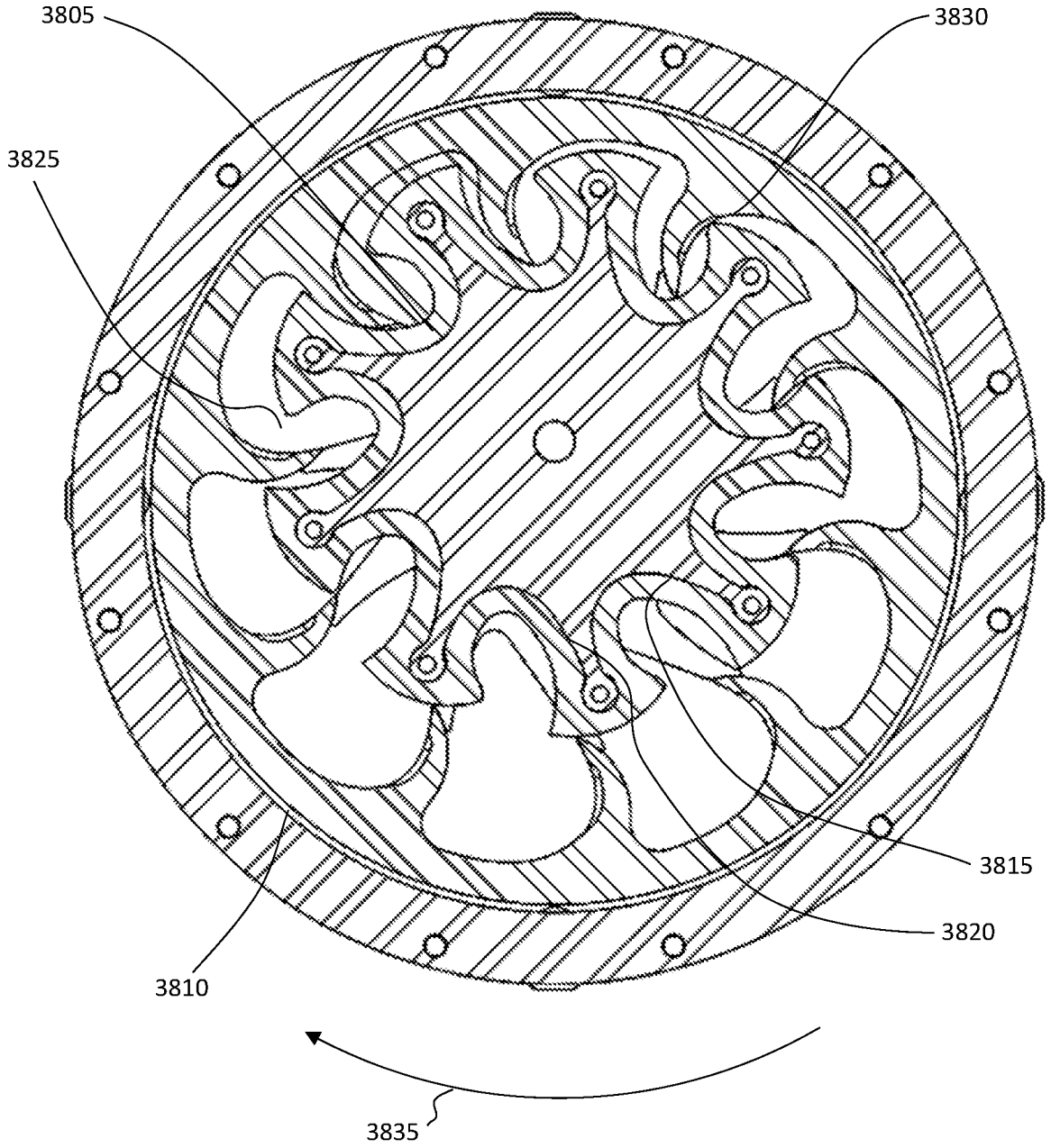
FIG. 38 is a section view of an exemplary machine showing an inner rotor having nine outward-facing projections and an outer rotor having ten inward-facing projections including a cross section view of non-sealing flow paths on the outer rotor.

FIG. 38 illustrates an exemplary embodiment of a device featuring a clamshell construction of shapable material around the inner rotor. In this embodiment the inner rotor 3805 is constructed by securing, such as with bolts or adhesive, a plastic material 3815 over an inner portion 3820 of the inner rotor 3805, the inner portion 3820 being preferably constructed from a material with higher stiffness and/or higher strength and preferably lower cost than the material of the outer portion 3820.

FIG. 17 illustrates an exemplary embodiment of an overmolded construction. In this embodiment the inner rotor 1715 is constructed by overmolding a plastic material 1765 over an inner portion 1770 of the inner rotor 1715, the inner portion 1770 being constructed from a material with higher stiffness and/or higher strength and preferably lower cost than the ovemolding material.

Returning to FIG. 38, the outer rotor shaping edges 3825 located at the ends of inward-facing fins on the outer rotor 3810 are designed to shape the preferably softer inner rotor outer material 3830 as the shaping edges 3825 trace a hypotrochoid path on the profile of the inner rotor 3805 as previously described in this disclosure. The direction of rotation of the inner rotor 3805 and outer rotor 3810 in operation is shown by arrow 3835.

Port Plate Construction and Adjustment Mechanism

Materials may be selected to avoid unwanted thermal expansion and wear affects. In a non-limiting example, shown in FIG. 25, a port plate 2535 is shown constructed as a single piece. It may be advantageous for port plate 2535 to be constructed from a relatively soft material, and/or easily shapable material such as PTFE or PEEK, since softer materials will be more easily removed or shaped by the shaping features 2530 on an outer rotor 2510 which were taught by the author above. However, it may be expensive to construct such a port plate with a single piece of plastic, owing to the high material cost. Further, such materials may have a disadvantage in that their coefficients of thermal expansion exceed those of many metals, including aluminum. Consequently, the gap between the sealing surfaces of the port plate and outer rotor may change depending on the temperature of the port plate and housing due to the different coefficients of thermal expansion. Therefore, when a housing 2540 is constructed from a material which has a different coefficient of thermal expansion as compared to the coefficient of thermal expansion of the material of the port plate, there may be a further disadvantage to a single piece construction of a port plate. Such a disadvantage arises under hot conditions, when the port plate 2535 expands more, or less, in the axial direction than does the housing 2540, leading to contact with the shaping features 2530 of an outer rotor 2510 or a large gap between the sealing surfaces of the two. A small amount of shaping of the port plate seal by the outer rotor is desirable for a near-zero gap seal. This small amount can be controlled by mechanical stops that set the amount of axial motion of an axially movable and mechanically energized port plate and/or by the thermal expansion of the port plate or port plate shapable surface. Too much material removal, as a result of too much thermal expansion, for example, is undesirable because it will lengthen the amount of time needed for run-in. One way to ensure minimal self-shaping is to limit the amount of thermal expansion of the port plate surface by using a thin section of machinable/abradable/otherwise shapable material, such as but not limited to PTFE, on the seal face of the port plate and a more rigid port plate body, made from a material such as, but not limited to, aluminum. In a non-limiting example shown in FIGS. 39, 40, 41, and 42, a port plate 3905 is constructed of a shapable piece 3910 (shown in FIG. 39) and supporting piece 3915. Shapable piece 3910 may be a softer material such as but not limited to PEEK or PTFE for example. This material may be chosen for its machinability. For reference, FIGS. 40 and 41 show the same non-limiting embodiment in which the port plate 3905 position is actuated via pressurized fluid. FIG. 42 shows a different non-limiting embodiment wherein the port plate 4200 position is adjusted via screws.

The support piece 3915 may be constructed of a material such as but not limited to aluminum, whose rigidity may exceed that of the wear piece 3910 material, thus providing resistance against deformation of the port plate 3905. Additionally, the material of the support piece 3915 may be chosen to have a coefficient of thermal expansion which is nearer to that of the material of the housing 3920. As an added benefit, the material of the support piece 3915 may have a greater thermal conductivity than the material of the wear piece 3910, allowing heat to be more rapidly transferred from the port plate 3905 via conduction with contacting components of the device, such as a housing 3920.

Figure 39:
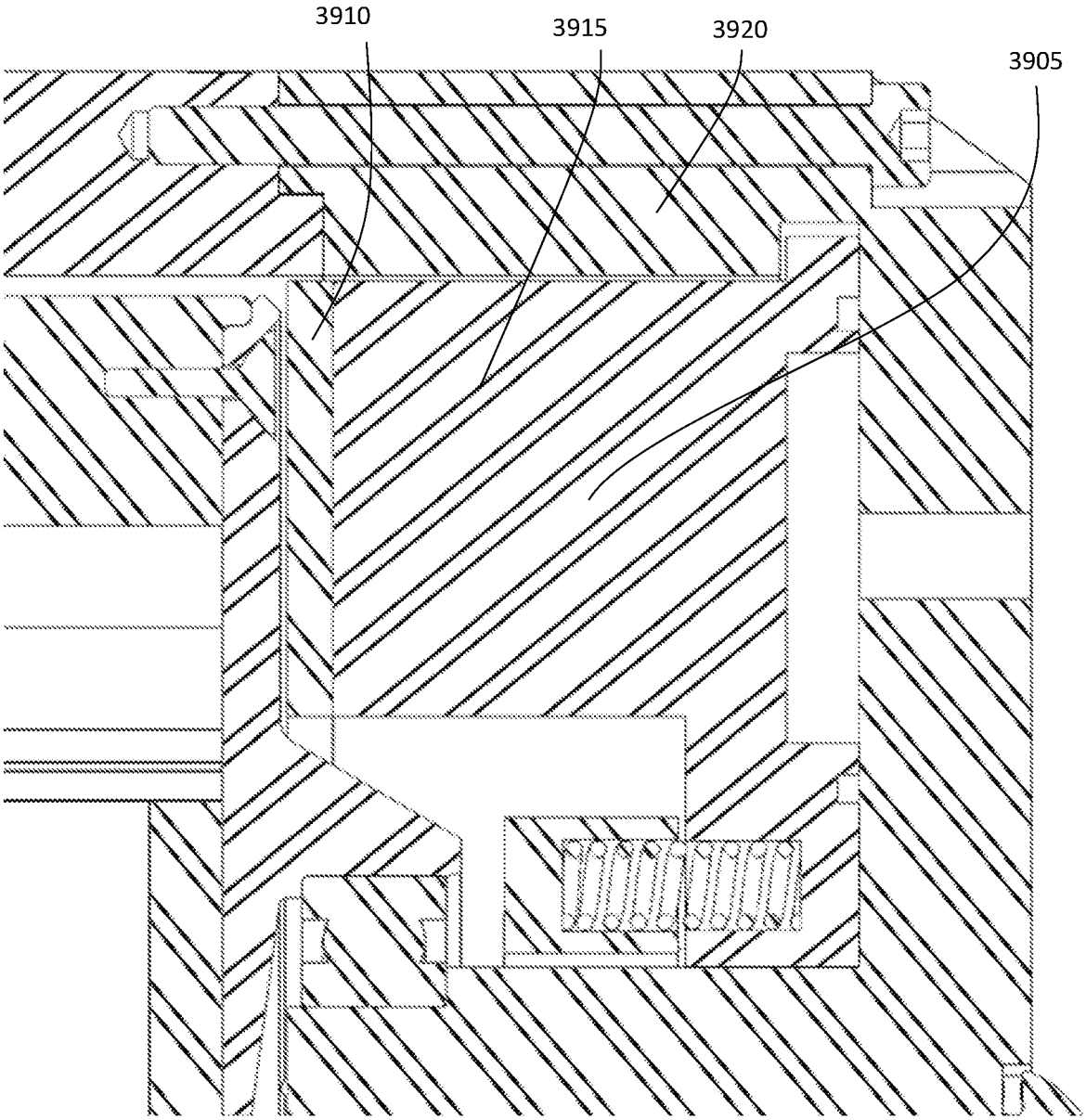
FIG. 39 is a closeup side section view of an exemplary machine showing a port plate also shown in FIG. 44 which translates when pressurized fluid is applied to a corresponding port.
Figure 40:
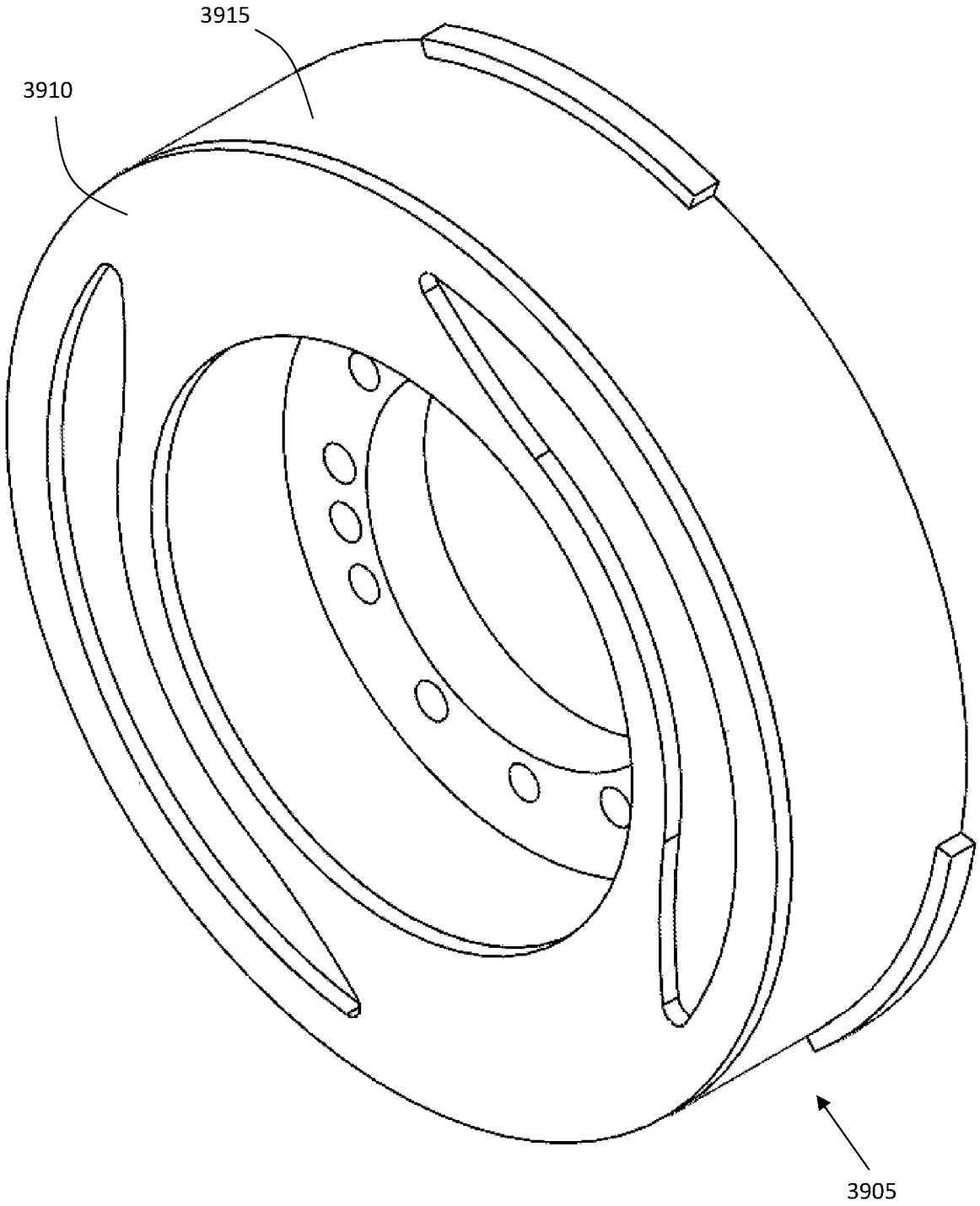
FIG. 40 is a first isometric view of a port plate which has a multi-part construction.
Figure 41:
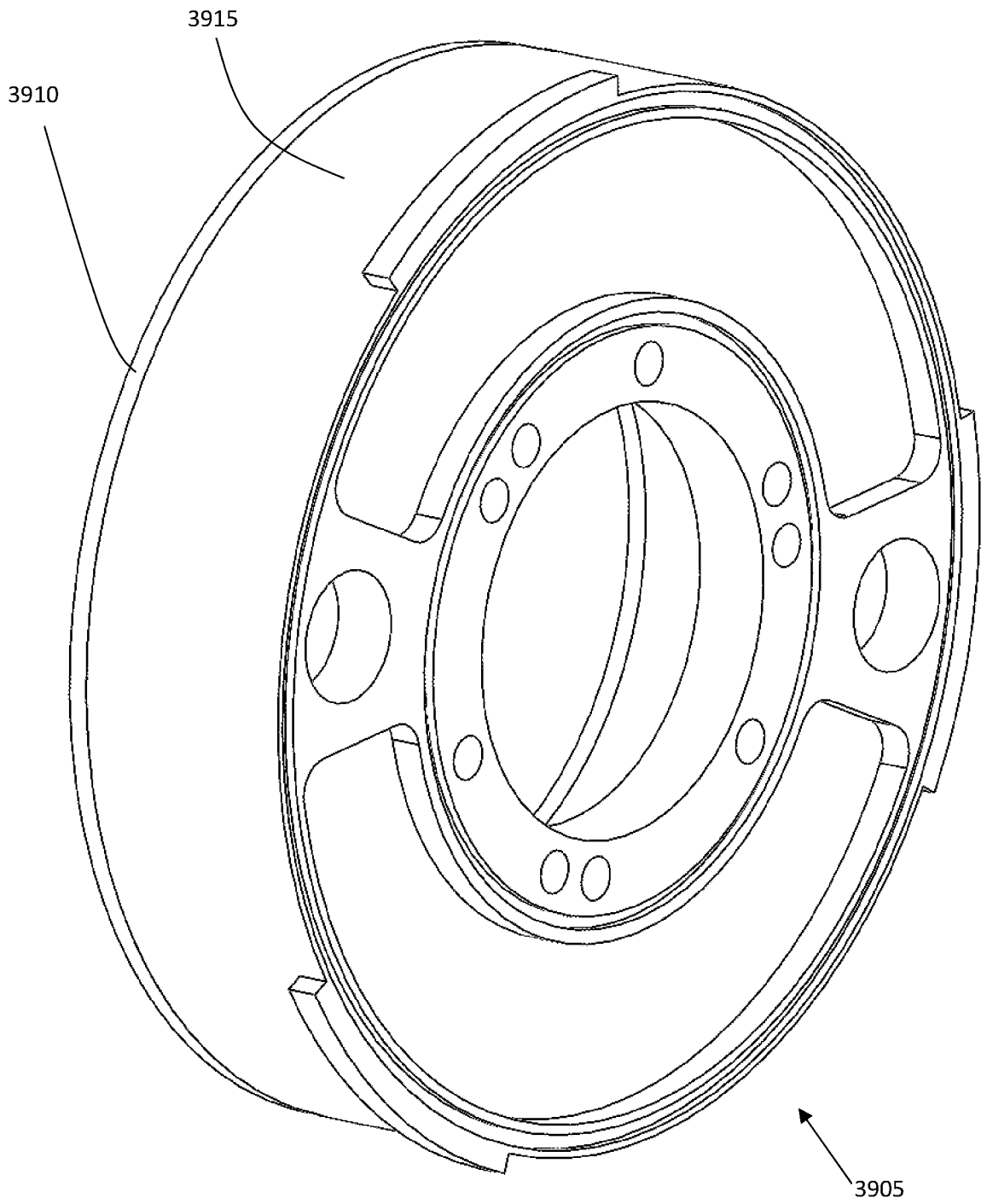
FIG. 41 is a second isometric view of the port plate of FIG. 40.
Figure 42:
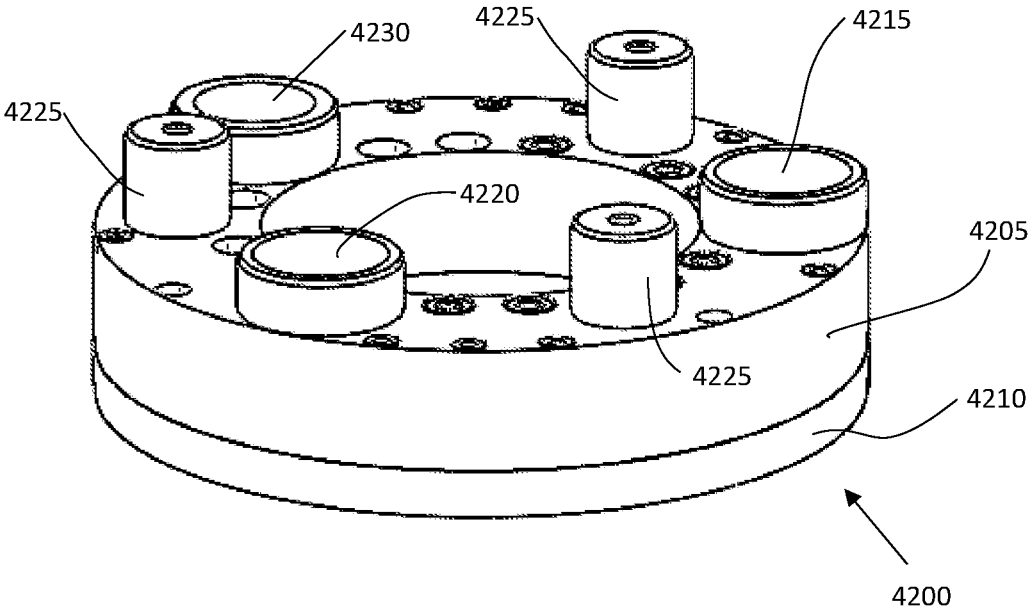
FIG. 42 is an isometric view of an alternate port plate which has a multi-part construction.

FIGS. 40 and 41 provide alternate views of the embodiment shown in FIG. 39. For clarity, the same reference numerals used in FIG. 39 are provided in FIGS. 40 and 41 where applicable.

As shown in the non-limiting embodiment in FIG. 42, a port plate 4200 is comprises two parts, supporting portion 4205 and sealing portion 4210. Supporting portion 4205 and sealing portion 4210 are shown bolted together, but other methods of fastening, including but not limited to the use of adhesives, rivets, and thermal fitting are also contemplated by the inventor. In FIG. 42 inlet port 4215 and outlet port 4220 provide passages through the port plate 4200 and platforms 4225 interfaces with axial screws which adjust the axial position of the port plate 4200. The axial screw mechanism is explained below. Port 4230 is an optional port for a sensor in this non-limiting exemplary embodiment, which can be used for diagnostics.

Figure 43:
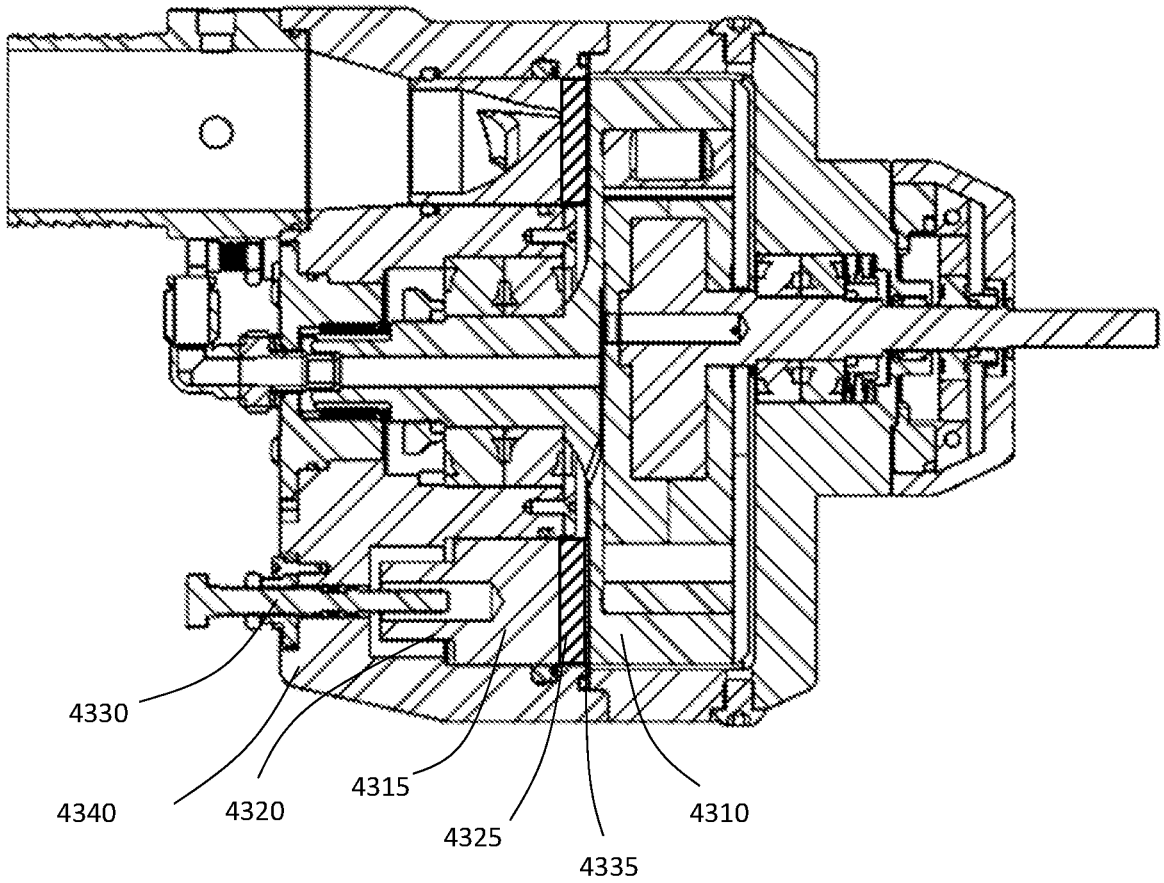
FIG. 43 is a section view of an exemplary machine showing a port plate which moves axially via the adjustment of screws.

In a non-limiting embodiment shown in FIG. 43, the port plate 4315 may have a two-piece construction in which a backing plate 4320 is made from metal such as aluminum and a backing plate is covered by a sealing surface plate 4325 made from a plastic material such as but not limited to PEEK or PTFE. A means such as but not limited to axial screws 4330 may be used to move the port plate 4315 in the axial direction, causing the port plate 4315 to press against the axial end of the outer rotor 4310, the outer rotor 4310 having shaping features which may be, for example, similar to shaping features 3105 shown in FIG. 31 or shaping features 2530 shown in FIG. 25, located on the a surface 4335 which faces the port plate 4315. These features machine, abrade, grind, shape, or otherwise mechanically remove material from the port plate to form a lightly contacting or small gap between the outer rotor and the port plate.

As shown in FIG. 43 a port plate 4315 comprises a backing plate 4320 and sealing surface plate 4325. The sealing surface plate 4325 is shaped by the shaping features located on the outer axial surface 4335 of the outer rotor 4310. In a non-limiting embodiment, the backing plate 4320 is made from a material with a similar coefficient of thermal expansion as the housing 4340. Thus, as the temperature of the housing changes, the distance between the sealing face of the sealing surface plate 4325 and the corresponding shaping features located on the axial outward-facing surface 4335 of the outer rotor 4310 remains largely the same.

In a non-limiting exemplary embodiment the backing plate 4320 and housing 4340 are made of aluminum and the shapable member 4325 is made from PTFE.

Figure 44:
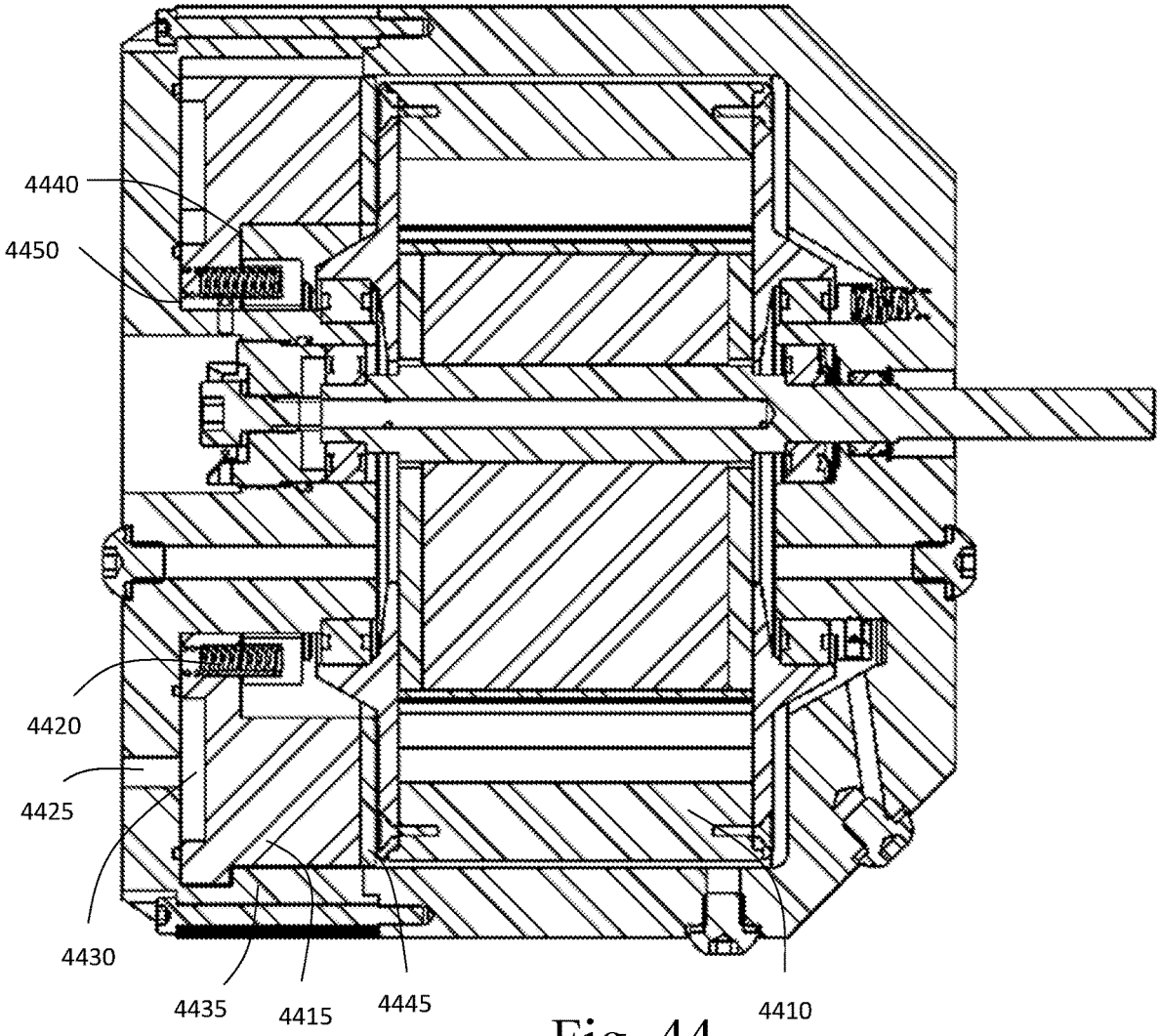
FIG. 44 is a section view of an exemplary machine including a port plate which translates when a corresponding port supplies pressurized fluid.

In the non-limiting exemplary embodiment shown in FIG. 44, the port plate 4415 can move axially and is biased via springs 4420 to move in the axial direction away from the outer rotor 4410. Pressurized fluid within channel 4425 flows into a chamber 4430 between the port plate 4415 and the housing 4435, causing the port plate 4415 to act as a piston and move in the axial direction towards the outer rotor 4410. In a non-limiting exemplary embodiment, the pressurized fluid supplied to chamber 4430 is supplied by an external source such as an external air compressor or external compressed air reservoir, or by the pressure produced by the output of the device. This allows for control of the axial position and therefore shaping of port plate 4415.

In a non-limiting embodiment the fluid chamber 4430 is in communication with a high-pressure region of the machine such as the discharge port whereby, when the discharge port is at an elevated pressure compared to the inlet port and therefore additional sealing is required, the chamber 4430 is subjected to greater pressure than the average pressure on the opposing side of the port plate 4415, overcoming the force provided by the springs 4420 and moving the port plate towards the outer rotor 4410.

Figure 45:
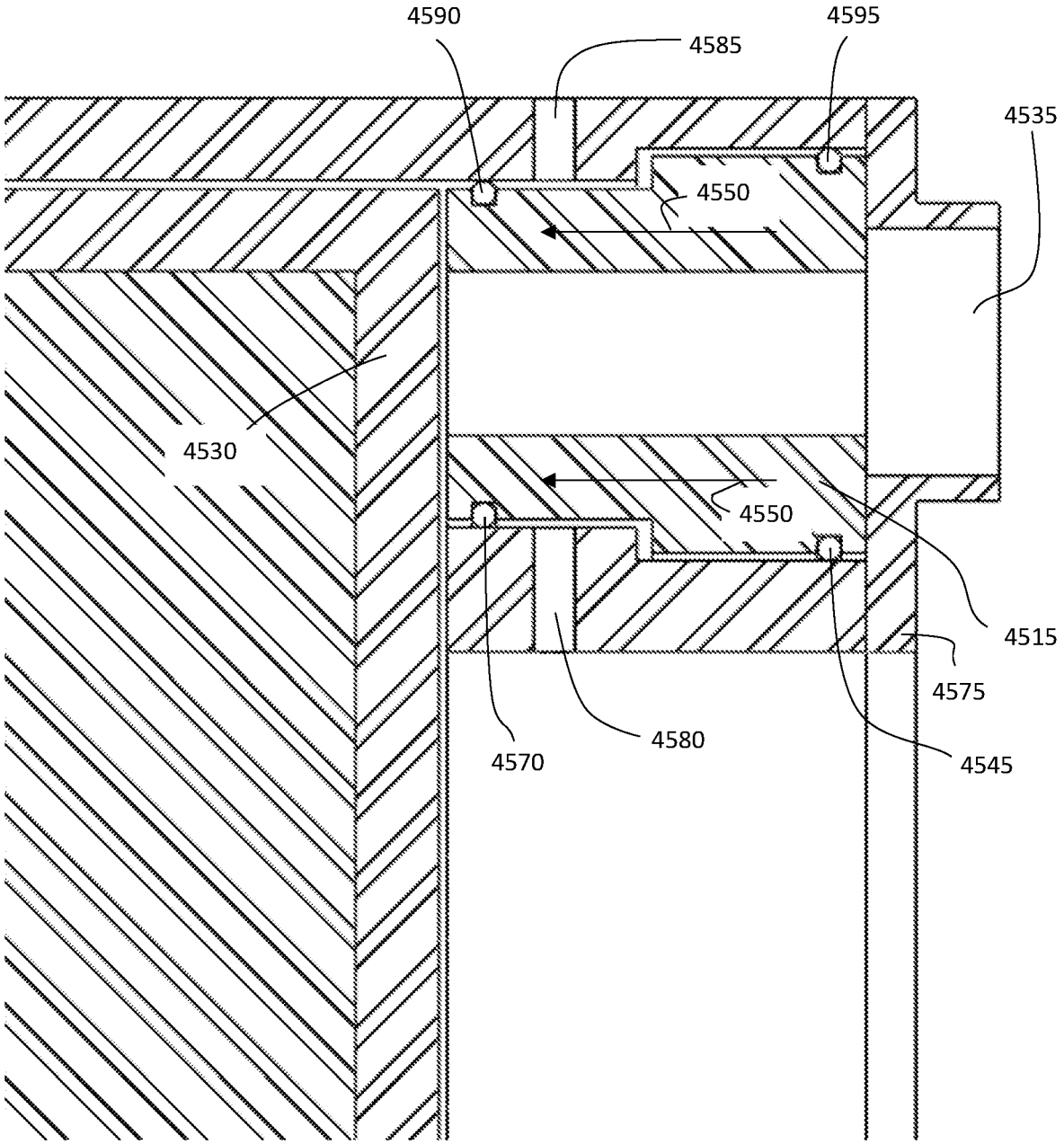
FIG. 45 is a closeup section view of an exemplary machine showing a port plate which is arranged to translate towards an outer rotor.

As shown in FIG. 45, a port plate 4515 is arranged within a housing 4575 with a first pair of seals 4570 and 4590 and second seal pair 4545 and 4595 such that the cross-sectional area exposed to working pressure on the side of the port plate furthest from the outer rotor is larger than the cross-sectional area exposed to working pressure on the side of the port plate 4515 which seals against the outward-facing axial end of the outer rotor 4530. A port 4580 may be used to keep the region between seal 4570 and seal 4545 at a pressure that is lower than the working pressure of the working fluid and port 4585 may be used to keep the region between seal 4590 and seal 4595 at a pressure that is lower than the working pressure of the working fluid.

In FIG. 45, a port 4535 is located whereby it communicates with fluid which passes through ports in the outer rotor and through passages in the port plate 4515. During operation the port plate would experience a net force in the direction indicated by arrows 4550 toward the outer rotor 4530.

In another non-limiting embodiment, springs may be oriented to push the port plate towards the outer rotor and no backing pressure chamber or axial screws are needed.

Returning to FIG. 44, "top-out" features 4440 may be used to prevent the pressurized fluid in chamber 4430, which acts on the port plate 4415, or the springs in the embodiment if springs are used instead of a pressure chamber, from pushing the port plate 4415 farther towards the outer rotor 4410 than a pre-determined axial position, even after the surface of a sealing plate 4445 is cut or abraded or shaped away by the outer rotor's shaping features. This additional movement is prevented by contact between the port plate 4415 and the top-out feature 4440 which may be a feature of the housing 4435 or of another component of the device. Additionally, features 4450 also prevent the springs 4435 from pushing the port plate 4415 away from an outer rotor 4410 past a pre-determined axial position. This additional movement is prevented by contact between the port plate 4415 and the top out feature 4450 which may be a feature of the housing 4435 or of another component of the device.

To prevent or reduce freezing of the port plate 4415 to the outer rotor 4410, which would require excess torque to separate them during start-up, it may be desirable that when the device is not in operation, the port plate 4415 and outer rotor 4410 separate. In the embodiment where chamber 4430 is pressurized with an external pressure supply, disconnecting the external pressure supply when the device is not in operation would accomplish this separation as no pressure force would oppose the springs. In the embodiment where chamber 4430 is pressurized using the discharge pressure of the device, when the device ceased operating chamber 4430 would depressurize and no pressure force would oppose the springs, resulting in separation. In this embodiment, it is desirable to keep this separation small enough that even with this gap, the device seals well enough to build up enough pressure in chamber 4430 to oppose the springs such that port plate 4415 shapes the outer rotor 4410 or reaches its top-out position when the device starts operation. A reasonable separation range is 0.002-0.004" which is believed by the inventor to still allow adequate buildup of pressure, but higher gaps may also work in various configurations (e.g., for larger devices).

FIG. 4 shows the inlet and exhaust side of the machine. In a non-limiting exemplary embodiment the port plate position may be adjusted via three adjustment screws 0415 which screw into the housing and which apply force to the port plate in the axial direction towards an outer rotor to define the position of the port plate. A spring pushing the port plate away from the outer rotor provides an opposing force to ensure the port plate is fully in contact with the three adjustment screws.

Compression Relief Flow Channels

Figure 46:
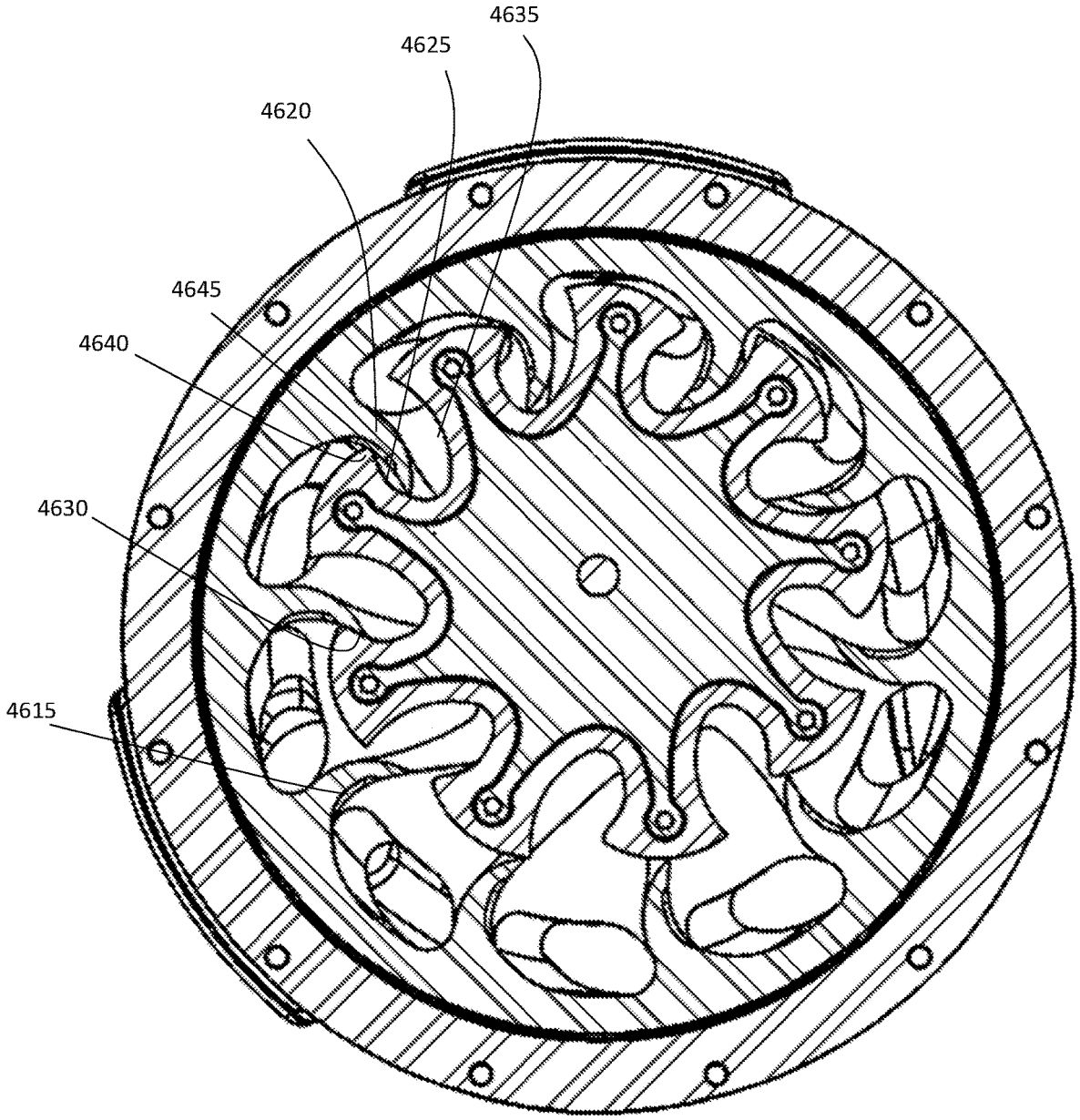
FIG. 46 is a section view of an exemplary machine shown in FIG. 38 shown viewed from a different axial direction.

As the leading or trailing edges of the outer rotor projections contact corresponding surfaces of the inner rotor projections, the curved surfaces of the respective projections may form an additional sealed chamber, referred to here as a secondary chamber, near top dead center. To prevent these secondary chambers from being sealed and thus resulting in wasteful compression or decompression of fluid in that space, flow channels may be arranged to connect these secondary chambers to a port such as the intake port. The flow channels could be located, for example, in an inward facing axial endplate of the outer rotor, in the contacting surface of the inward facing projections of the outer rotor, or in the outward facing projections of the inner rotor. In an example shown in FIG. 46, non-sealing portions 4615 provide flow channels along the driven face of the outer rotor fin 4620 to prevent sealing of a non-useful secondary chamber 4625, formed between where the tip 4630 of an outer rotor projection 4620 contacts the inner rotor surface 4635 and where the tip of an inner rotor lobe 4640 contacts the outer rotor fin surface 4645, thereby avoiding unnecessary compression of fluid in this volume and therefore avoiding or reducing this energy loss.

The non-sealing portions 4615 may also take additional configurations as shown by non sealing portions 2720 in the embodiments shown in FIGS. 27 and 28. In these non-limiting exemplary embodiments, the outer rotor comprises a pocket in the leading surface of the outer rotor projections to provide a flow channel which allows fluid to exit the secondary chamber and avoid undesirable compression as taught above.

For clarity, the same reference numeral is used for the non sealing portions in both FIG. 27 and FIG. 28.

Figure 47:
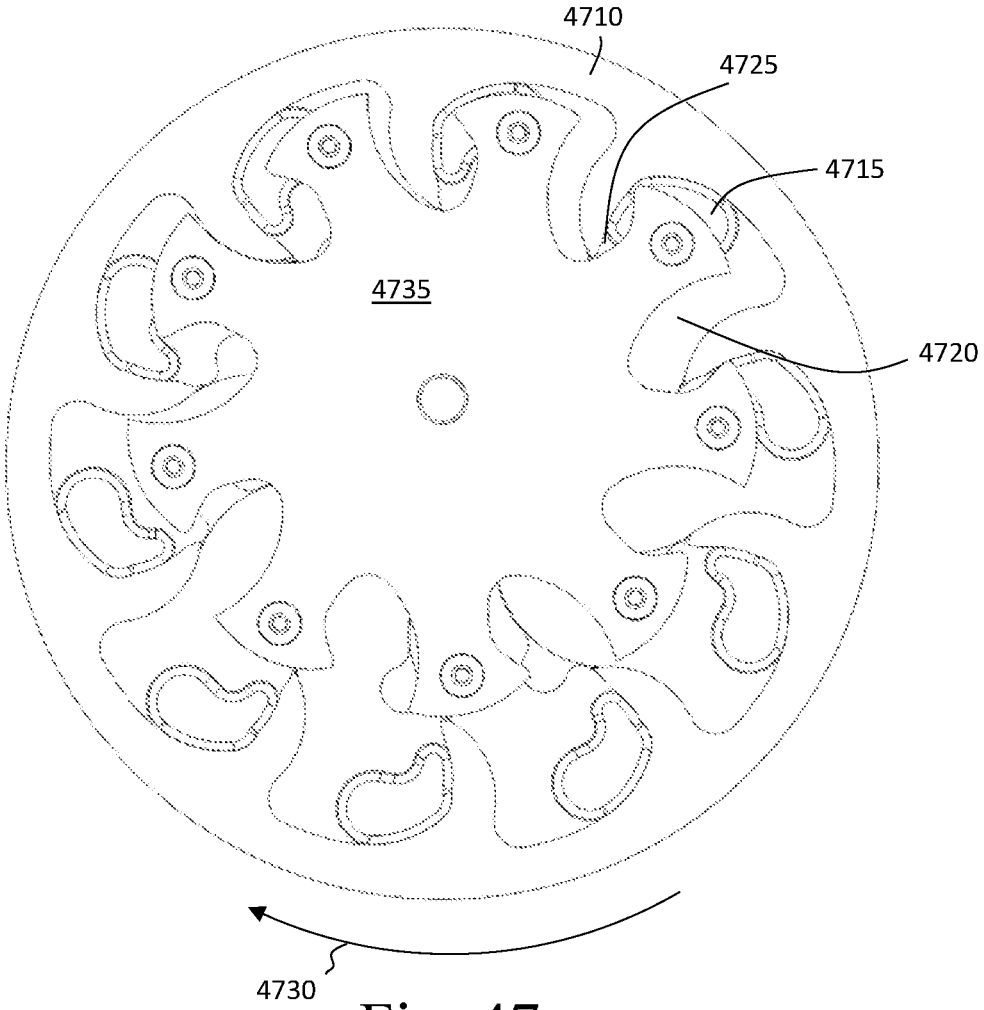
FIG. 47 is a second section view of an exemplary machine shown in FIG. 35 shown from a different axial direction showing axial non-sealing portions which prevent sealing of secondary chambers.

In another non-limiting embodiment shown in FIG. 47 flow channels 4715 are located on the outer rotor 4710 axial-facing sealing surface 4720 which allow flow from secondary chambers 4725 and thereby prevent unnecessary compression in the secondary chambers. In FIG. 47 the direction of rotation of the inner rotor 4735 and outer rotor 4710 is shown by arrow 4730.

Debris Clearing

As described above, in embodiments pairings of axially facing surfaces are configured so that one surface of the pairing shapes the other. Fluid flow channels may be provided to supply fluid to any one or more interfaces comprising these surface pairings for debris removal. In embodiments without shaping of surfaces, fluid flow channels may be provided for other purposes such as cooling. In a non-limiting exemplary embodiment shown in FIG. 48, an inlet port 4820 supplies compressed gas which is routed within the machine 4800 to the internally machined/abraded/shaped surfaces between the port plate 4815 and the outer rotor 4810 so as to clear shaping debris away from sealing surfaces to prevent heat build-up and to prevent particles produced from the shaping process from building up on the shaping or shaped surfaces and impeding sliding contact between said surfaces. The path taken by supplied compressed gas is shown by arrow 4825. Compressed gas from compressor 4830, the compressor shown schematically as a box, travels into inner axis channel 4835 at which point a first portion of compressed gas travels through channels 4895 in the outer rotor 4810, allowing the compressed gas to carry debris generated between the inner rotor 4805 and outer rotor 4810, the debris-carrying compressed air leaving via port 4705 which is shown plugged by plug 4855 in FIG. 48, but which would be unplugged during debris removal.

A second portion of compressed gas travels via an alternate path shown by arrow 6120. The aforementioned second portion of compressed gas travels from channel 4835 in the axis of the outer rotor 4700 to region 4855 which permits flow of compressed gas from channel 4835 located in the inner axis of the shaft of the outer rotor 4700 to a channel 4650 in the axis of the inner rotor 4805. Compressed gas, after traveling through channel 4650 exits the channel via port 4880 to region 4710 which accumulates debris generated by the inner and outer rotor. The debris-carrying compressed gas then travels via gap 4860 between the housing 4885 and the outer rotor 7400 and exits via port 4705 to leave machine 4600 via port 4705 when plug 4855 is removed.

Figure 49:
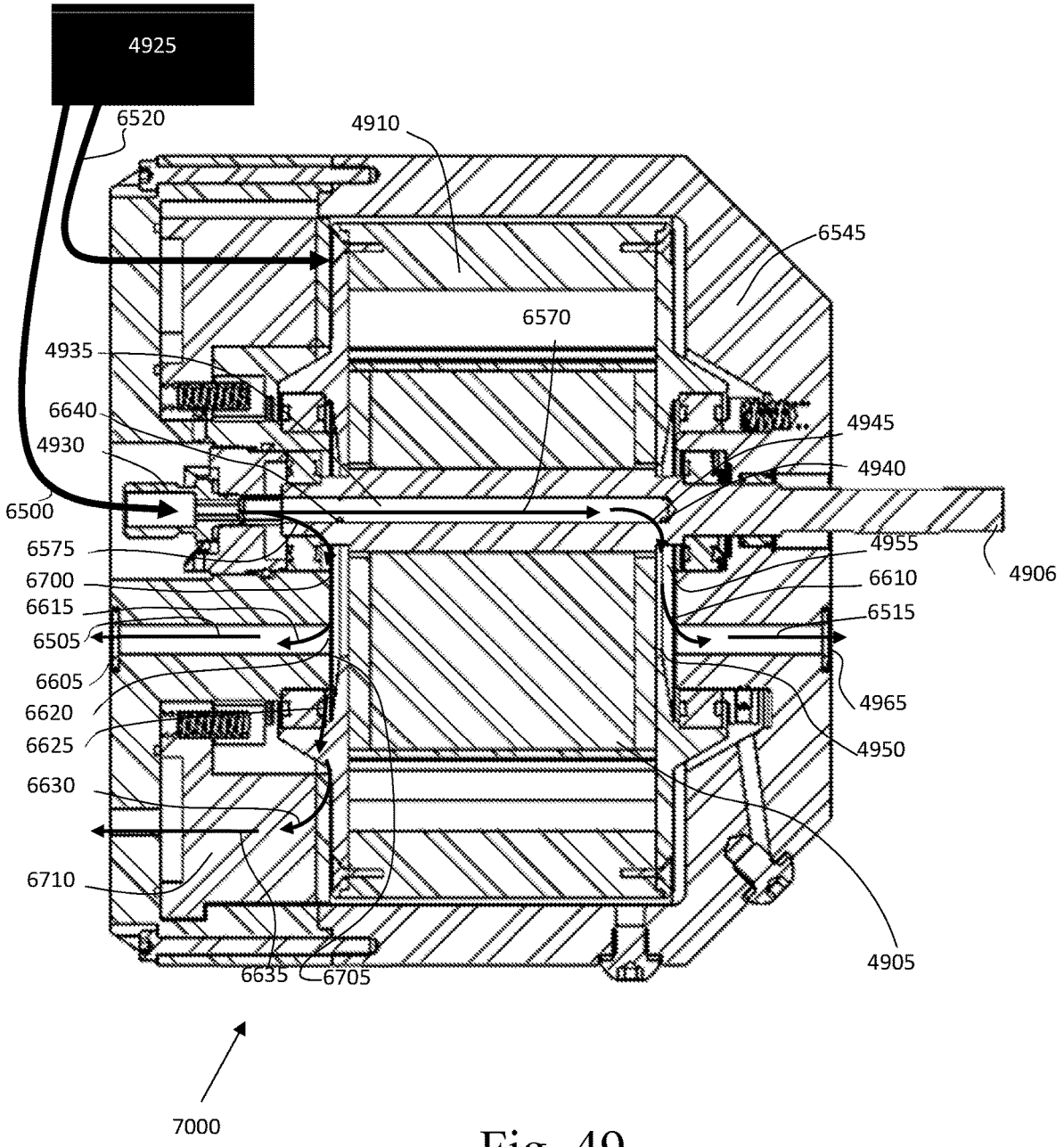
FIG. 49 is a section view of another exemplary machine having passages throughout the machine which carry pressurized air to shaping areas of the machine and which carry swarf out of the machine showing swarf-clearing exhaust ports unplugged.

In the non-limiting embodiment shown in FIG. 49, compressed gas is supplied from an external compressor 4925, e.g. an air compressor, (shown schematically as a box) to gas inlet 4930, the path shown by arrow 6500. Compressed gas then travels from air inlet 4930 to the channel 4935 inside inner rotor shaft 4906 of inner rotor 4905. At this point a first portion of gas exits the channel 4935 via first inner rotor shaft ports 6640, this path shown by arrow 6575 whereas a second portion continues to travel within channel 4935, this path shown by arrow 6570, until it reaches second inner rotor shaft ports 4940 the end of channel 4935.

The aforementioned first portion of gas, after passing through port 6640, further splits into a third portion of gas and a fourth portion of gas. The third portion, shown by arrow 6615, thereby passing region 6700 which picks up debris and exiting via port 6605. The fourth portion, shown by arrow 6620, passes region 6705, which accumulates debris, and continues through channels in the outer rotor 4910, the path shown by arrows 6625 and 6630, before traveling through channels (such as exhaust port 4225 visible in FIG. 42) in the port plate 6710, which lead to the exterior of the device, thereby expelling debris from the machine, this path shown by arrow 6635.

The second portion of compressed gas then travels through said second inner rotor shaft ports 4940, the path shown by arrow 4945. As the compressed gas exits ports 4940 and travels past seal 4950 (between the axial sealing surfaces of the outer rotor 4910 and the axial sealing surfaces of the inner rotor 4905, this portion of the path shown by arrow 6610), which is an area that generates debris, as well as regions 4955 which is also a region which accumulate debris, the bulk compressed gas carries debris out of the machine via port 4965 located on the housing 6545, this portion of the path shown by arrow 6515. Compressed gas may also be supplied from compressor 4925 to the inlet port 5115 (shown in FIG. 51) of machine 7000 whereby the gas travels through the chambers formed between the inner rotor 4905 and outer rotor 4910 of machine 7000 and is expelled via an exhaust port 5120, thereby carrying debris from the chambers and out of machine 7000.

Figure 50:
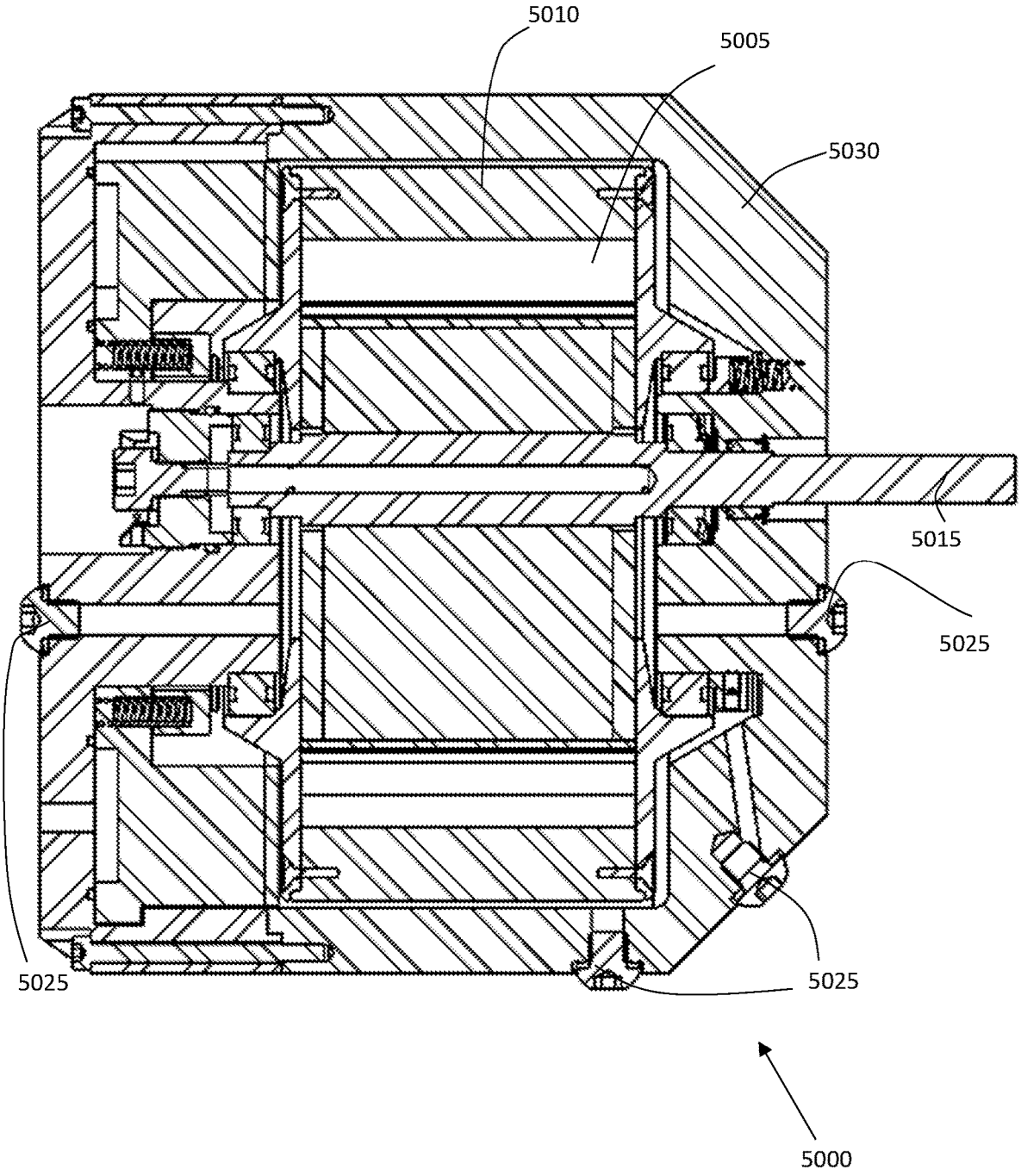
FIG. 50 is a section view of the exemplary machine shown in FIG. 49 with swarf-clearing exhaust ports plugged.
Figure 51:
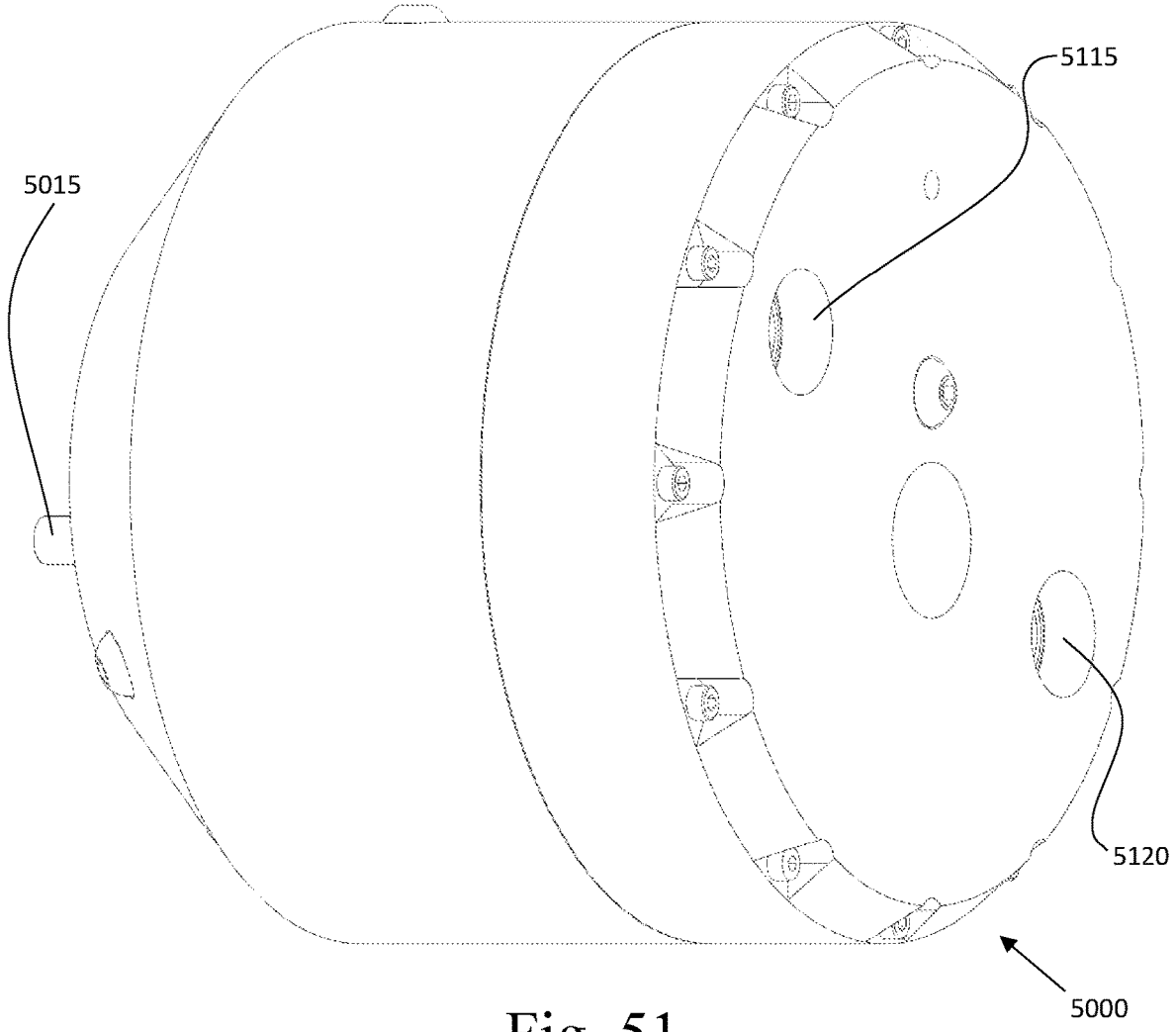
FIG. 51 is an isometric view of a housing of an exemplary machine including an input shaft, an intake port, and an exhaust port.

In a non-limiting embodiment shown in FIGS. 50 and 51 an external gas compressor is connected to the inlet port 5115 of machine 5000 whereby the compressed gas enters the chambers formed between projections of the outer rotor 5010 and inner rotor 5005. As the input shaft 5015 is rotated, the compressed gas travels through machine 5000 thereby carrying debris out of the machine 5000 through the exhaust port 5120.

Figure 48:
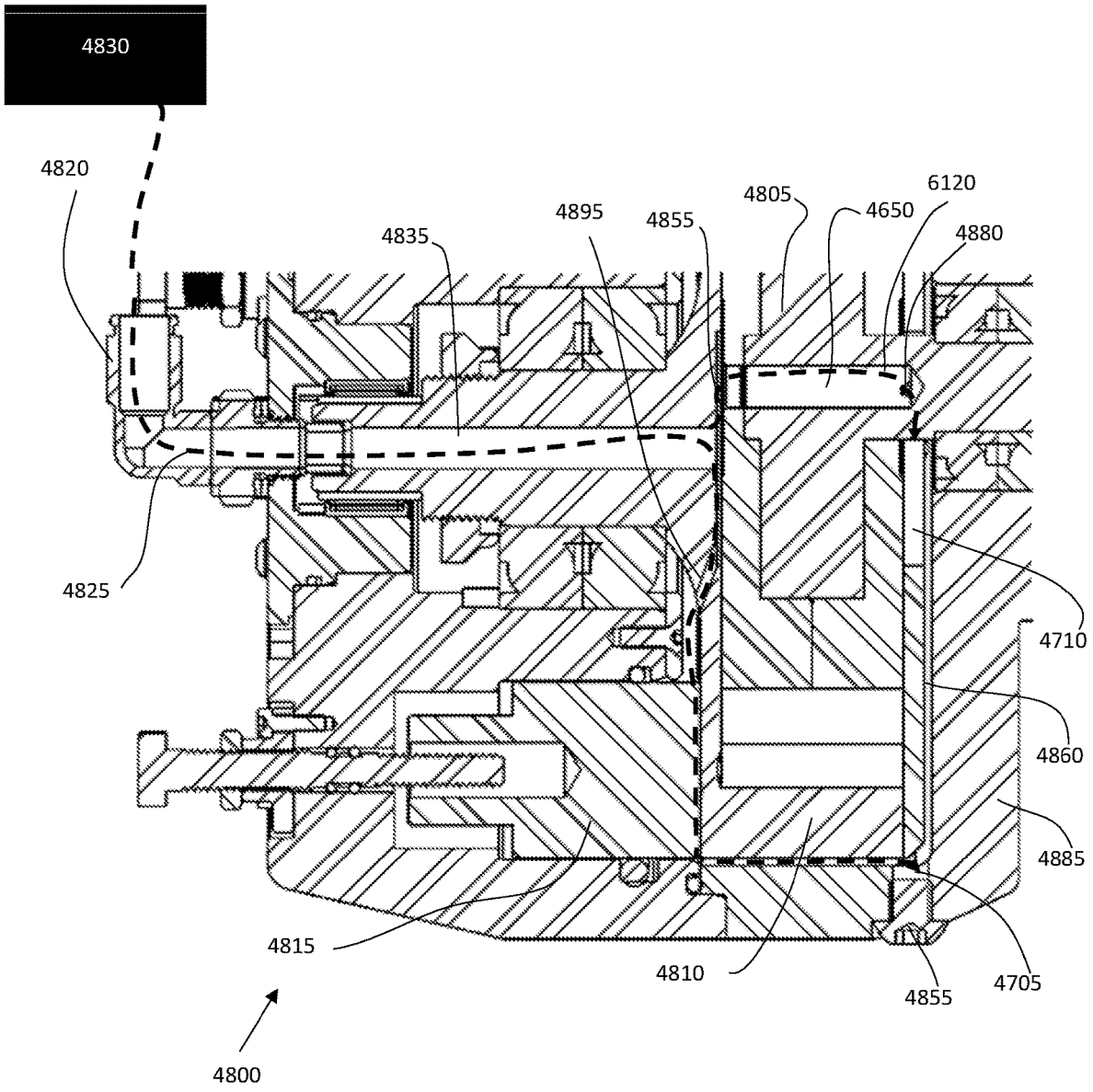
FIG. 48 is a close up section view of an exemplary machine shown in FIG. 43 having passages throughout the machine which carry pressurized air to shaping areas of the machine and which carry swarf out of the machine.

As shown by the non-limiting example in FIG. 50, plugs 5025 may be used to seal the housing 5030 of machine 5000 once the shaping/run-in process is complete. In other embodiments, fluids other than compressed gas, such as but not limited to water, coolant or alcohol may be used to flush out debris and/or remove heat. For clarity, reference numerals used in either FIG. 50 or FIG. 51 are used again in the opposite figure where applicable. Fluid supply channels supplying fluid to different interfaces may be connected together or separate, and if separate may use the same or different fluids. The fluid or fluids used may be the same as or different than a working fluid of the displacement device. The fluid supply channels may include, as shown in FIGS. 48-50, fluid channels that supply the interfaces via directions away from the interfaces, such as via the flow passage shown through the shaft of the inner rotor. Fluid flow channels may also be supplied within the interfaces, as for example indentations in the surfaces forming the interfaces which do not form close contact and thus allow debris to move through the interface from where close contact occurs to an outlet.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The invention claimed is:

1. A displacement device comprising:

a housing;

an inner rotor with an inner rotor projection number of outward-facing projections, the inner rotor being fixed for rotation relative to the housing about a first axis;

an outer rotor with an outer rotor projection number of inward-facing projections, the outer rotor being fixed for rotation relative to the housing about a second axis parallel to and offset from the first axis;

and the outward-facing projections of the inner rotor and the inward-facing projections of the outer rotor intermeshing, the outer rotor and the inner rotor configured to rotate at a relative ratio of rotation speeds defined by a ratio of the inner rotor projection number to the outer rotor projection number;

the inward-facing projections of the outer rotor having inward-most tips defining, during respective rotation of the inner rotor and the outer rotor, a hypotrochoid path relative to the inner rotor;

the inner rotor comprising tip sealing zones at tips of the outward-facing projections and trough sealing zones at troughs between the outward-facing projections, the tip sealing zones and the trough sealing zones being arranged to seal against the inward-most tips of the inward-facing projections of the outer rotor as the inward-most tips movingly trace along the hypotrochoid path during the respective rotation of the inner rotor and the outer rotor and form respective engagements with the tip sealing zones and with the trough sealing zones along the hypotrochoid path; and during at least part of each of the respective engagements with the trough sealing zones, the movingly tracing inward-most tips have the same sense as the rotation of the inner rotor; and during the entirety of each of the respective engagements of the inward-most tips of the outer rotor with the tip sealing zones, the movingly tracing inward-most tips have the opposite sense as the rotation of the inner rotor.

2. The displacement device of claim 1 in which the outer rotor projection number being greater by one than the inner rotor projection number.

3. The displacement device of claim 1 in which the tip sealing zones occur at a Bottom Dead Center zone including Bottom Dead Center (BDC) of the displacement device, and trough sealing zones occur at a Top Dead Center zone including Top Dead Center (TDC) of the displacement device, the BDC and TDC sealing zones separating the displacement device into higher and lower pressure regions.

4. The displacement device of claim 3 in which the radially inward-facing projections of the outer rotor, in combination with the sealing of the radially inward-facing projections of the outer rotor against the inner rotor, are configured to produce substantially equal and opposite torques on the outer rotor as a result of their similar surface areas exposed to higher pressure fluid at TDC and BDC.

5. The displacement device of claim 3 in which two consecutive radially inward-facing projections of the radially inward-facing projections of the outer rotor and two consecutive regions between the radially outward-facing projections of the inner rotor are respectively shaped such that a seal is maintained between the inner and outer rotor in a chamber past TDC to provide an internal expansion of compressed fluid that passes through TDC.

6. The displacement device of claim 3 in which two consecutive radially outward-facing projections of the radially outward-facing projections of the inner rotor are respectively shaped such that a seal is maintained between the inner and outer rotors in a chamber past BDC to provide an internal compression of fluid that passes through BDC.

7. The displacement device of claim 1 further comprising a screen arranged to contact a fluid flow into the displacement device, the screen arranged to cool more quickly than fluid-facing surfaces of the outer rotor when the displacement device is shut down after use.

8. The displacement device of claim 7 in which the screen is thermally connected to a heat sink exposed to an ambient temperature.

9. The displacement device of claim 1 in which the tip sealing zones or the trough sealing zones or both are configured with the inward-most tips of the outer rotor so that the tip sealing zones or the trough sealing zones or both are shaped by the inward-most tips of the outer rotor.

10. The displacement device of claim 9 in which a first inward-facing projection of the inward facing projections of the outer rotor has a first tip geometry different than a second tip geometry of a second inward-facing projection of the inward facing projections of the outer rotor, the first tip geometry having a higher rake angle with the tips of the outward-facing projections of the inner rotor in a direction of relative motion at Bottom Dead Center (BDC) and the second tip geometry having a higher rake angle at the troughs between the outward-facing projections of the inner rotor in a direction of relative motion at Top Dead Center (TDC).

11. The device of claim 10 where the first inward-facing projection has a first tip of the inward-most tips of the outer rotor, and the second inward-facing projection has a second tip of the inward-most tips of the outer rotor, arranged so that the first tip and the second tip trace a common hypotrochoid path relative to the inner rotor.

12. The displacement device of claim 10 in which the inward-facing projections of the outer rotor include a plural number of sets of projections, the projections of each set having a respective common geometry, and the outer rotor projection number being a multiple of the plural number of the sets.

13. The displacement device of claim 9 in which the inward-most tips of the inward-facing projections of the outer rotor are made of a harder material than the inner rotor at the tip sealing zones and at the trough sealing zones and in which the inward-most tips of the inward-facing projections of the outer rotor are configured to shape the tip sealing zones and the trough sealing zones in operation of the displacement device.

14. The displacement device of claim 9 in which the inward most-tips of the inward-facing projections of the outer rotor comprise pointed tips, each inward-facing projection being decreasingly tapered on the inward-facing projection in a direction away from an inner portion of the outer rotor that ends at the pointed tip.

15. The displacement device of claim 9 in which the inward-most tips of the outer rotor are configured with rounded surfaces.

16. The displacement device of claim 1 in which the tip sealing zones or the trough sealing zones or both comprise radially movable seals.

17. The displacement device of claim 16 in which the radially movable seals are radially movable at a first temperature and configured to become radially fixed at a second temperature.

18. The displacement device of claim 16 in which the radially movable seals are radially moveable within grooves and are radially movable at a first temperature and configured to become tighter fitting in the grooves at a second temperature.

19. The displacement device of claim 1 in which the inward-facing projections of the outer rotor have leading and trailing portions configured to contact the outward-facing projections of the inner rotor between the tip sealing zones and the trough sealing zones.

20. The displacement device of claim 19 further comprising flow channels arranged to prevent the formation of a sealed secondary chamber between the outward-facing projections of the inner rotor and the inward-facing projections of the outer rotor at or near Top Dead Center (TDC).

21. The displacement device of claim 19 in which the trailing portions of the inward-facing projections of the outer rotor provide relative rotational positioning of the outer rotor and the inner rotor and provide a contact ratio between the rotors in a direction of rotation of one or greater.

22. The displacement device of claim 19 in which the leading portions of the inward-facing projections of the outer rotor provide relative rotational positioning of the outer rotor and the inner rotor and provide a contact ratio between the rotors in a direction of rotation of one or greater.

23. The displacement device of claim 1 in which a trough of the troughs between the outward-facing projections has a shape such that a sealed chamber is maintained past Top Dead Center (TDC) to provide an internal expansion of fluid that passes through TDC.

24. The displacement device of claim 1 in which an inner rotor projection of the outward-facing projections has a shape such that a sealed chamber is maintained past Bottom Dead Center (BDC) to provide an internal compression of fluid that passes through BDC.

25. The displacement device of claim 1 in which the tip sealing zones, the trough sealing zones, or both comprise a shapable material, and portions of the inner rotor outward-facing projections providing rotational positioning relative to the outer rotor comprising the shapable material.

* * * * *